US008936330B2

(12) United States Patent
Kim et al.

(10) Patent No.: US 8,936,330 B2
(45) Date of Patent: Jan. 20, 2015

(54) LAUNDRY TREATING APPARATUS

(75) Inventors: Kihyuk Kim, Seoul (KR); Seunghyun Song, Seoul (KR); Minjung You, Seoul (KR); Yongcheol Jin, Seoul (KR); Eunyoung Jee, Seoul (KR); Hongjun Cho, Seoul (KR); Sanghun Bae, Seoul (KR); Donghyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/334,481

(22) Filed: Dec. 22, 2011

(65) Prior Publication Data

US 2012/0187811 A1 Jul. 26, 2012

(30) Foreign Application Priority Data

| | | |
|---|---|---|
| Dec. 23, 2010 | (KR) | 10-2010-0133674 |
| Jun. 2, 2011 | (KR) | 10-2011-0053225 |
| Jun. 2, 2011 | (KR) | 10-2011-0053385 |
| Dec. 21, 2011 | (KR) | 10-2011-0139294 |
| Dec. 21, 2011 | (KR) | 10-2011-0139447 |

(51) Int. Cl.
*F25D 25/02* (2006.01)
*A47B 49/00* (2006.01)
(Continued)

(52) U.S. Cl.
CPC ..... *D06F 39/02* (2013.01); *D06F 33/02* (2013.01); *E05D 3/10* (2013.01); *E05D 11/06* (2013.01); *E05Y 2900/132* (2013.01)
USPC ..... 312/298; 312/291; 312/292; 312/228; 312/236; 312/326; 34/601; 34/606; 16/229; 16/367; 126/190; 126/273 R; 68/196; 49/192

(58) Field of Classification Search
USPC ..... 312/292, 291, 295, 298, 228, 236, 226, 312/227, 326–329, 138.1; 34/601–610; 68/3 R, 24, 139, 196; 126/190, 194, 126/273 R; 134/56 D, 57 D, 57 DL, 58; 16/229–232, 367; 49/192
See application file for complete search history.

(56) References Cited

U.S. PATENT DOCUMENTS 872,694 A * 12/1907 Thiem ..... 126/194
1,053,829 A * 2/1913 Keith et al. ..... 16/258
(Continued)

FOREIGN PATENT DOCUMENTS

DE 10 2007 017 916 6/2008
DE 10 2007 012 980 9/2008
(Continued)

OTHER PUBLICATIONS

International Search Report and Written Opinion dated Aug. 9, 2012 issued in Application No. PCT/KR2011/010017.
(Continued)

*Primary Examiner* — Janet M Wilkens
*Assistant Examiner* — Andrew Roersma
(74) *Attorney, Agent, or Firm* — KED & Associates LLP

(57) ABSTRACT

A laundry treating apparatus is provided that includes a cabinet configured to define a profile thereof, the cabinet including a laundry introduction opening formed therein, a door configured to open and close the laundry introduction opening, a hinge including a first pivot to rotate the door along a first rotational direction and a second pivot to rotate the door along a second rotational direction that is different from the first rotational direction, a guide part installed in the cabinet having a guide groove recessed a predetermined depth therein, and a connection part installed in the door, the connection part including a guide projection received in the guide groove of which a moving path is guided, and an opening angle of the opening being variable based on positions of the guide projection.

11 Claims, 49 Drawing Sheets

(51) Int. Cl.

| | |
|---|---|
| ***A47B 97/00*** | (2006.01) |
| ***E03C 1/18*** | (2006.01) |
| ***A47B 77/08*** | (2006.01) |
| ***A47F 3/04*** | (2006.01) |
| ***F26B 11/02*** | (2006.01) |
| ***E05D 7/10*** | (2006.01) |
| ***E05D 3/10*** | (2006.01) |
| ***F23M 7/00*** | (2006.01) |
| ***F24C 14/02*** | (2006.01) |
| ***D06F 17/00*** | (2006.01) |
| ***E05D 15/52*** | (2006.01) |
| ***D06F 39/02*** | (2006.01) |
| ***D06F 33/02*** | (2006.01) |
| ***E05D 11/06*** | (2006.01) |

(56) References Cited

U.S. PATENT DOCUMENTS

| | | | | | |
|---|---|---|---|---|---|
| 1,496,466 | A | * | 6/1924 | Jackson | 16/260 |
| 2,261,147 | A | * | 11/1941 | Dow | 16/232 |
| 2,815,018 | A | * | 12/1957 | Collins | 126/190 |
| 3,018,508 | A | * | 1/1962 | Keeling, Sr. | 16/232 |
| 3,018,509 | A | * | 1/1962 | Sherman | 16/232 |
| 3,030,656 | A | * | 4/1962 | Hopkins | 16/230 |
| 3,089,327 | A | | 5/1963 | Stilwell, Jr. | 68/139 |
| 3,538,641 | A | * | 11/1970 | Lux et al. | 49/192 |
| 3,690,035 | A | | 9/1972 | Schindlauer et al. | |
| 3,802,124 | A | * | 4/1974 | Guerrini | 49/192 |
| 4,035,953 | A | | 7/1977 | Bierlich | |
| 4,096,602 | A | * | 6/1978 | Nelson | 16/85 |
| 4,503,582 | A | * | 3/1985 | Gurubatham | 16/232 |
| 4,532,673 | A | | 8/1985 | Kim | |
| 4,665,892 | A | * | 5/1987 | Spargo et al. | 126/194 |
| 5,187,836 | A | * | 2/1993 | Kim et al. | 16/231 |
| 5,530,992 | A | | 7/1996 | Baermann | |
| 5,675,934 | A | * | 10/1997 | Park | 49/193 |
| 5,829,197 | A | | 11/1998 | Oh | |
| 5,911,264 | A | * | 6/1999 | Smrke et al. | 16/258 |
| 6,000,769 | A | | 12/1999 | Chen | |
| 6,070,293 | A | * | 6/2000 | Schreiber | 16/229 |
| 6,282,838 | B1 | * | 9/2001 | Yoshikawa | 49/193 |
| 7,007,346 | B2 | * | 3/2006 | Hoffman | 16/367 |
| 7,150,486 | B2 | * | 12/2006 | Ichinose | 296/51 |
| 7,243,973 | B2 | | 7/2007 | Plett et al. | |
| 7,481,479 | B1 | * | 1/2009 | Townson et al. | 296/51 |
| 7,516,515 | B2 | | 4/2009 | Leimkuehler et al. | |
| 7,547,056 | B2 | | 6/2009 | Waldner et al. | |
| 7,669,908 | B2 | | 3/2010 | Townson | |
| 7,740,157 | B2 | * | 6/2010 | Fisher et al. | 224/328 |
| 2008/0172838 | A1 | * | 7/2008 | Choi | 16/366 |
| 2008/0245112 | A1 | * | 10/2008 | Sung | 68/12.26 |
| 2009/0025178 | A1 | * | 1/2009 | Tamayama et al. | 16/221 |
| 2009/0229316 | A1 | * | 9/2009 | Yoo et al. | 68/13 R |
| 2010/0175221 | A1 | | 7/2010 | Klassen et al. | |
| 2010/0212112 | A1 | * | 8/2010 | Steurer et al. | 16/286 |
| 2012/0161594 | A1 | * | 6/2012 | Kim et al. | 312/228 |

FOREIGN PATENT DOCUMENTS

| | | | | | |
|---|---|---|---|---|---|
| EP | 1 652 992 | A2 | | 5/2006 | |
| JP | S48-074044 | | | 10/1973 | |
| JP | S50-032545 | | | 3/1975 | |
| JP | S60-080280 | | | 6/1985 | |
| JP | S63-10185 | | | 1/1988 | |
| JP | S63-11782 | | | 1/1988 | |
| JP | 02-275696 | | | 11/1990 | |
| JP | 08-164294 | | | 6/1996 | |
| JP | 08-270308 | | | 10/1996 | |
| JP | 09-136576 | | | 5/1997 | |
| JP | 09-182709 | | | 7/1997 | |
| JP | 2000-279697 | | | 10/2000 | |
| JP | 2001-057955 | | | 3/2001 | |
| JP | 2001-065543 | | | 3/2001 | |
| JP | 2002-115713 | | | 4/2002 | |
| JP | 2005-354852 | | | 12/2005 | |
| JP | 2006-314561 | | | 11/2006 | |
| KR | 10-2007-0038720 | A | | 4/2007 | |
| KR | 10-2009-0096948 | A | | 9/2009 | |
| KR | 1020090096948 | A | * | 9/2009 | D06F 39/14 |
| RU | 2007 130 262 | | | 2/2009 | |
| WO | WO2009116752 | A2 | * | 9/2009 | D06F 39/14 |

OTHER PUBLICATIONS

International Search Report and Written Opinion dated Aug. 9, 2012 issued in Application No. PCT/KR2011/010021.

U.S. Office Action issued in U.S. Appl. No. 13/334,568 dated Oct. 22, 2013.

Russian Decision on Grant dated Jul. 15, 2014 (translation).

* cited by examiner (a)

(b)

(a)

(b)

(a)

(b)

(a)

(b)

(a)

(b)

(a)

(b)

(a)

(b)

LAUNDRY TREATING APPARATUS

CROSS-REFERENCE TO RELATED APPLICATION

This application claims priority under 35 U.S.C. §119 from Korean Application Nos. 10-2010-0133674 filed on Dec. 23, 2010; 10-2011-0053225 filed on Jun. 2, 2011; 10-2011-0053385 filed on Jun. 2, 2011; 10-2011-0139294 filed on Dec. 21, 2011; 10-2011-0139447 filed on Dec. 21, 2011 the subject matter of which is incorporated herein by reference.

BACKGROUND

1. Field

Embodiments may relate to a laundry treating apparatus, more particularly, to a laundry treating apparatus which can secure an open door at various angles.

2. Background

Generally, a laundry treating apparatus may be categorized into a washing-only apparatus only having a washing function, a drying-only apparatus only having a drying function and a laundry washing/drying apparatus having both of the washing and drying functions. Also, based on a structure and a type, the laundry treating apparatuses may be categorized into a drum type laundry treating apparatus which dries laundry while tumbling the laundry by using a rotatable drum and a cabinet type laundry treating apparatus which dries laundry while hanging the laundry therein.

In a conventional washing/drying apparatus, a laundry introduction opening is formed in a front of a cabinet to introduce laundry there through. Also, a door may be installed to the front of the cabinet to open and close the laundry introduction opening. Here, the door includes a single shaft capable of rotating along a right and left direction to open and close the opening.

In the meanwhile, the laundry treating apparatus that is the drying-only apparatus may be arranged next to a lateral side of the washing-only apparatus in a line. To dry the laundry washed in the washing-only apparatus, a user may typically unload the washed laundry out of the washing-only apparatus and he or she may load it into the drying-only apparatus via the laundry introduction opening.

In the conventional laundry treating apparatus including the washing/drying apparatus or the drying-only apparatus, the door is able to be fixed in a state of closing the opening through which the laundry is introduced, not enough to be secured to maintain a state of partially opening the opening, which may be a disadvantage.

SUMMARY

Accordingly, the embodiments may be directed to a laundry treating apparatus. To achieve these objects and other advantages and in accordance with the purpose of the embodiments, as embodied and broadly described herein, a laundry treating apparatus includes a cabinet configured to define a profile thereof, the cabinet comprising a laundry introduction opening formed therein; a door configured to open and close the laundry introduction opening; a hinge unit comprising a first pivot to rotate the door along a first rotational direction and a second pivot to rotate a second rotational direction that is different from the first rotational direction; a guide part installed in the cabinet, with a guide groove recessed a predetermined depth; and a connection part installed in the door, the connection part comprising a guide projection received in the guide groove of which a moving path is guided, wherein an opening angle of the opening is variable based on positions of the guide projection.

The guide projection may be stopped at a plurality of positions in the guide groove.

The guide groove may include a first guide groove configured to guide the guide projection to stop the door at a first angle, and a first seating protrusion is formed at an end of the first guide groove to seat the guide projection therein.

The guide groove may further include a second guide groove configured to guide the guide projection to stop the door at a second angle, and a second seating protrusion may be formed at an end of the second guide groove to seat the guide projection therein.

The guide groove may further include a third guide groove configured to guide the guide projection to stop the door at a third angle.

A guide piece may be projected from the guide groove to limit the motion of the guide projection.

In another aspect, a laundry treating apparatus includes a cabinet configured to define a profile thereof, the cabinet including a laundry introduction opening formed therein; a door configured to open and close the laundry introduction opening; and a hinge unit including a first pivot to rotate the door along a first rotational direction and a second pivot to rotate a second rotational direction that is different from the first rotational direction, wherein the door is selectively rotated along one of the first and second rotational directions.

The door may be detached from the second pivot when the door is rotated along the first rotational direction, and the door may be detached from the first pivot when the door is rotated along the second rotational direction.

The first pivot may be perpendicular to the second pivot.

The hinge unit may include a first hinge configured to rotatably secure the door to the cabinet when the door is rotated along the first rotational direction.

The hinge unit may include a second hinge configured to rotatably couple the door to the cabinet when the door is rotated along the first rotational direction and the second rotational direction.

The second hinge may include a second shaft forming the first pivot and a third shaft forming the second pivot.

The hinge unit may include a third hinge configured to secure the door to the cabinet when the door is rotated along the second rotational direction.

In a further aspect, a laundry treating apparatus includes a cabinet configured to define a profile thereof, the cabinet comprising a laundry introduction opening formed therein; a door configured to open and close the laundry introduction opening; and a second hinge comprising a second shaft forming a first pivot to rotate the door along a first rotational direction and a third shaft forming a second pivot to rotate the door along a second rotational direction, wherein the door is able to be secured at a plurality of rotational angles.

The plurality of the rotational angles may include a first angle and a second angle larger than the first angle, and the door may be secured after opened the second angle larger than the first angle, when an external force is applied to the door secured at the first angle.

The laundry treating apparatus may further include a door tilting adjusting part configured to adjust a rotational angle when the door is rotated on the second pivot.

The laundry treating apparatus may further include a third hinge comprising a fourth shaft forming the second pivot and a door supporter of which a detaching angle from the cabinet is adjusted by the door tilting adjusting part.

The second hinge may include a hinge supporter of which a detaching angle from the cabinet is adjusted by the door tilting adjusting part.

The laundry treating apparatus may further include a fourth hinge comprising a fifth shaft forming the second pivot and a cabinet detaching part installed in the cabinet to be detachably secured to the fifth shaft.

The fourth hinge may include a first adjusting plate provided in the fifth shaft and a first detaching part provided in the door to adjust the rotational angle of the door, with being detachable from the first adjusting plate.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein:

FIGS. 29 and 30 are diagrams illustrating a fifth shaft detecting part having a fifth shaft of the fourth hinge detachable there from;

DETAILED DESCRIPTION

To solve the disadvantages mentioned above, embodiments may provide a laundry treating apparatus including a door which is able to be secured in a state of partially opening a laundry introduction opening.

Furthermore, the embodiments may provide a laundry treating apparatus which is able to adjust an opening degree of the door with respect to the laundry introduction opening variously and to fix the rotated degree that is changed variously.

As follows, exemplary embodiments will be described in detail in reference to the accompanying drawings. Reference may now be made in detail to specific embodiments, examples of which may be illustrated in the accompanying drawings. Wherever possible, same reference numbers may be used throughout the drawings to refer to the same or like parts.

Figure 1:
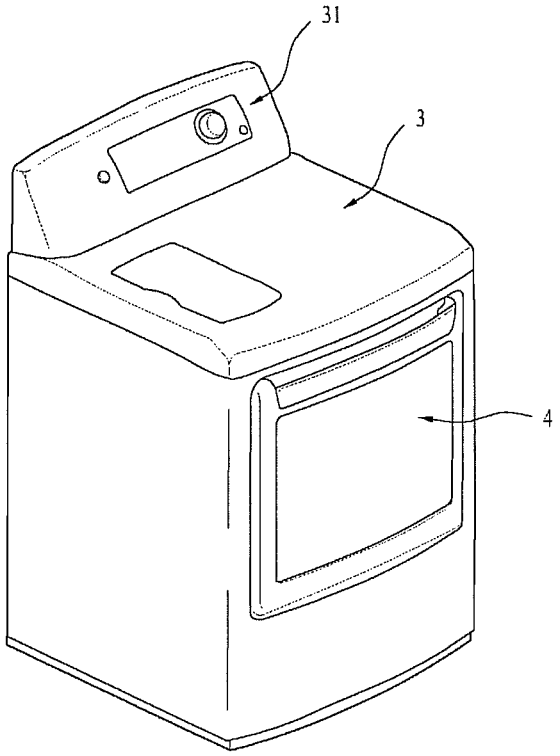
FIG. 1 is a perspective view illustrating a laundry treating apparatus according to an exemplary embodiment.
Figure 2:
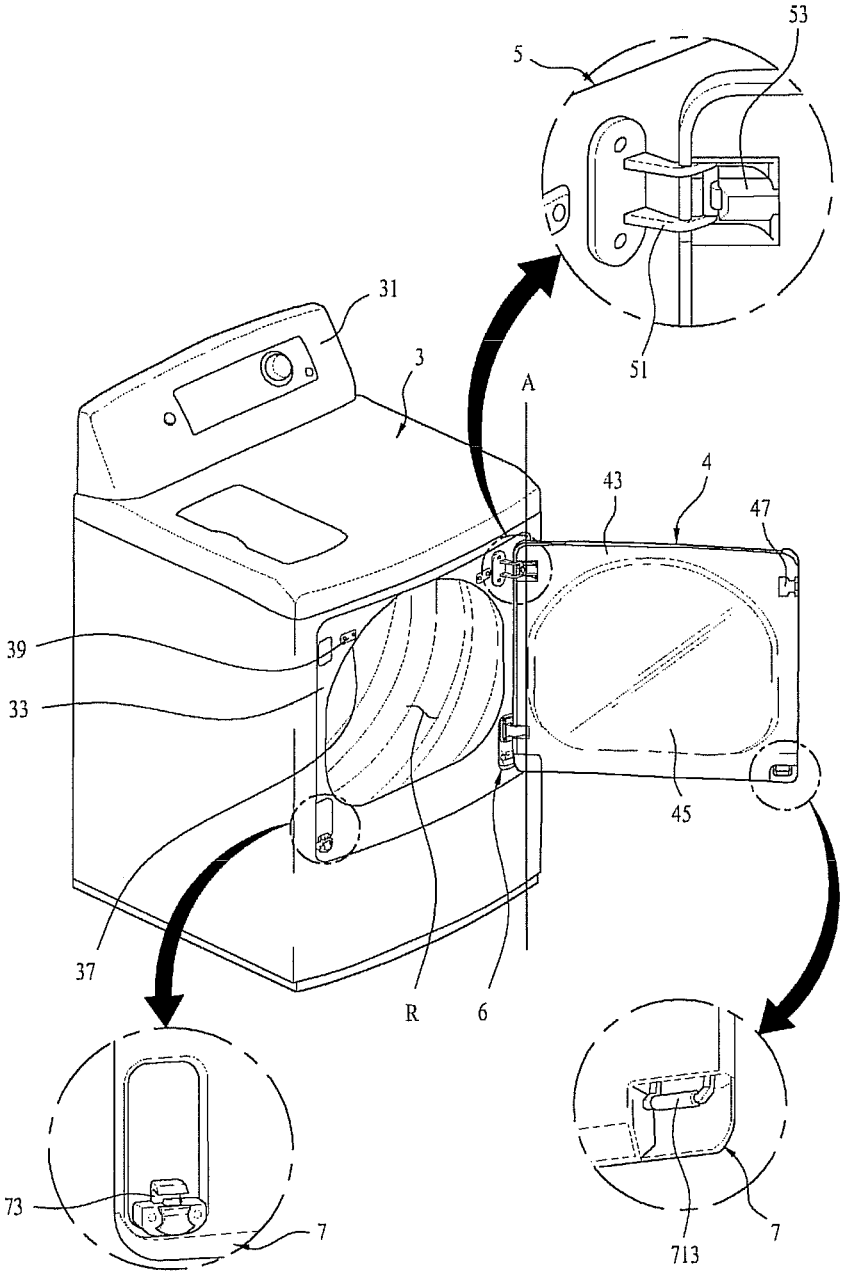
FIG. 2 is a diagram illustrating a door shown in FIG. 1 which is rotated along a first rotational direction.
Figure 3:
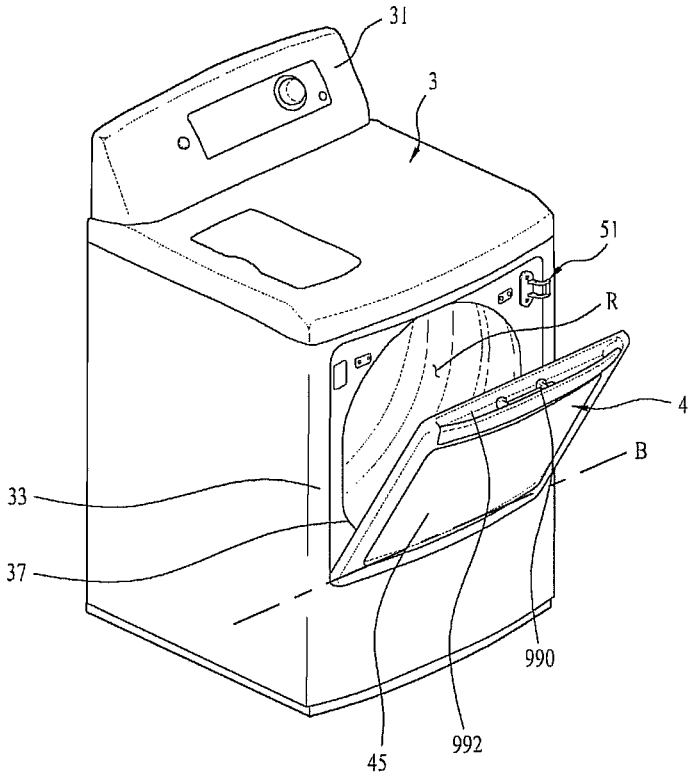
FIG. 3 is a diagram illustrating the door shown in FIG. 1 which is rotated along a second rotational direction.

FIG. 1 is a perspective view illustrating a laundry treating apparatus according to an exemplary embodiment. FIG. 2 is a diagram illustrating a door shown in FIG. 1 which is rotated along a first rotational direction. FIG. 3 is a diagram illustrating the door shown in FIG. 1 which is rotated along a second rotational direction. As follows, the laundry treating apparatus according to the embodiment will be described in reference to FIGS. 1 to 3.

The laundry treating apparatus according to the embodiment may include a cabinet 3 having a laundry accommodating room (R) and a laundry introduction opening 37 enabling laundry loaded into the laundry accommodating room, a door 4 provided to open and close the opening 37, and a hinge unit 5, 6, and 7 configured to rotate the door 4 to open and close the opening, along different directions.

The cabinet 3 may define a profile of the laundry treating apparatus and the laundry introduction opening 37 may be provided through an outer panel 33 provided in a side of the cabinet to communicate with the laundry accommodating room (R).

A locking projection receiving part 39 may be provided in the outer panel 33 to receive a locking projection 47 provided in the door 4. The locking projection 47 of the door 4 may be received in the locking projection receiving part 39 provided in the cabinet, such that the door 4 may open and close the laundry introduction opening.

In the meanwhile, a control panel 31 may be provided on the cabinet 3 to enable a user to input a control command to the laundry treating apparatus.

The hinge unit 5, 6 and 7 may form a first pivot (A) to rotate the door to open and close the opening 37 and a second pivot (B) to rotate the door 4 to open and close the opening 37 along a different direction from a direction of the first pivot (A). The first pivot (A) may be vertical to the cabinet 3 and the second pivot (B) may be horizontal to the cabinet 3.

The first pivot may be formed by a first hinge 5 and a second hinge 6. The second pivot may be formed by the second hinge 6 and a third hinge 7.

In FIGS. 2 and 3, the first pivot (A) may be formed along a longitudinal direction of the cabinet 3 (A vertical pivot) and the second pivot (B) may be formed along a width direction of the cabinet (A horizontal pivot). However, the location of the first pivot and the location of the second pivot may not be limited to what shown in FIG. 2 necessarily.

In other words, the first pivot and the second pivot may be located at various positions of the cabinet only if they enable the door to be rotated along various directions to open the opening (only if the first pivot and the second pivot form a preset angle). Here, the direction of the first pivot (the first direction) may be different from the direction of the second pivot (the second direction).

Here, as shown in FIG. 3, the second pivot may be provided along the width direction of the cabinet to enable the door to be tilted with respect to a lower end of the opening 37. In this case, there may be an effect of efficient laundry loading caused by adjusting a tilting angle of the door, which will be described later.

The hinge unit may include the first hinge 5 having a first shaft consisting of the first pivot (A) to couple and detach the door to and from the cabinet 3, the second hinge 6 having a second shaft consisting of the first pivot (A) together with the first shaft and a third shaft consisting of the second pivot (B), and the third hinge 7 having a fourth shaft consisting of the second pivot (B) together with the third shaft to couple and detach the door 4 to and from the cabinet 3.

The first hinge 5 may include the first shaft 51 forming the first pivot and a first shaft detaching part 53 having a first receiving groove formed therein to receive the first shaft 51. The first shaft 51 may be installed in the cabinet 3 and the first shaft detaching part 53 may be provided in the door 4. Alternatively, the first shaft 51 may be installed in the door 4 and the first shaft detaching part 53 may be installed in the cabinet 3.

The third hinge 7 may include the fourth shaft 713 to form the second pivot (B) and a fourth shaft detaching part 73 having a second receiving groove formed therein to receive the fourth shaft 713. The fourth shaft 713 may be installed in the door 4 and the fourth shaft detaching part 73 may be provided in the cabinet 3. Alternatively, the fourth shaft 713 may be installed in the cabinet 3 and the fourth shaft detaching part 73 may be installed in the door 4.

As shown in FIG. 2, when the door is rotated along a first direction, the first hinge 5 and the second hinge 6 may rotatably couple the door 4 to the cabinet 3. At this time, the third hinge 7 may detach the door 4 from the cabinet 3.

In contrast, as shown in FIG. 3, when the door is rotated along a second direction, the second hinge 6 and the third hinge 7 may rotatably couple the door 4 to the cabinet 3. At this time, the first hinge 5 may detach the door 4 from the cabinet 3.

In other words, when the door 4 is rotated along one of the first and second directions, the second hinge 6 may be secured with respect to both of the directions and the first hinge 5 and the third hinge 7 may couple or detach the door 4 to or from the cabinet 3.

The door 4 may include an inner frame 43 provided toward the outer panel 33 and an outer frame 41 coupled to the inner frame to from a profile of the door 4.

The door may further include a transparent part 45 insertedly provided in the opening 37. The transparent part 45 may prevent the laundry located in the laundry accommodating room (R) from coming out through the laundry introduction opening and it may also allow the user to see the laundry accommodating room (R) during the operation of the laundry treating apparatus.

As shown in FIG. 3, a recessed part 992 recessed a preset distance along a longitudinal direction may be provided at an upper end of the door 4. The recessed part 992 may be longitudinally extended along a width direction of the door 4 and it may be extended as long as the horizontal length of the door 4.

A pressing piece 990 that is able to be grasped by the user may be provided at a center of the recessed part 992. The pressing piece 990 may be installed at the center of the door 4 to allow the user to press the door 4 when rotating it along the second rotational direction. When the user is pressing the pressing piece 990, the door 4 may be stably rotated along the rotational direction the user selects by a variety of elements installed in the door 4 which will be described later.

In the meanwhile, the user may grasp the recessed part 992 to rotate the door 4, without grasping the pressing piece 990 located at the center of the recessed part 992. When trying to rotate the door 4 along the first rotational direction, not the second rotational direction, the user may grasp not the pressing piece 990 but other portions of the recessed part 992 where the pressing piece 990 is not located, to rotate the door 4. For example, when the trying to rotate the door along the first rotational direction, the user may grasp a portion located in opposite to the first pivot (A) of the first rotational direction and he or she may open the door 4 after that.

Figure 4:
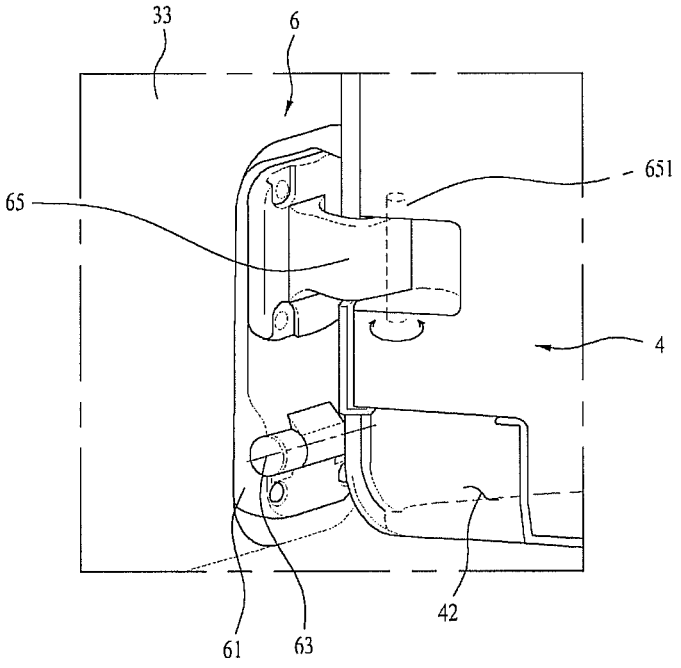
FIG. 4 is a diagram illustrating a second hinge which is rotated along a first rotational direction.
Figure 5:
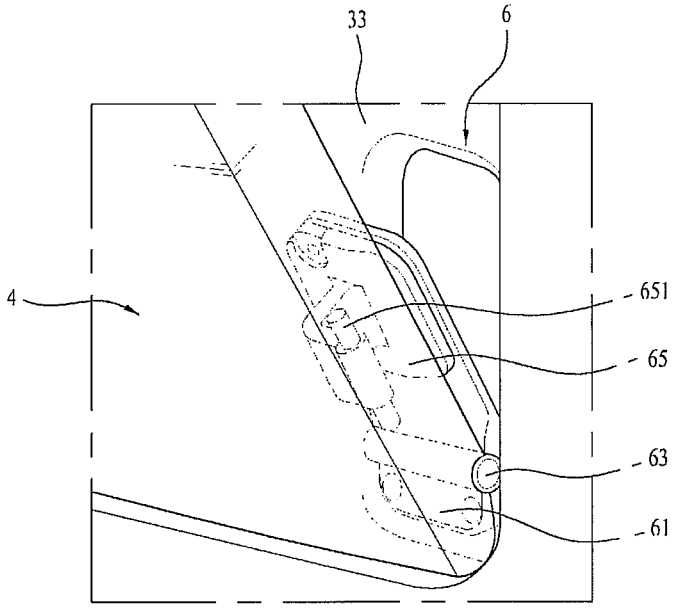
FIG. 5 is a diagram illustrating the second hinge which is rotated along a second rotational direction.

FIG. 4 is a diagram illustrating the second hinge which is rotated along a second rotational direction. FIG. 5 is a conceptual diagram illustrating an open stat of the door. As follows, the embodiment will be described in reference to FIGS. 4 and 5.

The second hinge 6 may couple the cabinet 3 to the door 4, to secure the door 4 in a state of being selectively rotatable along the first and second rotational directions. The second hinge 6 may allow the door 4 to be rotatably coupled to the cabinet 3 when the door 4 is rotated on both of the first and second pivots.

The second hinge 6 may include a cabinet securing part 61 secured to the cabinet 3 and a door securing part 65 secured to the door 4.

The second shaft 651 consisting of the first pivot may be provided in the door securing part 65. The door 4 may be rotated on the second shaft 651 along the first rotational direction and it may be rotated on the second shaft 651 with respect to the door securing part 65.

The door securing part 65 and the cabinet securing part 61 may be rotatable on the third shaft 63. The third shaft 63 may consist of the second pivot and the door 4 may be rotated on the third shaft 63 along the second rotational direction.

As shown in FIG. 4, the door securing part 65 and the cabinet securing part 61 may not be bent at the third shaft 63 when the door 4 is rotated along the first rotational direction. When the door 4 is rotated along the first rotational direction, no relative motion is generated between the door securing part 65 and the cabinet securing part 61. Because of that, the coupling between the door securing part 65 and the cabinet securing part 61 may be maintained without change.

A recess 42 recessed to a preset depth may be formed at a lower end of the door 4 and the recess 42 may provide a predetermined space where the cabinet securing part 61 is received. As shown in FIG. 5, the recess 42 may form a sufficient space not to generate interference between the cabinet securing part 61 and the lower end of the door 4 and the door 4 is rotated along the second rotational direction.

When the door 4 is rotated along the second rotational direction, the lower end of the door 4 may be moved toward the cabinet 3. As a result, a predetermined space has to be provided between the door 4 and the cabinet 3 to rotate the door 4 along the second rotational direction. For that, the recess 42 may be formed at the lower end of the door 4 and the door 4 may be rotated as far as the space provided by the recess 42 accordingly.

As shown in FIG. 5, when the door 4 is rotated along the second rotational direction, the door securing part 65 and the cabinet securing part 61 may be bent at the third shaft 63. In other words, when the door 4 is rotated along the second rotational direction, the door 4 may not be rotated along the first rotational direction and the door 4 may not be rotated on the second shaft 651 accordingly.

Figure 6:
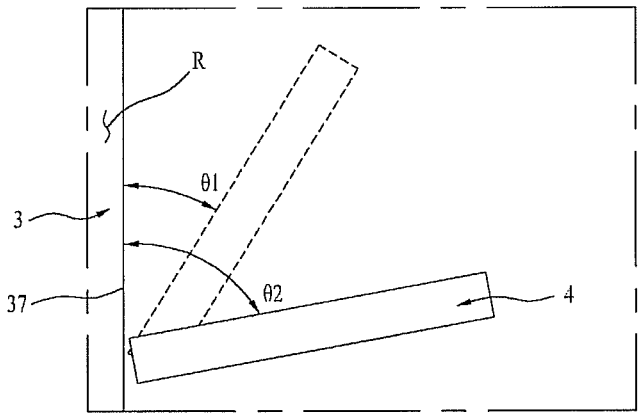
FIG. 6 is a conceptual diagram illustrating an open stat of the door.

FIG. 6 is a conceptual diagram illustrating an open stat of the door. As follows, the embodiment will be described in reference to FIG. 5.

The door 4 may open the laundry introduction 37 at two angles with respect to the cabinet 3. In other words, as shown in FIG. 6, the door 4 may be coupled at a position of opening the laundry introduction opening 37 relatively less and a position of opening the laundry introduction opening 37 relatively more, in a state of having opened the laundry introduction opening 37. At this time, an angle at which the door 4 is opening the laundry introduction opening 37 relatively less may be referenced to as 'a first angle (θ1)' and an angle at which the door 4 is opening the laundry introduction opening 37 relatively more may be referenced to as 'a second angle (θ2)'.

The first angle may be approximately 30 degrees and the second angle may be approximately 85~90 degrees. Here, the first angle and the second angle may be changed into other values from the values mentioned above.

Based on the embodiment, it may be possible to stop the door 4 at other angles rather than the first and second angles. For explanation convenience, an angle at which the door 4 closes the opening 37, that is, an angle of the door 4 standing vertically may be referenced to as 'a third angle'.

According to the embodiment, the door 4 may be open the laundry introduction opening 37 at two positions to introduce the laundry via the opening 37.

For example, the angle of the door 4 may be relatively close to being perpendicular at a position at which the door 4 opens the opening 37 less. As a result, when the user tries to load the laundry into the opening 37, the laundry may be introduced into the laundry accommodating room smoothly via the laundry introduction opening 37 because of a tilted angle of the door 4, even if the laundry collides against the door 4.

In contrast, when the door 4 opens the opening 37 less in case the user tries to unload the laundry accommodated in the laundry accommodating room (R) via the laundry introduction opening 37, inconvenience might be given to the user. For the user to unload the laundry smoothly after putting his or her arm into the laundry accommodating room (R), it is necessary for the door 4 to open the laundry introduction opening 37 sufficiently. As a result, the door 4 has to be coupled in a state of having opened the laundry introduction opening 37 relatively more.

Figure 7:
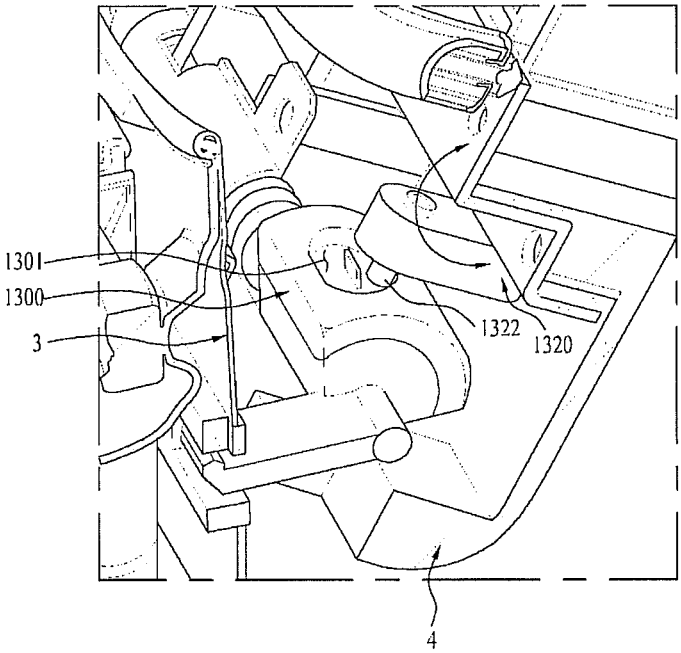
FIG. 7 is a perspective view illustrating key parts of the laundry treating apparatus according to the embodiment.

FIG. 7 is a perspective view illustrating key parts of the laundry treating apparatus according to the embodiment. As follows, the embodiment will be described in reference to FIG. 7.

The laundry treating apparatus according to the embodiment may include a guide part 1300 installed in the cabinet 3 and a connection part 1320 installed in the door 4.

A guide groove 1301 recessed a predetermined depth may be formed in the guide part 1300. A guide projection 1322 may be provided in the connection part 1320 to be received in the guide groove 1301 to have a moving path thereof guided. The guide projection 1322 may be guided according to the shape of the guide groove 1301.

In the meanwhile, the guide projection 1322 may be stopped at various positions of the guide groove 1301 while being moved along the shape of the guide groove 1301 in the guide groove 1301. At this time, an opening degree of the laundry introduction opening 37 may be differentiated based on the positions of the guide projection 1322.

Especially, the guide groove 1301 may be recessed toward the pivot of the door 4. In other words, the guide groove 1301 may be recessed toward the center of the pivot, that is, along an opposite direction to a radial direction of the pivot. The pivot of the door 4 may be arranged underneath the door 4 and it may be the center of the rotation of the door 4 along a clockwise direction or a counter-clockwise direction with respect to FIG. 6. When the door 4 is rotated along the clockwise direction, an opening degree of the laundry introduction opening may be increased. When the door 4 is rotated along the counter-clockwise direction, the opening degree may be decreased.

The guide projection 1322 may be projected correspondingly toward the recessed direction of the guide groove 1301 to be moved in a state of received in the guide groove 1301.

The connection part 1320 may be rotatably shaft-coupled to the door 4. As shown in an arrow line of FIG. 6, the connection part 1320 may be moved with being freely rotatable with respect to the door 4 and it may be moved along the shape of the guide groove 1301.

Figure 8:
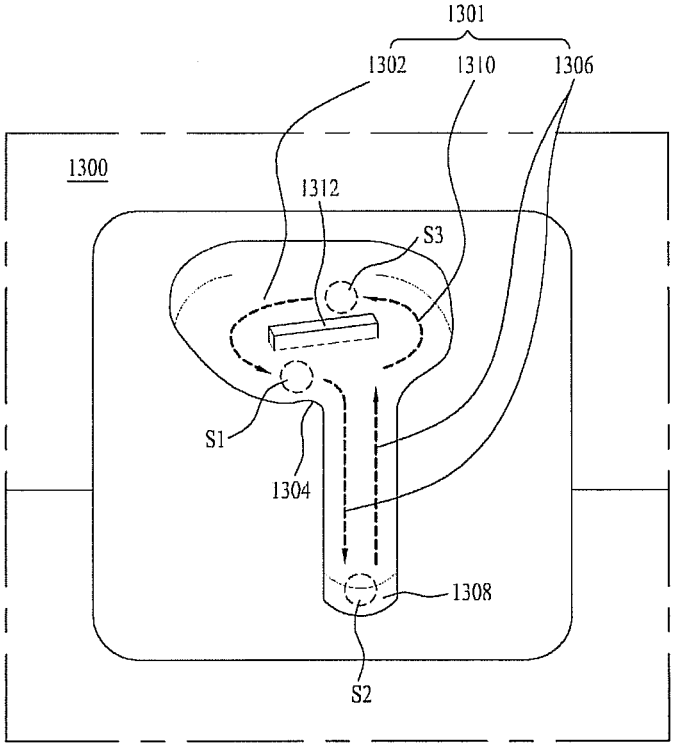
FIG. 8 is a diagram specifically illustrating a guide part shown in FIG. 7.

FIG. 8 is a diagram specifically illustrating the guide part shown in FIG. 7 and the guide part will be described in reference to FIG. 8 as follows.

The guide groove 1301 may include three guide grooves of a first guide groove 1302, a second guide groove 1306 and a third guide groove 1310. The first guide groove 1302, the second guide groove 1306 and the third guide groove 1310 may be connected with each other, such that the guide projection 1322 may be movable from each of the guide grooves to another.

The first guide groove 1302 may guide the guide projection 1322 to stop the door 4 at the first angle and a first seating protrusion 1304 may be formed at an end of the first guide groove 1302 to seat the guide projection 1322 at the first angle.

The first seating protrusion 1304 may reduce the width of the first guide groove 1302 by a predetermined value. Here, the first seating protrusion 1304 may be upwardly projected a predetermined distance from a lower end of the first guide groove 1302. That is, the guide projection 1322 may be stopped at the moment when meeting the first seating protrusion 1304 in the middle of passing the first guide groove 1302, such that the door 4 may be stopped at the first angle.

The second guide groove 1306 may guide the guide projection 1322 to stop the door at the second angle and a second seating protrusion 1308 may be formed at an end of the second guide groove 1306 to seat the guide projection 1322 at the second angle.

The second seating protrusion 1308 may finish the end of the second guide groove 1306 and the guide projection 1322 may not move downwardly after stopped by the second seating protrusion 1308.

The third guide groove 1310 may guide the guide projection 1322 to stop the door 4 at the third angle at this time, the third angle may be the angle at which the door 4 is arranged perpendicularly to close the opening 37 airtight, different from the first and second angles.

In the meanwhile, a guide piece 1312 projected from the guide groove 1301 may be provided at a center of the guide groove 1301 to limit the motion of the guide protrusion 1322. The guide piece 1312 may be projected toward an opposite direction to the recessed direction of the guide groove 1301. The guide piece 1312 may be moved along a path formed in the guide groove 1301 receiving the guide projection 1322.

The first guide groove 1302 may be divided into a portion located beyond the guide piece 1312 and a portion located below the guide piece 1312.

At this time, the first guide groove 1302 located beyond the guide piece 1312 may be inclined a predetermined angle to move downwardly along the direction of the moving guide projection 1322. This is to move the guide projection 1322 in the first guide groove 1302 even without a large force applied by the user, because the door 4 has a self weight.

An operation method of the laundry treating apparatus according to the embodiment will be described in reference to FIGS. 1 to 8.

First of all, the door 4 may be stopped at the end (S3) of the first guide groove 1302 shown in FIG. 8, in a state of being arranged at the third angle, that is, a state of having closed the opening 37.

In the state of the door 4 being stopped at the end (S3) of the first guide groove 1302, the user may apply a force to rotate the door 4 along the clockwise direction with respect to the cabinet 3. In this case, the guide projection 1322 may be moved along the first guide groove 1302 and the door 4 may get increasing an opening angle of the opening 37 gradually.

The guide projection 1322 may be moved along the first guide groove 1302 arranged beyond the guide piece 1312. At this time, the guide piece 1312 may be tilted downwardly with respect to the moving direction of the guide projection 1322 and the guide projection 1322 may be moved along the first guide groove 1302 by the weight of the door 4 because of that.

Hence, the door may increase the opening angle of the laundry introduction opening 37, while the guide projection 1322 is moving along the first guide groove 1302 arranged below the guide piece 1312. Since the guide projection 1322 is moving lower than the position of S3, the door 4 may be rotated along the clockwise direction and it may be identified that the opening angle of the opening 37 is increased.

As the guide projection 1322 reaches the first seating protrusion 1304 after moved to the end of the first guide groove 1302, the guide projection may be seated on the first seating protrusion 1304. The motion of the guide projection 1322 may be stopped at a position (1) where the first seating protrusion 1304 is formed. The first seating protrusion 1304 may be formed to move upward a predetermined height, to stop the motion of the guide projection efficiently.

When the user desires for the door 4 to open the opening 37 at the second angle that is larger than the first angle, the user may apply an additional force to the door 4.

Because of the force applied by the user, the guide projection 1322 may be getting out of the first seating protrusion 1304 and it may be moved along the second guide groove 1306 after that. The guide projection 1322 may be moved to the second guide groove 1306 out of the first guide groove 1306, because an end of the first guide groove 1302 is connected with the second guide groove 1306. After that, the guide projection 1306 may be guided along the second guide groove 1306.

The second guide groove 1306 may be extended downward along a longitudinal direction. Because of that, the guide projection 1322 may be moved downwardly along the shape of the second guide groove 1306. The connection part 1320 may be freely rotatable with respect to the door 4 but it may not be extended along the longitudinal direction. Because of that, the connection part 1320 may rotate the door 4 along the shape of the second guide groove 1306.

When it is moved to the position (S2) to be in contact with the second seating protrusion 1308 within the second guide groove 1306, the guide projection 1322 may be seated in the second seating protrusion 1308 to be stopped. As a result, the rotation of the door 4 may be stopped and the door 4 may open the opening 37, in a state of being tilted at the second angle.

In the meanwhile, when desiring for the door 4 to close the laundry introduction opening 37, the user may apply a force to the door 4 to rotate the door 4 along the counter-clockwise direction. In this case, the guide projection 1322 may be moved to the third guide groove 1310, with being moved upwardly in the second guide groove 1306. An end of the second guide groove 1306 may be connected with the third guide groove 1310. Because of that, the guide projection 1322 may be moved to the third guide groove 1310 out of the second guide groove 1306.

While the guide projection 1322 is moving upwardly in the third guide groove 1310, the door 4 may decrease the opening angle of the opening 37. When the guide projection 1322 reaches a position (S3) where the third guide groove 1310 is connected with the first guide groove 1302, the motion of the guide projection 1322 may be stopped and the door 4 may be stopped at the third angle. As a result, the door 4 may close the laundry introduction opening 37 airtight.

Entirely, the position of the guide projection 1322 may be changed from S1->S2->S3->within the guide groove 1301 and it may be fixed at each of the positions.

At this time, an auxiliary securing member may be used for securing the door 4 at the third angle, that is, the state of closing the opening 37.

For that, the locking projection receiving part and the locking projection may be used at the position where the door 4 meets the cabinet 3 to maintain the secured state of the door 4.

In contrast, when desiring to move the door from the first angle to the third angle without passing the second angle, that is, to move the door 4 to close the opening 37, the user may apply a force to the door 4 along the counter-clockwise direction and the guide projection may be moved from the first guide groove 1302 to the third guide groove 1310. At this time, the guide projection 1322 seated in the first seating protrusion 1304 may be released and the guide projection may be guided from the first guide groove 1302 to the third guide groove 1310. Entirely, the first guide groove 1302, the second guide groove 1306 and the third guide groove 1310 may be formed to meet at a single point. In this case, the guide projection 1322 may be moved from S1->S3 within the guide groove 1301.

Figure 9:
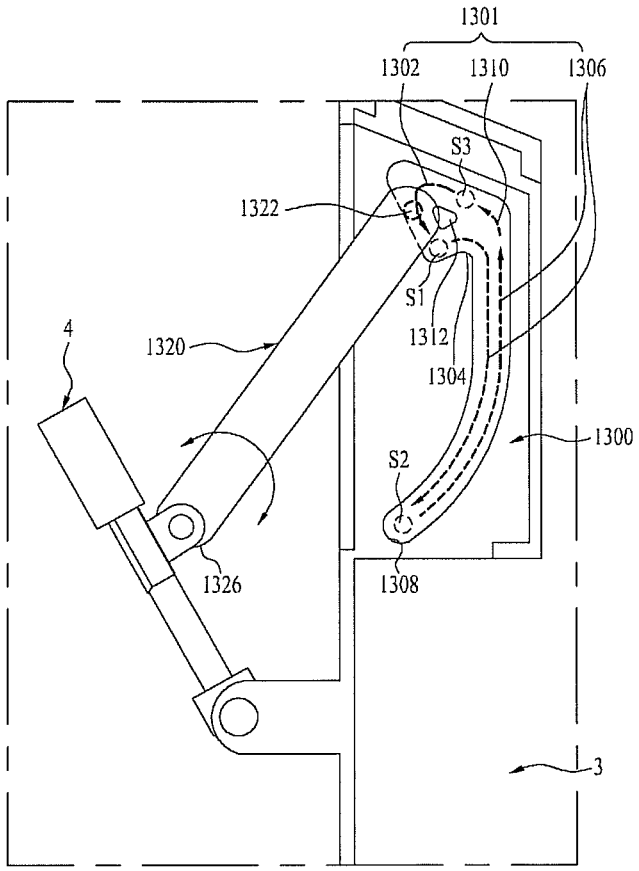
FIG. 9 is a diagram illustrating a laundry treating apparatus according to another embodiment.

FIG. 9 is a diagram schematically illustrating a laundry treating apparatus according to another embodiment. As follows, the laundry treating apparatus according to the embodiment will be described in reference to FIG. 9.

Different from the embodiment described above, according to this embodiment, the guide groove 1301 may be recessed along a longitudinal direction of the pivot of the door 4. Assuming that the pivot of the door 4 is located at a lower end of the door 4, the pivot of the door 4 may be formed toward a direction passing through the drawing.

At this time, the guide groove 1301 may be installed in a lateral wall of the cabinet 3. Here, the guide groove 1301 may be formed in a variety of elements consisting of a wall body to arrange the guide groove 1301 therein perpendicularly. In other words, an auxiliary perpendicular wall may be added to the cabinet 3 to form the guide groove 1301. Alternatively, the guide groove 1301 may be formed in the existing lateral wall provided in the cabinet 3.

The connection part 1320 may be rotatably provided to the door 4. Alternatively, the connection part may be provided in the hinge provided in the door 4. To make the drawing look simple, FIG. 9 shows that the connection part 1320 is connected with some elements of the door, not the entire elements thereof.

The connection part 1320 may include a connection joint 1326 connected to the door 4 via the shaft. The connection part may be shaft-coupled to the door 4 via the connection joint 1326.

The guide groove 1301 may include the three guide grooves of the first guide groove 1302, the second guide groove 1306 and the third guide groove 1310. The first guide groove 1302, the second guide groove 1306 and the third guide groove 1310 may be connected with each other.

The first guide groove 1302 may guide the guide projection 1322 to stop the door 4 at the first angle and the first seating protrusion 1304 may be formed at an end of the first guide groove 1302 to seat the guide projection 1322 at the first angle.

The first seating protrusion 1304 may reduce the width of the first guide groove 1302 by a predetermined value. Here, the first seating protrusion 1304 may be upwardly projected a predetermined height from a lower end of the first guide groove 1302. In other words, the guide projection 1322 may be stopped at the moment of meeting the first seating protrusion 1304, while passing through the first guide groove 1302. Because of that, the door 4 may be stopped at the first angle.

The second guide groove 1306 may guide the guide projection 1322 to stop the door 4 at the second angle and a second seating protrusion 1308 may be formed at an end of the second guide groove 1306 to seat the guide projection therein at the second angle.

The second seating protrusion 1308 may finish the end of the second guide groove 1306 and the guide projection 1322 may not be moved downwardly after seated in the second seating protrusion 1308.

The third guide groove 1310 may guide the guide projection 1322 to stop the door 4 at the third angle. At this time, the third angle may be an angle at which the door is arranged perpendicularly to close the laundry introduction opening 37 airtight, different from the first and second angles.

In the meanwhile, a guide piece 1312 projected from the guide groove 1301 may be provided at a center of the guide groove 1301 to limit the motion of the guide projection 1322. The guide piece 1312 may be projected along an opposite direction to the recessed direction of the guide groove 1301.

At this time, the portion of the first guide groove 1302 arranged beyond the guide piece 1312 may be tilted to move the guide projection 1322 upwardly, which is different from the embodiment described above. In other words, the guide projection 1322 may be moved upwardly in a section beyond the guide piece 1312.

Figure 10:
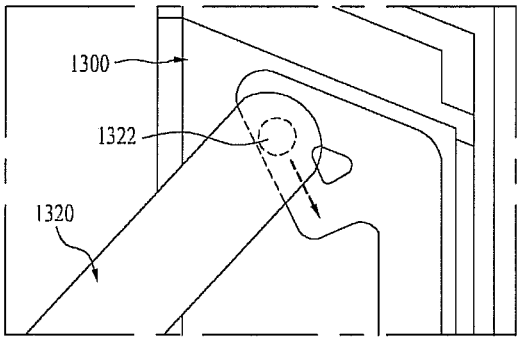
FIG. 10 is an enlarged view partially illustrating a guide part shown in FIG. 9.

FIG. 10 is an enlarged view partially illustrating a guide part shown in FIG. 9 and the guide part will be described in reference to FIG. 10.

The guide piece 1312 may have a predetermined thickness to prevent the guide projection 1322 from being directly moved to the second guide groove 1306 from the first guide groove 1302, without stopped in the first seating protrusion 1304. A portion of the first guide groove 1302 located below the guide piece 1312 may have the identical width. Because of that, the guide projection 1322 may be moved to the first seating protrusion 1304 stably.

If the guide piece 1312 is not formed in the guide groove 1301, the guide projection 1322 might be moved to the second guide groove without being seated in the first seating protrusion within the first guide groove 1302. To prevent that, the guide piece 1312 may be formed to provide a path along which the guide projection 1322 is freely moved in the first guide groove 1302.

Figure 11:
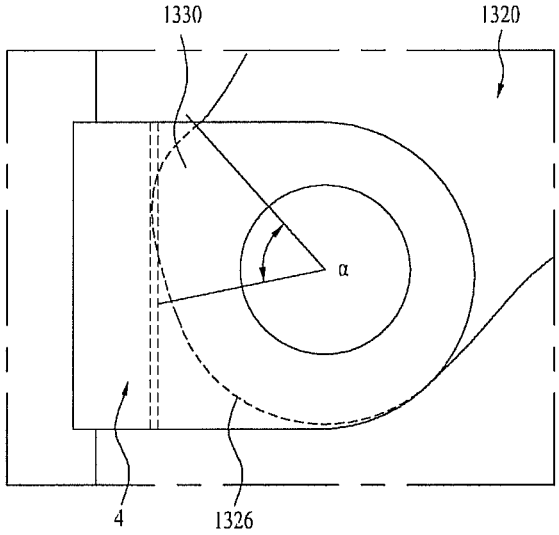
FIG. 11 is an enlarged view partially illustrating a connection part.

FIG. 11 is an enlarged view partially illustrating the connection part. As follows, the connection part will be described in reference to FIG. 11.

The connection joint 1326 that is the end of the connection part 1320 may be formed in a semicircular shape. Especially, an interference piece 1330 projected as far as a predetermined length may be provided in the connection joint 1326 at a predetermined angle ($\alpha$). The interference piece 1330 may be projected to have a larger radius than a radius of the connection joint 1326.

The connection joint 1326 may be shaft-coupled to the door 4 and the rotation of the connection joint 1326 may be limited at the angle (α) at which the projected inference piece 1330 is formed. The angle of the door 4 may be maintained temporarily because of that. The interference piece 1330 may just limit the rotation of the door 4 with a small force temporarily. If the user applies a small force to the door additionally, additional rotation may be performed and the door 4 may be out of the interference of the interference piece 1330.

In other words, if the interference piece 1330 contacts with the door 3 as the connection joint 1326 is rotating, the rotation of the door 4 may be stopped temporarily. The connection joint 1326 may be rotated at the position where the interference piece 1330 is not contact with the door 4, with no resistance.

As follows, the operation of the laundry treating apparatus according to another embodiment will be described in reference to FIGS. 4 and 9 to 11.

The guide projection 1322 may be stopped at the position of S3, in the state of the door 4 having closed the opening 37. Like the embodiment mentioned above, auxiliary securing members such as the locking projection receiving part and the locking projection may be provided in the door 4 and the cabinet 3, to secure the guide projection 1322 at the position of S3.

It is necessary for the user to rotate the door to unload or load the laundry from or into the opening 37.

In case of rotating the door 4 to open the laundry introduction opening 37, the guide projection 1322 may be moved at the position of S3 along the first guide groove 1302. At this time, the first guide groove 1302 may be divided into a portion located beyond the guide piece 1312 and a portion located below the guide piece 1312.

When the guide projection 1322 is moved along the portion of the first guide groove 1302 beyond the guide piece 1312 as shown in FIG. 11, the interference piece 1330 may interfere with the rotation of the connection joint 1326. In other words, the connection part 1320 may not be rotated and the door 4 may not be rotated such that a predetermined angle of the door 4 may be maintained. As a result, the guide projection 1322 may be moved upwardly along the portion of the first guide groove 1302 located beyond the guide piece 1312. That is, the portion of the first guide groove located beyond the guide piece 1312 may be a kind of a locking section.

The interference piece 1330 may not have a large resistance but it may provide a temporary locking force. As a result, when the door 4 is additionally rotated, the portion of the door locked by the interference piece 1330 may be released and the connection part 1330 may be rotated freely.

In the meanwhile, as passing along the portion of the first guide groove 1302 located below the guide piece 1312, the guide projection 1322 may be stopped by the first seating protrusion 1304. The door 4 may be stopped at the position (S1) where the guide projection 1322 is stopped by the first seating protrusion 1304. Because of that, the rotation of the door 4 may be stopped at the first angle.

At this time, the guide piece 1312 may be arranged to prevent the guide projection 1322 from being directly moved to the second guide groove 1306, without stopped in the first seating protrusion 1304 in the portion of the first groove 1302 located below the guide piece 1312.

Next, in case of desiring to rotate the door 4 additionally to open the opening 37 more, the user may apply a force to the door 4 and the guide projection 1322 may be moved from the first guide groove 1302 to the second guide groove 1306. The guide projection 1322 may be moved to a lower portion of the second guide groove 1306 along the entire perpendicular shape of the second guide groove 1306. The motion of the guide projection 1322 may be stopped at the moment when it is seated in the second seating protrusion 1308 formed at the end of the second guide groove 1306. At this time, the motion of the door 4 may be stopped. As a result, the rotation of the door 4 may stopped at the second angle and the secured state of the door 4 may be maintained.

In the meanwhile, the second guide groove 1306 may be gently curved for the end of the second guide groove 1306 to be extended toward the door 4 to rotate the door 4 smoothly, not perpendicularly straight. As the door 4 is rotated, the connection joint 1326 may be moved along an approximately circular locus with respect to the guide projection 1322.

When trying to move the door 4 to the third angle from the second angle, the user may grasp the end of the door 4 by his or her hand to move the end of the door 4 upwardly. The guide projection 1322 may be moved upwardly along the second guide groove 1306 and it may be moved to the third guide groove 1310 out of the second guide groove 1306.

As the guide projection 1322 is getting moved upwardly along the third guide groove 1310, the door 4 may reach the third angle at which it closes the opening 37.

Figure 12:
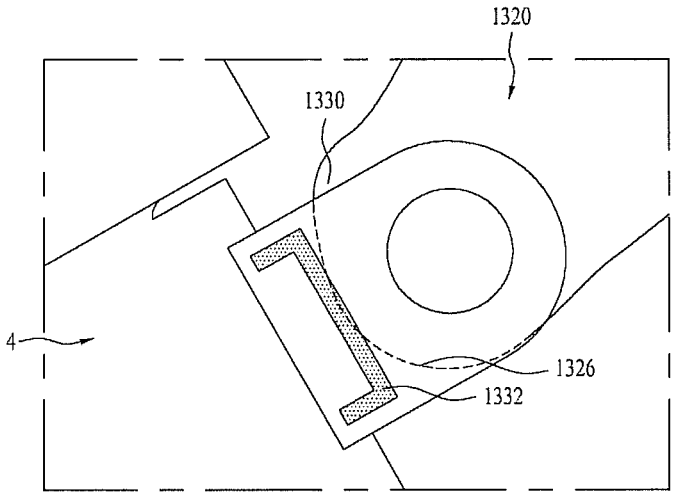
FIG. 12 is a diagram illustrating a converted example of the connection part.

FIG. 12 is a diagram illustrating a converted example of the connection part. As follows, the converted example will be described in reference to FIG. 12.

As the door is rotated multiple times, the interference piece 1330 of the connection joint 1326 might be worn out. If the projected length of the interference piece 1330 is reduced because of the wear, the interference piece 1330 cannot sufficiently limit the rotation of the connection part 1320 during the motion of the first projection 1322 within the first guide groove 1302. In this case, the guide projection 1322 cannot be moved upwardly along the upper portion of the first guide groove 1302 located beyond the guide piece 1312 and it might be moved from the first guide groove 1302 to the third guide groove 1310.

In other words, the user tries to rotate the door 4 to the first angle to stop the door 4 but the interference piece 1330 may fail to perform the proper function. Because of that, the door 4 happens to be rotated to the second angle over the first angle and the opening 37 might be opened much unnecessarily and disadvantageously.

To prevent that, an elastic support piece 1332 capable of providing an elastic supporting force may be provided at a portion where the interference is generated to the interference piece 1330 and the door 4. The elastic support piece 1332 may be a plate spring and it may prevent the abrasion of the interference piece 1330. As a result, the interference piece 1330 may perform the function within the first guide groove 1302 consistently.

Figure 13:
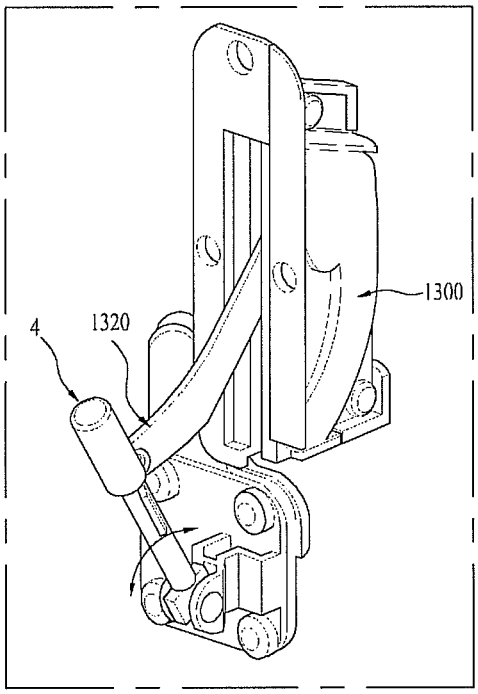
FIG. 13 is a diagram illustrating a converted example of the embodiment.
Figure 14:
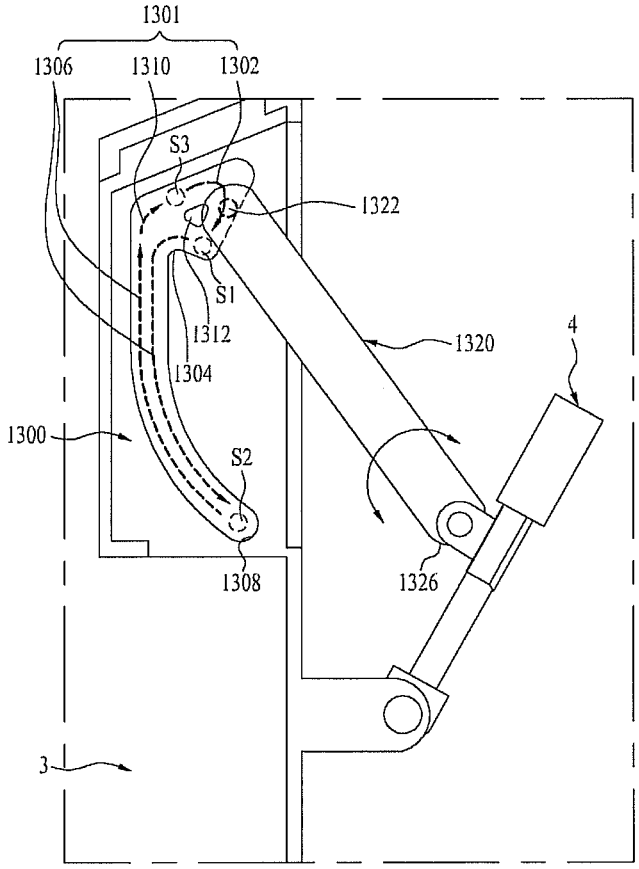
FIG. 14 is a diagram illustrating an inner surface of FIG. 13.

FIG. 13 is a diagram illustrating a converted example of the embodiment. FIG. 14 is a diagram illustrating an inner surface of FIG. 13.

Two guide projections 1322 may be symmetrically arranged in opposite sides with respect to the connection part 1320. Two guide parts 1300 may be symmetrically arranged in opposite sides with respect to the connection part 1320.

In other words, according to the example of FIG. 13, one of the two guide projections 1322 arranged with respect to the connection part 1320 may be guided along the guide groove as shown in FIG. 9 and the other one of the two guide projections 1322 with respect to the connection part 1320 may be guided along the guide groove shown in FIG. 14. In other words, an inner structure of the portion shown in FIG. 13 is shown in FIG. 9 and an inner structure of the other portion shown in FIG. 13 is shown in FIG. 14.

Each of the guide grooves 1301 may be formed in each of the guide part 1300. Each of the guide projections 1322 may be provided to be guided along each of the guide grooves 1301.

Each of the guide grooves 1301 may be formed to face another and each of the guide projections 1322 may be received in each of the guide grooves 1301 separately, to have a motion path thereof be guided.

At this time, the connection part 1320 may be inserted between two guide parts 1300, to be secured movably. The connection part 1320 may be moved together as two guide projections 1322 are moved within the guide grooves 1301, respectively and the connection part 1320 may adjust the rotational angle of the door 4.

The operation of the embodiment shown in FIGS. 9, 13 and 14 may be identical to the other embodiments described above and detailed description of the operation will be omitted accordingly. According to the embodiment in reference to FIGS. 9, 13 and 14, the motion passage of the door 4 may be limited by the two guide projections and the securing forces may be provided at positions where the door 4 is stopped. As a result, the door 4 may be moved stably and fixed by a strong securing force.

Figure 15:
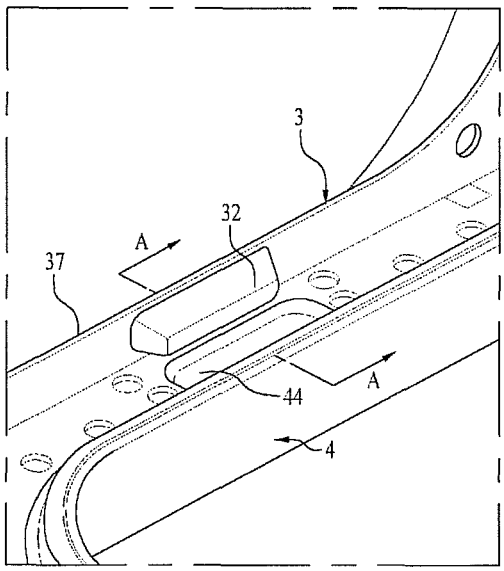
FIG. 15 is a diagram illustrating key parts of a laundry treating apparatus according to a further embodiment.
Figure 16:
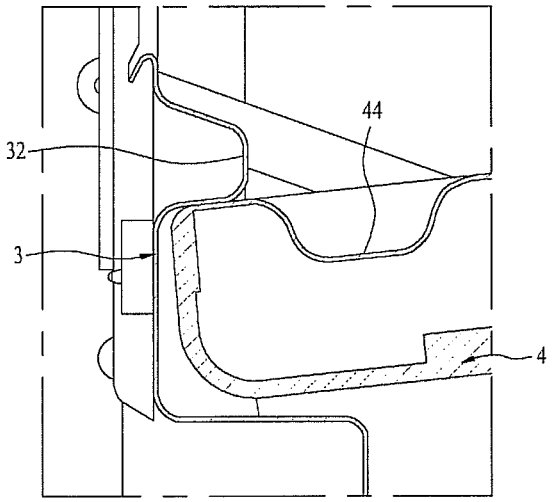
FIG. 16 is a sectional view illustrating a center region of FIG. 15.

FIG. 15 is a diagram illustrating key parts of a laundry treating apparatus according to a further embodiment. FIG. 16 is a sectional view illustrating a center region of FIG. 15. As follows, the key parts will be described in reference to FIGS. 15 and 16. In FIG. 15, hinges provided in both sides of the door are omitted and only a center portion of the door 4 is illustrated.

This embodiment represents a structure supporting the door 4 not to rotate any further additionally in a state of the door being rotated at the second angle. Like the embodiment mentioned above, the door 4 may not be rotated any further when the guide projection 1322 is seated in the second seating protrusion 1308. However, if an unexpected force such as laundry falling to the door 4 is applied to the door 4, it may be necessary to secure the door 4 more stably.

A recessed piece 44 recessed a predetermined depth may be formed at a lower portion of the door 4 and a projected piece projected a predetermined depth may be formed in a lower portion of the cabinet 3, corresponding to the recessed piece 44. At this time, the recessed piece 44 may be formed higher from the lower end of the door 4. That is, the recessed piece 44 may be formed at an upper position having a predetermined height from the lower end of the door 4 and the portion of the door down the recessed piece 44 may be more projected than the recessed piece 44 to have a normal profile of the door 4.

The projected piece 32 may be received in the recessed piece 44, in a state of the door 4 having closed the opening 37, that is, in a state of the door 4 being arranged at the third angle.

However, after the door 4 is rotated at the second angle in case of the user rotating the door 4, the lower end of the door 4 may contact with the projected piece 32 formed at the lower end of the cabinet 3.

In other words, once the door 4 rotated sufficiently is arranged at the second angle, the lower end of the cabinet 3 may contact with the lower end of the door 4 and the door 4 may not be then rotated additionally.

A single projected piece 32 may be formed at a center of the cabinet 3. Alternatively, a plurality of projected pieces 32 may be symmetrically arranged with respect to the center of the cabinet 3, to reinforce the strength for supporting the door 4.

A single recessed piece 44 may be formed at a center of the door 4. Alternatively, a plurality of recessed pieces 44 may be symmetrically arranged with respect to the center of the door 4 to reinforce the strength for supporting the cabinet 3.

Added to the embodiments mentioned above, a further embodiment may present that the door 4 is not rotated at more than the second angle.

A laundry treating apparatus 100 according to a further embodiment may include a cabinet 3 configured to define a profile thereof, having a laundry introduction opening 37, an accommodating room (R) arranged in the cabinet to treat (wash and dry) laundry (washing objects or drying objects) and a door 4 configured to open and close the laundry introduction opening 37.

In case the laundry treating apparatus 100 is structured only to dry, only a drum (not shown) rotatably provided in the cabinet 3 may be provided as the accommodating room (R).

However, in case the laundry treating apparatus 100 is structured to perform a washing function as well as the drying function, a tub (not shown) provided in the cabinet to hold wash water therein and a drum (not shown) rotatably provided in the tub may be provided as the accommodating room (R).

The door 4 may be rotated by a hinge unit 5 and 6 provided perpendicular to a bottom surface of the cabinet 3 or a hinge unit 6 and 7000 provided in parallel to the bottom surface of the cabinet 3. The door 4 may include an outer frame 43 having the hinges fixed thereto and an inner frame 41 coupled to the outer frame 43, with define a profile of the door.

The outer frame 43 may include a first handle 4311 and a second handle 4315. The first handle 4311 may be provided on an upper surface of the outer frame 43, with being bent, and the second handle 4315 may be provided each of both opposite lateral surfaces of the door.

The first handle 4311 may be used as means for rotating the door with respect to a second hinge 6 and a fourth hinge 7000, which will be described later. The second handle 4315 may be used as means for rotating the door 4 with respect to the second hinge 6 and a first hinge 5, which will be described later.

In the meanwhile, the door 4 may further include a through hole 4330 provided in a position thereof, corresponding to the laundry introduction opening 37 of the cabinet 3, and a transparent plate 4330 located in the through hole to enable the user to see the inside of the accommodating room (R).

In this case, the through hole 4330 may be include a frame through hole provided in the outer frame 43 and a cover through hole provided in the inner frame 41. The transparent plate 4340 may include a cover transparent plate provided in the cover through hole and a frame transparent plate provided in the frame through hole.

A locking unit may be further provided in the door 4 to couple the door to the cabinet 3. The locking unit may include a hook 41 provided in each of the outer frame 43 and the cabinet 3 and a hook receiving groove 43 provided in the other one to receive the hook.

Figure 18:
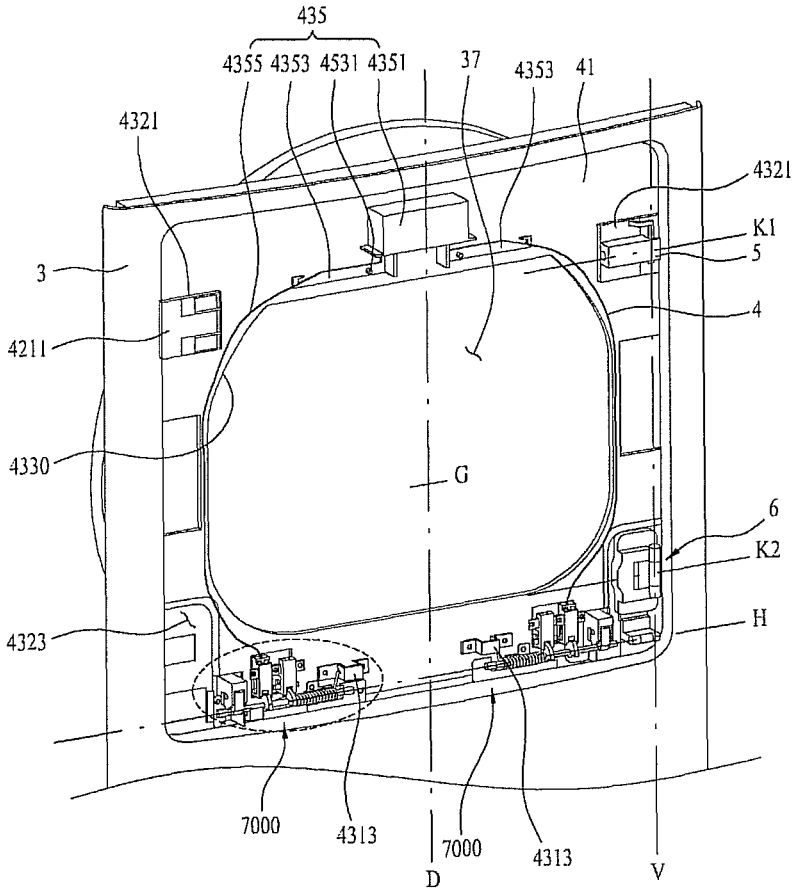
FIG. 18 is a diagram illustrating an inner structure of a door provided in the laundry treating apparatus.

Moreover, as shown in FIG. 18, the laundry treating apparatus 100 may include a first hinge 5 having a first shaft (51, see FIGS. 20 and 21) provided perpendicular to the bottom surface of the cabinet 3, a fourth hinge 7000 having a fifth shaft (7100, see FIG. 22) provided in parallel to the bottom surface of the cabinet 3 and a second hinge 6 having a third shaft (63, see FIG. 19) provided in parallel to the fifth shaft 7100 and a second shaft (631, see FIG. 19) provided in parallel to the first shaft 51.

The second hinge 6 and the fourth hinge 7000 may form a pivot (V) used for opening the door 4 at a preset angle with respect to a front surface of the cabinet 3 (opening shown in FIG. (*c*)). The second hinge 6 and the first hinge 5 may form a pivot (H) used for opening the door 4 toward a lateral surface of the cabinet 3 (opening shown in FIG. 17(*b*)).

As a result, the third shaft 63 of the second hinge 6 and the fifth shaft 7100 of the fourth hinge 7000 may be located at the same pivot (H). The second shaft 651 of the second hinge 6 and the first shaft 51 of the first hinge 5 may be located at the same pivot (V).

Also, the fourth hinge 7000 and the first hinge 5 may be detachably provided in the door 4 and the detailed structure thereof will be described as follows.

First of all, the second hinge 6 will be described in reference to FIG. 19.

The second hinge 6 may include a cabinet securing part 61 secured to the cabinet 3 and a door securing part 65 secured to the door 4.

In this case, the door securing part 65 may be rotatably provided in the cabinet securing part 61 via the third shaft 63 provided in parallel to the bottom surface of the cabinet.

In other words, the cabinet securing part 61 may include a cabinet securing plate 611 secured to the cabinet 3 and a rotating plate 613 rotatably coupled to the cabinet securing plate 611 via the third shaft 63, with the door securing part 65 coupled thereto.

The door securing part 65 may include a securing part connection plate 631 secured to the rotating plate 613, the second shaft 651 fixed to the securing part connection plate 631, in parallel to the bottom surface of the cabinet 3, and a door securing plate 633 rotatably provided in the securing part connection plate 631 by the second shaft 651, with being secured to the door 4.

Figure 19:
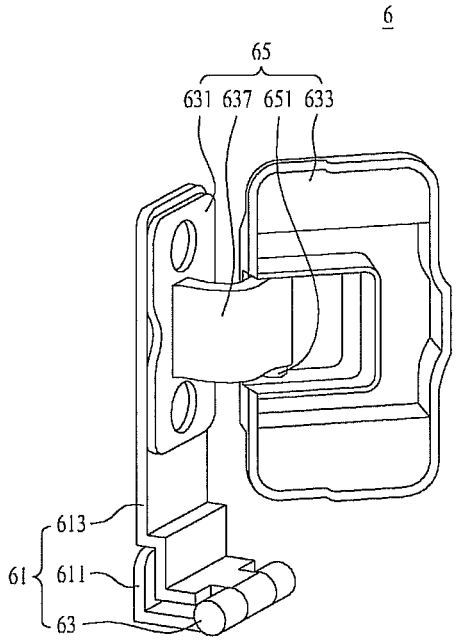
FIG. 19 is a perspective view illustrating a second hinge provided in the laundry treating apparatus.

In this case, the second shaft 651 may be fixed to the securing part connection plate 631 by a shaft fixing rib 637 and the shaft fixing rib 637 may not be bent, different from FIG. 19.

The first hinge 5 may include the first shaft (51, which is fixed to the cabinet 3 to have the same pivot as that of the fourth shaft) provided in perpendicular to the bottom surface of the cabinet 3, with passing a center of the second shaft 651, and a first shaft detaching part 53 provided in the door 4, with being detachable from the first shaft 51.

Figure 20:
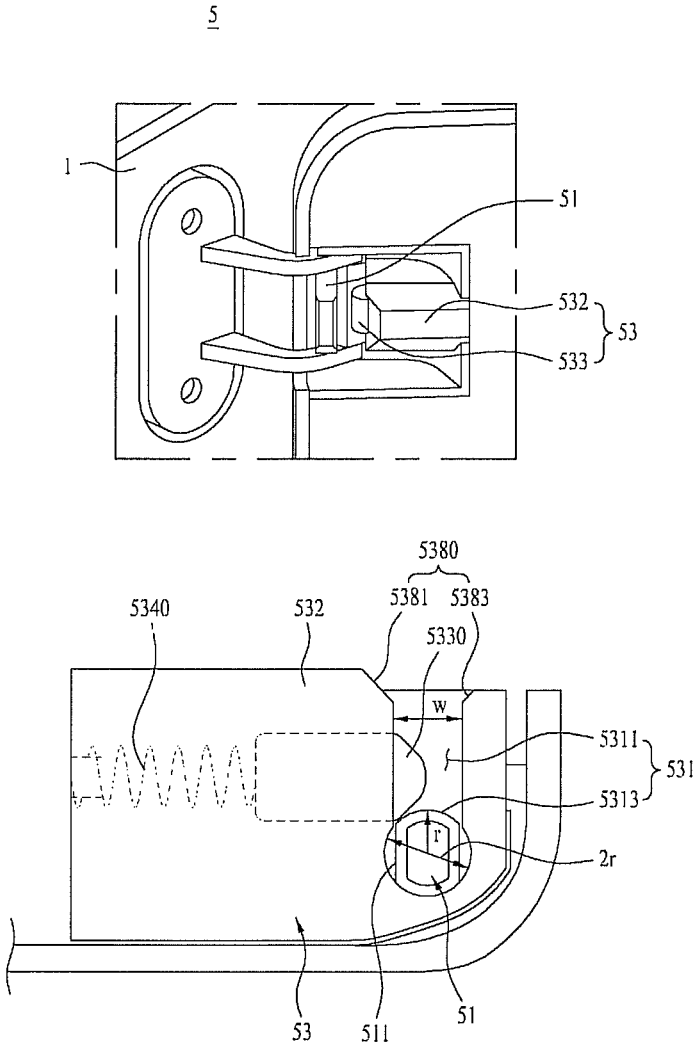
FIGS. 20 and 21 are diagrams illustrating a first hinge provided in the laundry treating apparatus.

As shown in FIG. 20, the first shaft detaching part 53 may include a housing 532 provided in the door 4, a first shaft receiving groove 531 provided in the housing 532 to receive the first shaft 51 therein, a fixing body 5330 having an end located in the housing 532 and the other end located in the first shaft receiving groove 531, and a fixing body elastically supporting part 5340 located in the housing 532 to elastically support the fixing body 5330.

The first shaft 51 may include cut-surfaces 511 provided in opposite (facing each other symmetrically) along a longitudinal direction.

In this case, the first shaft receiving rove 531 may include a cut-surface receiving groove 5311 having a corresponding width to a distance between the cut-surfaces 511 of the first shaft 51 and a circular groove 5313 having a radius that is identical to a curvature (r) of a connecting surface 513 connecting the cut-surfaces with each other.

The circular groove 5313 may be connected to the cut-surface receiving groove 5311 and a diameter of the circular groove 5313 may be longer than the distance between the cut-surfaces 511.

Thus, there may be an effect that the first shaft 51 can be connected to or detached from the first shaft detaching part 53 smoothly, when the door 4 is rotated on the third shaft 63 and the fifth shaft 7100, and that the first shaft detaching part 63 can be prevented from being separated from the first shaft 51, when the door 4 is rotated on the first shaft 51 and the second shaft 651.

In other words, when the door is not rotated on the first shaft 51 and the second shaft 651 of the second hinge, the cut-surfaces 511 of the third shaft may be kept in parallel to the cut-surface receiving groove 5311. Because of that, the first shaft detaching part 53 may be detachable from the first shaft 51, when the door 4 is rotated on the third shaft 63 of the second hinge and the fifth shaft 7100 of the fourth hinge.

However, once the door 4 starts to be rotated on the first shaft 51 and the second shaft 651 of the second hinge, the connecting surface 513 of the first shaft may contact with the circular groove 5313. The first shaft 51 may be prevented from separated from the first shaft receiving groove 531, because the diameter (2*r*) of the circular groove 5313 is larger than the width (w) of the cut-surface receiving groove 5311.

In the meanwhile, at least one inclined surface may be provided in the first shaft receiving groove 531 to guide the first shaft 51 to the cut-surface receiving groove 5311, when the first shaft detaching part 53 is coupled to the first shaft 51. FIG. 20 illustrates a first inclined surface 5381 and a second inclined surface 5383.

The fixing body 5330 may be means for supporting the shaft 51 received in the circular groove 5313 may be supported by the fixing body elastically supporting part 5340.

As a result, the fixing body 5330 may be moved to the housing 532, when the first shaft 51 is inserted in the cut-surface receiving groove 5311, and it may be exposed to the cut-surface receiving groove 5311, when the first shaft 51 is inserted in the circular groove 5313, such that the fixing body 5330 may be support the first shaft 51 to prevent the first shaft 51 from being separated from the circular groove 5313.

Figure 21:
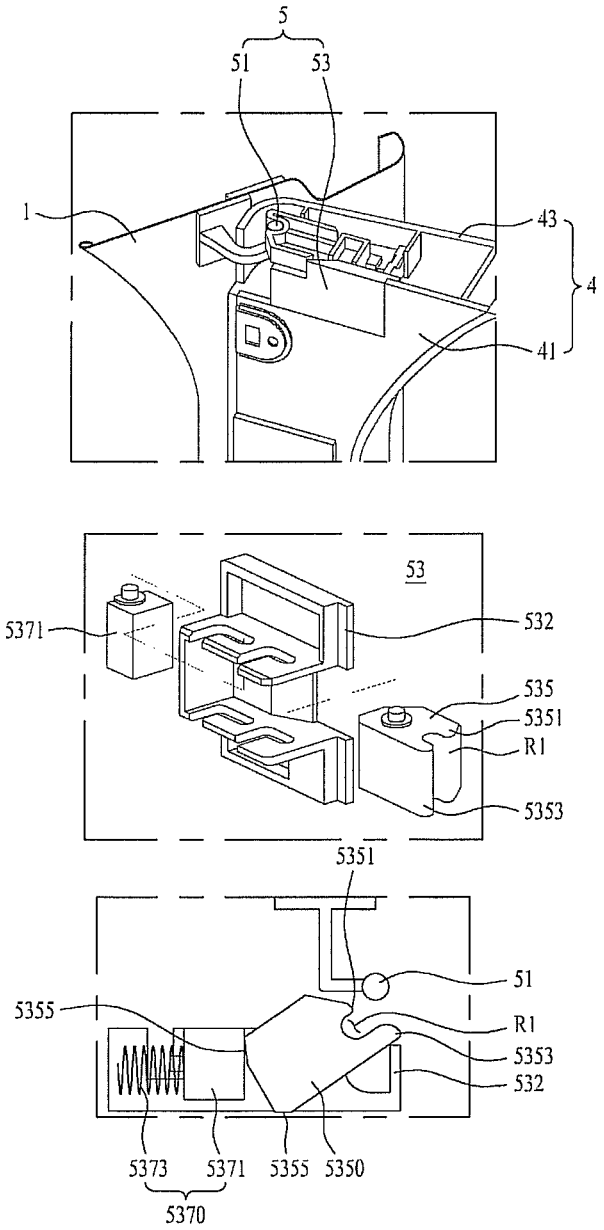

FIG. 21 illustrates another example of the first hinge 5 described above. this example of the first hinge 5 may include a first shaft 51 fixed to the cabinet 3 and a first shaft detaching part 53 provided in the door 4, being detachable from the first shaft 4.

The first shaft detaching part 53 may include a housing 532 fixed to the door 4, a first shaft receiving body 535 rotatably coupled to the housing and a receiving body elastically supporting part 537 configured to elastically support the first shaft receiving body.

The first shaft receiving body 535 may include a first shaft receiving groove (R1) to receive the first shaft 51 therein and a first shaft guider 5353 to guide the first shaft toward the first shaft receiving groove (R1), when the first shaft is coupled to the first shaft detaching part.

In the meanwhile, the first shaft receiving groove (R1) may be formed by a projection 5351 and the first shaft guider 5353, as shown in FIG. 21. In this case, the length of the first shaft guider 5353 may be larger than the length of the projection 5351.

The receiving body elastically supporting part 537 may include a piston 5371 provided in the housing 532, in contact with the first shaft receiving body 535, and a spring 5373 configured to elastically support the piston 5371.

In this case, at least one body inclined surface 5355 may be provided in the first shaft receiving body 535 to contact the piston 5371 and the housing 532, in case of rotating. Because of the body inclined surface, there may be an effect of controlling a rotational angle of the first shaft receiving body 535 when the first shaft 51 is coupled to or separated from the first shaft detaching part 53.

Also, the body inclined surface 5355 may generate a sound when contacting with the piston 5371 or the piston 5371 in the rotation of the first shaft receiving body 535, such that the user may be effectively informed of the completion of coupling or detaching between the first shaft 51 and the first shaft detaching part 53.

In the meanwhile, the laundry treating apparatus 100 may have a structure in that the second hinge 6 and the first hinge 5 may be selectively coupled to a right or left side of the door, to enable the user to change a rotational direction of the door 4 conveniently.

As shown in FIG. 18, the inner frame 41 provided in the door 4 may include two first securing parts 4321 provided at symmetrical positions with respect to a straight line (D) passing the center (G) of the door 4, respectively, to secure the first shaft detaching part 53 thereto, and two second securing parts 4323 provided at other symmetrical positions with respect to the straight line (d) passing the center (G) of the door, respectively, to secure the door securing part 65 of the second hinge 6 thereto. The cabinet 3 may include two first shaft securing parts (317, see FIG. 17(*b*)) provided at corresponding positions to the first securing parts 4321, respectively, to secure the first shaft 51 of the first hinge 5 secured thereto, and two securing plate fastening parts (319, see FIG. 17(*b*)) provided at corresponding positions to the second securing parts (4323, see FIG. 18) to fasten the cabinet securing plate 611 of the second hinge 6 thereto.

In this case, the first detaching part 53 of the first shaft 51 may be in parallel to the first shaft 61 of the first hinge, in symmetry with respect to a straight line (K1) passing a center of the first shaft 51. Also, the securing part connection plate 631, the second shaft 651 and the door securing plate 633 may be in parallel to the third shaft 63, in symmetry with respect to a straight line (k2) passing through a center of the second shaft 651.

As a result, in case the user is right-handed, the second hinge 6 and the first hinge 5 may be located on the right side of the cabinet (as shown in FIG. 18). In case the user is left-handed, the second hinge 6 and the first hinge 5 may be located on the left side of the cabinet 3.

Figure 17:
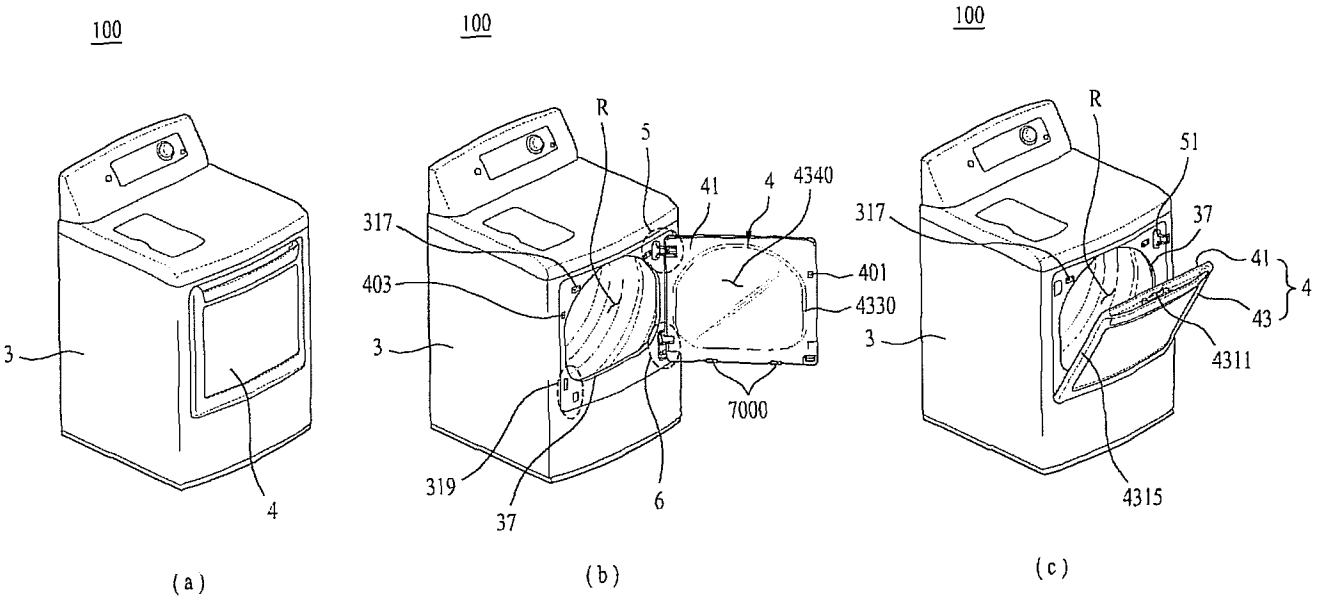
FIG. 17 is a perspective view illustrating the laundry treating apparatus according to the further embodiment.

When the second hinge 6 and the first hinge 5 are located on the left side of the cabinet 3 as shown in FIG. 18, the first hinge 5 may be rotated to change the first shaft 51 of FIG. 20 up and down and it may be secured to the first shaft securing part (317, see FIG. 17(*b*)) located on the left side of the cabinet 3. Here, the first shaft detaching part 53 of FIG. 20 may be rotated to changed up and down and it may be secured to the first securing part 4321 located on the left side of the inner frame 41.

In the meanwhile, a securing cover (4211, see FIG. 18) may be further provided in the inner frame 41 to prevent exposure of the other one of the first securing parts 4321 without the first hinge 5 secured thereto.

As follows, the fourth hinge 7000 provided in the laundry treating apparatus 100 will be described in reference to FIG. 22.

The fourth hinge 7000 may be used as means for rotating the door 4 on the pivot (H) located in parallel to the bottom surface of the cabinet 3, together with the second hinge 6.

For that, the fourth hinge 7000 may be provided in the outer frame 43 of the door. The fourth hinge 7000 may include the fifth shaft 7100 having the same pivot as the pivot of the third shaft 63 provided in the second hinge 6 and the cabinet detaching part configured to detachably couple the fifth shaft 7100 to the cabinet 3.

Figure 22:
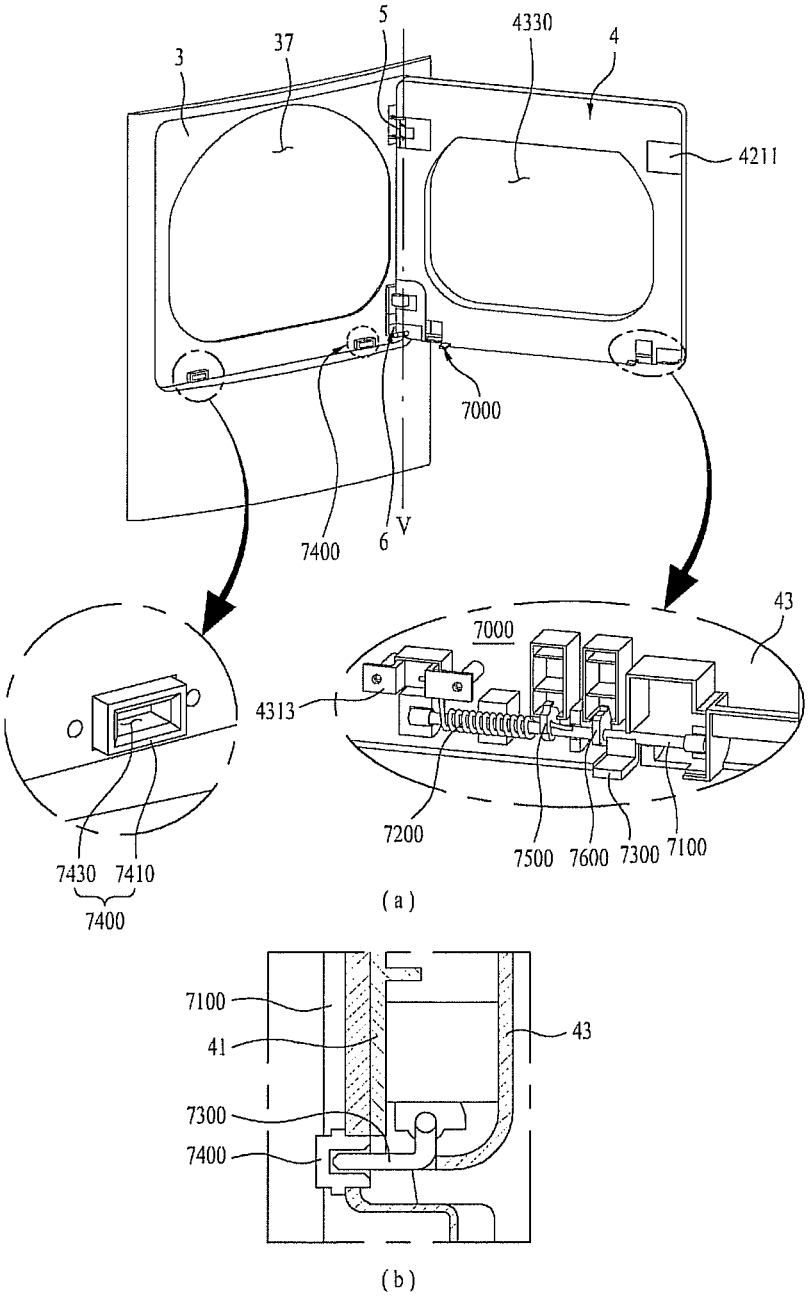
FIGS. 22 to 26 are diagrams illustrating a fourth hinge provided in the laundry treating apparatus.

At least one fourth hinge 7000 may be provided in the door 4 and FIG. 22 illustrates two fourth hinges 7000 are provided.

In the meanwhile, the cabinet detaching part may include a connecting shaft 7300 provided in the fifth shaft 7100 and a shaft receiving part 7400 provided in the cabinet 3 to receive the connecting shaft 7300.

The connecting shaft 7300 may be projected from an outer circumferential surface of the fifth shaft 7100 toward the cabinet 3, to be exposed outside the cover via the inner frame 41 of the door 4.

The shaft receiving part 7400 may include a receiving body 7410 fixed to the cabinet 3 and a receiving groove 7430 provided in the receiving body 7410 to receive the connecting shaft 7300 therein.

As a result, when the door 4 opens the opening 37 after rotated on the pivot (V) passing the center of the second shaft 651 and the first shaft 51, the fifth shaft 7100 may be detached from the cabinet 3. However, when the door 4 closes the opening 37 after rotated on the pivot (V), the connecting shaft 7300 may be inserted in the receiving groove 7430 to be secured to the cabinet 3.

Once the fifth shaft 7100 is secured by the connecting shaft 7300 and the shaft receiving part 7400, the door 4 may be rotated on the pivot (H, see FIG. 18) passing the center of the third shaft 63 of the first hinge and the center of the fifth shaft 7100 of the second hinge, to open the opening 37.

This is because the first shaft 51 of the third hinge can be detached from the first shaft detaching part 53.

In the meanwhile, the fourth hinge 7000 may further include a door elastically supporting part configured to control the rotational speed of the door 4 when the door 4 is rotated to open the opening 37 and to reduce the force for rotating the door 4 when the door closes the opening 37.

The door elastically supporting part may be varied only if it can realize the function mentioned above and FIG. 22 illustrates a torsion spring 7200 as the door elastically supporting part.

When the torsion spring 7200 is provided as the door elastically supporting part, the torsion spring 7200 may be provided in the door 4 and an end of the torsion spring 7200 may be fixed to the fifth shaft 7100 and the other end thereof may be fixed to the door 4.

For that, a spring holder 4313 fixed to the outer frame 43 may be further provided in the door 4.

Moreover, the fourth hinge 7000 may further include an angle adjusting part configured to adjust the rotational angle of the door 4 when the door 4 is rotated on the third shaft 63 of the first hinge and the fifth shaft 7100 of the second hinge (rotated on the pivot (H)).

The angle adjusting part may include at least one of first and second angle adjusting parts 7500 and 7600. As follows will be described a case in that both of the first and second angle adjusting parts 7500 and 7600 are provided.

Figure 23:
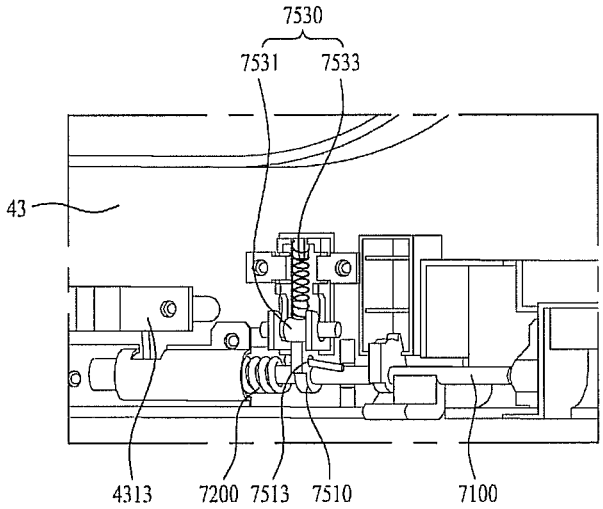

As shown in FIG. 23, the first angle adjusting part 7500 may include a first adjusting plate 7510 fixed to the fifth shaft 7100 and a first detaching part 7530 provided in the door to be coupled to the first adjusting plate 7510 to secure the position of the door 4.

The first adjusting plate 7510 may have a fastening part fastened to the first detaching part 7530 and the fastening part may be configured of a plurality of recesses concavely recessed from an outer circumferential surface of the first adjusting plate 7510 or a plurality of projections projected from the outer circumferential surface of the first adjusting plate 7510.

If the fastening part is the plurality of the recesses, the first detaching part 7530 may be formed to be inserted in one of the recesses. If the fastening part is the plurality of the projections, the first detaching part 7530 may be formed to receive one of the projections.

If the case of providing the plurality of the recesses as the fastening part is adapted, the fastening part may include a first groove 7511 and a second recess 7512 curvedly recessed from the outer circumferential surface of the first adjusting plate 7510.

In this case, the second recess 7512 may be spaced apart a predetermined angle from the first recess 7511. FIG. 23 illustrates the angle between the first recess 7511 and the second recess 7512 is 30 degrees.

In the meanwhile, the first detaching part 7530 may include a first body 7531 in contact with the outer circumferential surface of the first adjusting plate 7510 and a first body elastically supporting part 7533 having an end fixed to the door 4 and the other end fixed to the first body 7531 to elastically support the first body.

The first body elastically supporting part 7533 may enable the first body 7531 to maintain contact with the surface of the first adjusting plate 7510, even when the first body 7531 is moved together with the door during the rotation of the door 4.

In case of the door 4 closing the opening 37 (see FIG. 17(*a*)), the first body 7531 may be received in the first recess 7511. Unless an external force is applied to the door 4 via the first handle (311, see FIG. 17), the first body 7531 may prevent the door 4 from being rotated on the third shaft 63 of the second hinge and the fifth shaft 7100 of the fourth hinge (See FIG. 24(*a*)).

Figure 24:
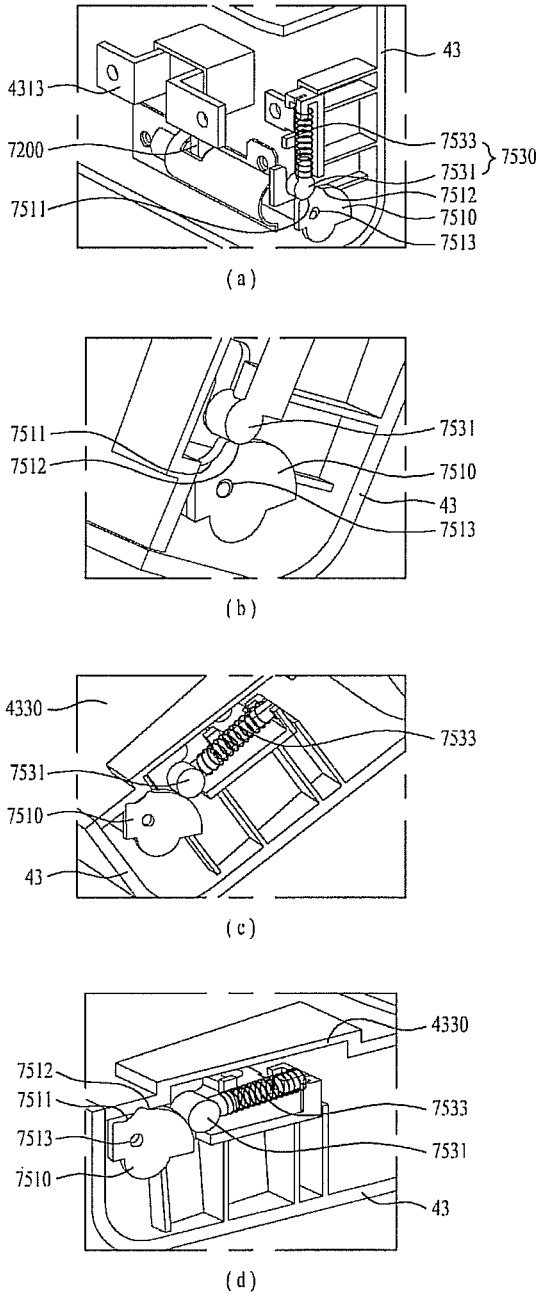

Also, even when the door 4 opens the opening 37 by the external force applied thereto via the first handle 4311, the first body 7531 may be inserted in the second recess 7512 and the door 4 may then maintain the state of being rotated on the fifth shaft 7100 of the fourth hinge (the first shaft of the first hinge and the second shaft of the second hinge) at 30 degrees (see FIG. 24(*b*)).

As a result, the opening angle of the door 4 may adjusted by the first angle adjusting part 7500.

Moreover, the torsion spring 7200 provided in the fourth hinge 7000 may provide an elastic force capable of locating the first body 7531 within an angle range of more than 30 degrees to 90 degrees or less from the first recess 7511, when the door 4 is rotated on the fifth shaft 7100 of the fourth hinge.

This is to realize the effect of securing the door 4 being rotated 30 to 90 degrees with respect to the fifth shaft of the fourth hinge (See FIG. 24(*c*)).

In the meanwhile, the end of the torsion spring 7200 may be fixed to the spring holder 4313 and the other end thereof may be insertedly fixed to the spring fixing hole 7513 provided in the first adjusting plate 7510.

As a result, the door 4 provided in the laundry treating apparatus 100 may be open to 30 degrees with respect to the fifth shaft 7100 (this is enabled by the first angle adjusting part), to more than 30 degrees to less than 90 degrees (for example, 60 degrees and this is enabled by the torsion spring) or to 90 degrees.

When the laundry placed on the door 4 opened 30 degrees or 60 degrees with respect to the fifth shaft 7100, the laundry can be loaded into the accommodating room (R) naturally and the user may not bend his or her waist to load the laundry.

Also, when the door 4 is open at 90 degrees with respect to the fifth shaft 7100, the door 4 may be used as a shelf and the user may place the laundry unloaded from the accommodating room (R) temporarily (see FIG. 24(*d*)).

In the meanwhile, when the door 4 is utilized as a shelf (when the door 4 is rotated 90 degrees with respect to the fifth shaft 7100), an external force generated by the weight of the laundry will be concentrated on the fourth hinge 7000 and the second hinge 6.

As a result, to prevent breakage of the second hinge 6 and the fourth hinge 7000, a door supporting part 313 projected toward the door 4 may be further provided in the cabinet 3. A supporting part receiving recess 4325 may be further provided in the door 4 to receive the door supporting part 313 (see FIG. 18).

In this case, the door supporting part 313 may be provided at a predetermined position to support the inner frame 41 of the door 4, when the door 4 is rotated 90 degrees on the fifth shaft 7100 (see FIG. 18(*b*)).

The second angle adjusting part 7600 may be further provided in the fourth hinge 7000 and it may be means for fixing the position of the door 4 rotated a predetermined angle on the fifth shaft 7100.

In other words, the laundry treating apparatus 100 mentioned above may secure the position of the door 4 by using the first adjusting plate 7510 and the first detaching part 7530 provided in the first angle adjusting part 7500 of the fourth hinge 7000. However, when an external force (for example, the weight of the laundry and the like) is applied to the door 4, there might be danger of failing to maintain the position of the door 4.

Figure 25:
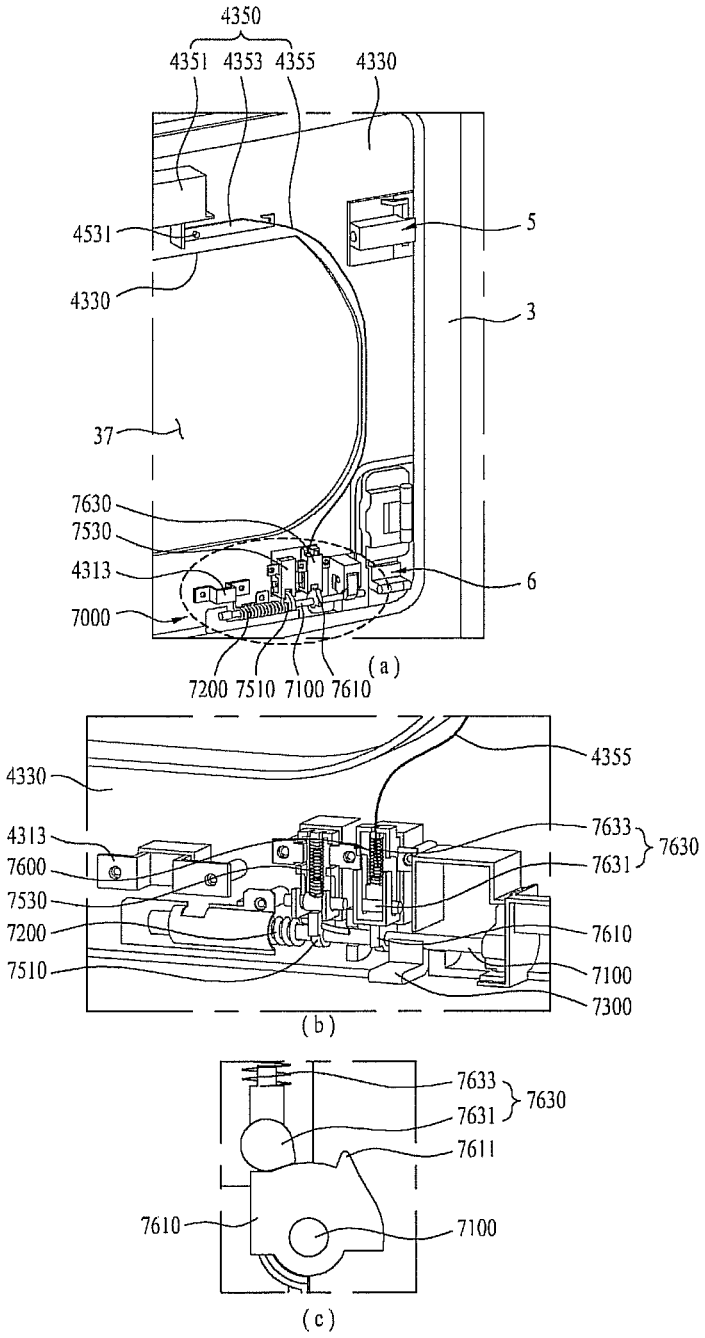

The second angle adjusting part 7600 may be means for prevent the danger mentioned above. As shown in FIG. 25, the second angle adjusting part 7600 may include a second adjusting plate 7610 provided in the fifth shaft 7100 and a second detaching part 7630 provided in the door 4, in contact with the second adjusting plate 7610.

The second detaching part 7630 may include a second body 7631 provided in the door, in contact with an outer circumferential surface of the second adjusting plate 7610, a second body elastically supporting part 7633 having an end fixed to the door 4 and the other end thereof fixed to the second body 7631.

In this case, a stopper 7611 may be provided in the outer circumferential surface of the second adjusting plate 7610 to be coupled to the second body 7631, when the first body 7531 of the first detaching part 7531 is coupled to the second recess 7512 of the first angle adjusting part 7500.

Figure 26:
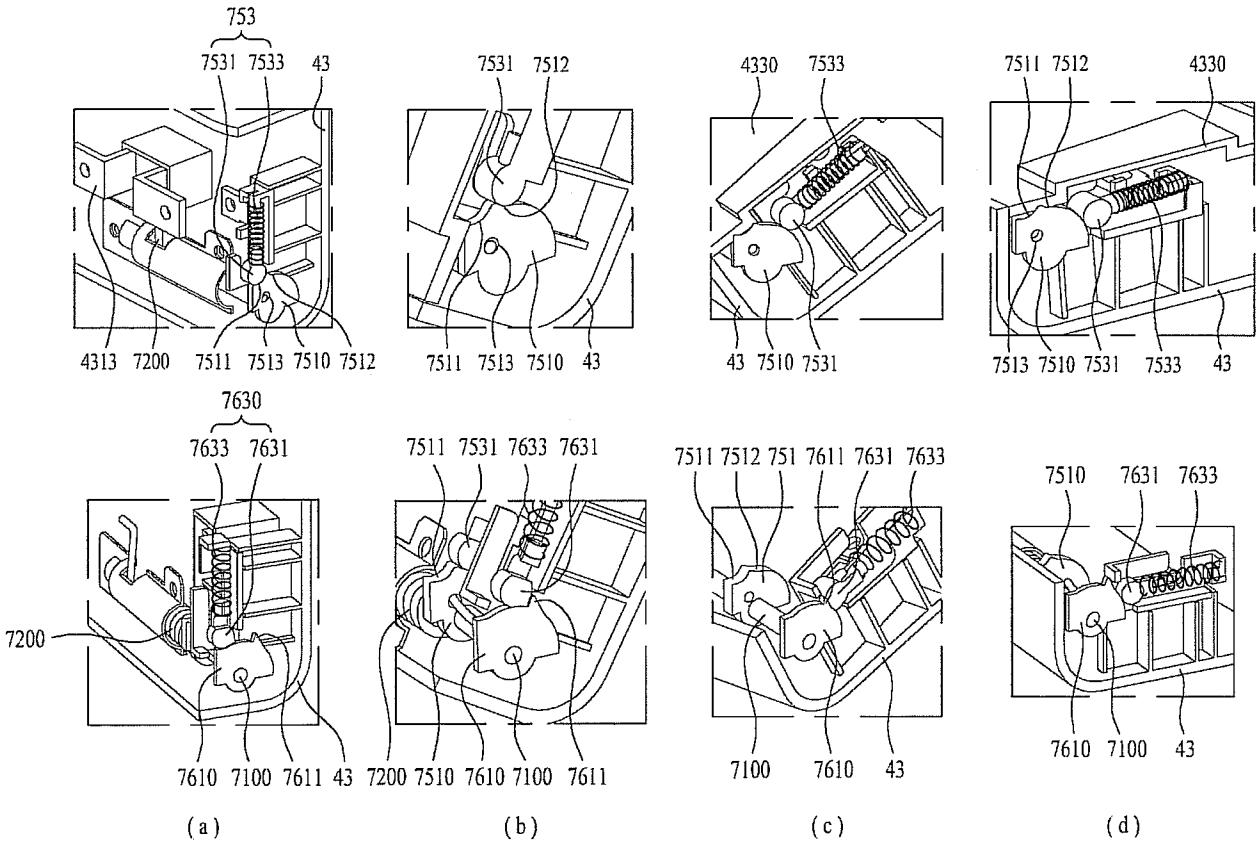

As a result, when the door 4 is rotated 30 degrees on the fifth shaft 7100, the first body 7531 may be inserted in the second recess 7511 as shown in FIG. 26(*b*) and the second body 7631 may contact with the stopper 7611, such that the open angle of approximately 90 degrees may be maintained even if the external force is applied to the door 4.

Also, the door 4 may maintain a state of being open 60 degrees on the fifth shaft 7100 by the elastic force of the torsion spring 7200. When the weight of the door 4 is larger than the elastic force of the torsion spring 7200 (when the door is rotated 60 degrees or more on the second shaft), the door may maintain a state of being open 90 degrees or more on the fifth shaft 7100.

Here, a lifter 4350 may be further provided in the door 4 to release the coupling between the second body 7631 and the stopper 7611 to open the door 60 degrees (a representative value of the door rotation angles in the range of more than 30 degrees to less than 90 degrees) or 90 degrees.

The lifter 4350 may have a structure shown in FIG. 25.

In other words, the lifter 4350 may include a pressing part 4351 provided in the door 4, a lever 4353 rotatably provided in the inner frame 41 of the door 4 via a lever rotation shaft 4351, with an end in contact with the pressing part 4351, and a wire 4355 having an end fixed to the lever 4353 and the other end fixed to the second body 7631 of the second detaching part 7630.

In this case, the pressing part 4351 may be located in the first handle (4311, see FIG. 17(*c*)) provided in the door 4.

As a result, when trying to rotate the door 4, that is open 3 degrees on the fifth shaft 7100, 60 degrees or 90 degrees, the user may release the coupling between the second body 7631 and the stopper 7611 by using the pressing part 4351 and the wire 4355 located in the first handle 4311.

In other words, when the pressing part 4351 is pressed by the user, the lever may be rotated on the lever rotation shaft 4531 and the wire fixed to the end of the lever 4353 may detach the second body 7631 of the second detaching part 7630 from the stopper 7611.

Figure 27:
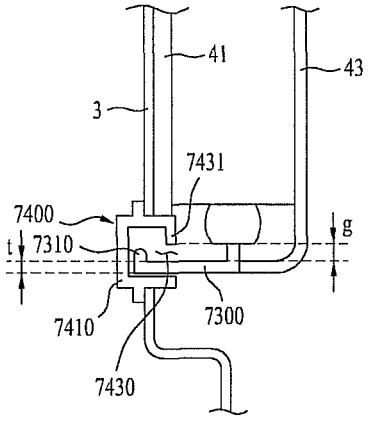
FIG. 27 is a diagram illustrating a structure of a cabinet detaching part provided in the fourth hinge.
Figure 27:
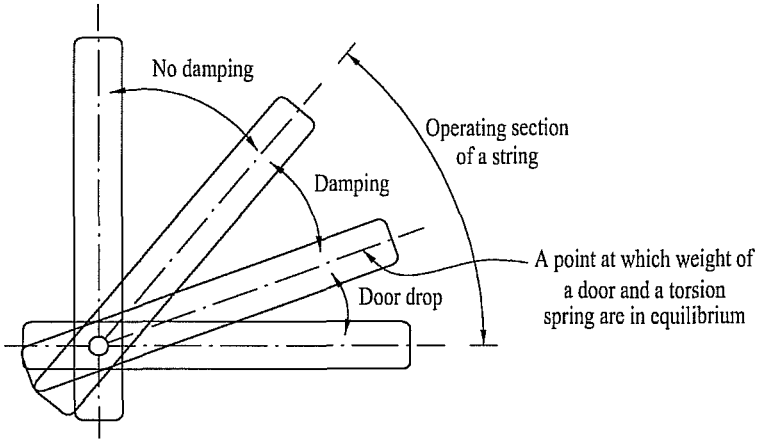
Figure 28:
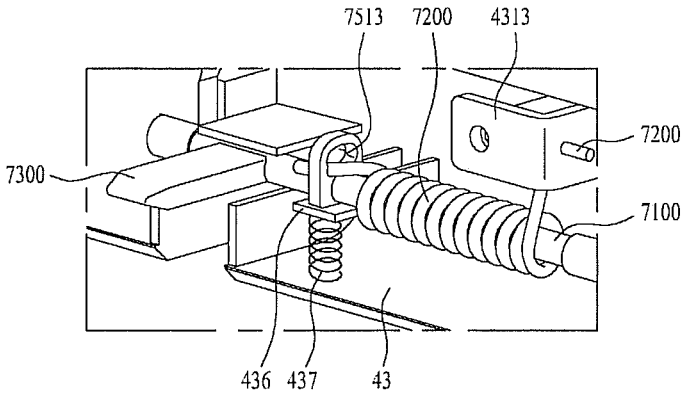
FIG. 28 is a diagram illustrating a fixing structure of a twisted spring provided in a door.
Figure 28:
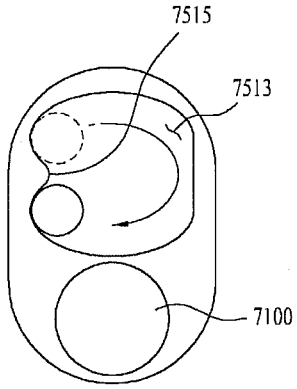

In the meanwhile, the cabinet detaching part provided in the fourth hinge 7000 may have a structure shown in FIGS. 27 and 28.

The cabinet detaching part shown in FIGS. 27 and 27 may have a characteristic of having no resistance transmitted from the torsion spring 7200 while the door 4 is rotated a predetermined angle on the third shaft 63 of the second hinge and the fifth shaft 7100 of the fourth hinge.

This characteristic is configured to improve user convenience and it may enable the door 4 to be rotated 30 degrees on the fifth shaft 7100 of the fourth hinge, which is very efficient in loading the laundry into the accommodating room (R).

The cabinet detaching part shown in FIG. 27(*a*) has a characteristic of a gap (g) formed between the receiving groove 7430 provided in the shaft receiving part 7400 and the connecting shaft 7300.

In other words, the thickness (t) of the connecting shaft 7300 may be smaller than the height (h) of the receiving groove 7430. In this case, the thickness (t) of the connecting shaft 7300 and the height (h) of the receiving groove may be set to enable the connecting shaft 7300 to contact with the receiving groove 7430 when the door rotated 30 to 40 degrees on the fifth shaft 7100.

Moreover, a receiving groove projection 7431 may be provided in the receiving groove 7430 to secure the coupling between the connecting shaft 7300 and the receiving groove 7430. A connecting shaft projection 7310 may be provided in the connecting shaft 7300 to be coupled to the receiving groove projection 7431.

As a result, the door 4 may be rotated on the fifth shaft 7100 in the angle range of 30 to 40 degrees, with no interference of the torsion spring 7200, and it may be slowly getting open in an angle range of more than 40 degrees, with the interference of the torsion spring 7200.

The reason why the door 4 is getting open with the interference of the torsion spring 7200 in the angle range of more than 40 degrees is that breakage of the second hinge 6 and the fourth hinge 7000 generated by the weight of the door has to be prevented when the door 4 is rotated rapidly.

FIG. 28 illustrates an embodiment that realizes the effects mentioned above with the fixing structure of the torsion spring 7200.

In other words, the spring fixing hole 7513 may be provided in the fifth shaft 7100 to insertedly fix the end of the torsion spring 7200 therein. A hole projection 7513 may be provided in an inner circumferential surface of the spring fixing hole 7513 to secure the position of the torsion spring 7200.

In this case, a diameter of the spring fixing hole 7513 may be larger than a diameter of the torsion spring 7200.

As a result, when the door 4 is rotated on the fifth shaft 7100, the end of the torsion spring 7200 is fixed to the spring holder 4313 fixed to the door and the torsion spring 7200 may be rotated together with the door 4 accordingly.

In the meanwhile, the other end of the torsion spring 7200 inserted in the spring fixing hole 7513 may be rotated along the inner circumferential surface of the spring fixing hole 7513 until it contacts with the hole projection 7515.

As a result, if the position of the hole projection 7515 is provided to support the torsion spring 7200 when the door 4 is rotated 30 to 40 degrees on the fifth shaft 7100, the same effect may be expected as the effect of the embodiment shown in FIG. 27.

FIG. 28 illustrates a case in that an auxiliary spring fixing hole 7513 is provided in the second shaft 72. If the spring fixing hole 7513 of FIG. 28 is applied to the embodiment shown in FIG. 23 or FIG. 25, the spring fixing hole 7513 of FIG. 28 may be provided in each of the first and second adjusting plates 7510 and 7610 or either of them.

In the above structure of providing the restitution force to the door 4 by using the torsion spring 7200, there might be danger of the fifth shaft 7100 getting out of its original position when the door 4 is rotated.

In other words, the end of the torsion spring 7200 may be fixed to the door by the spring holder 4313 and the other end of the torsion spring may be fixed to the fifth shaft 7100. Because of that, when the door 4 is rotated on the fifth shaft 7100, an external force generated by the torsion spring 7200 might be applied to the fifth shaft 7100 and the fifth shaft 7100 might fail to maintain an original position.

To prevent the danger mentioned above, the door 4 may further include a fifth shaft supporting rib 436 provided therein to support the fifth shaft 7100 and a rib elastically supporting part 437 having an end fixed to the door 4 and the other end fixed to the fifth shaft supporting rib 436.

Figure 29:
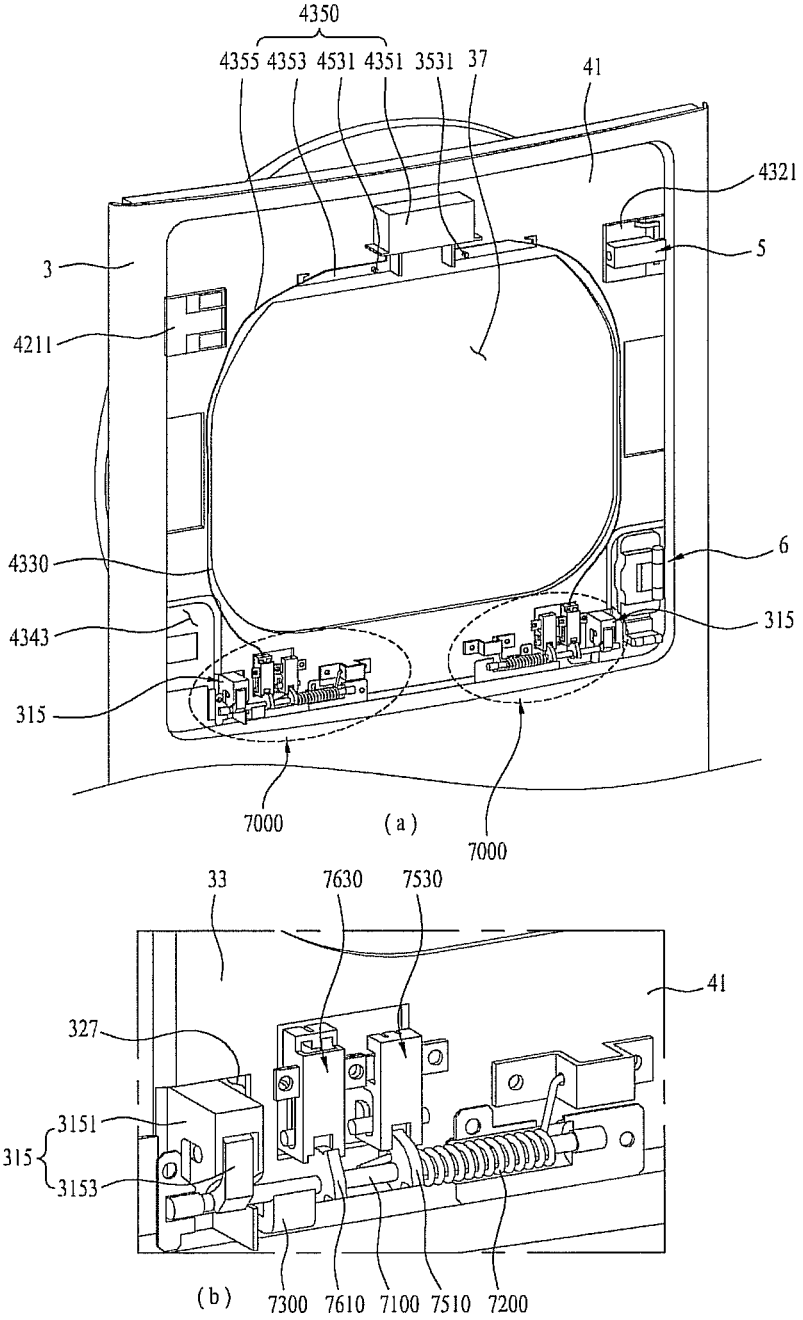
Figure 30:
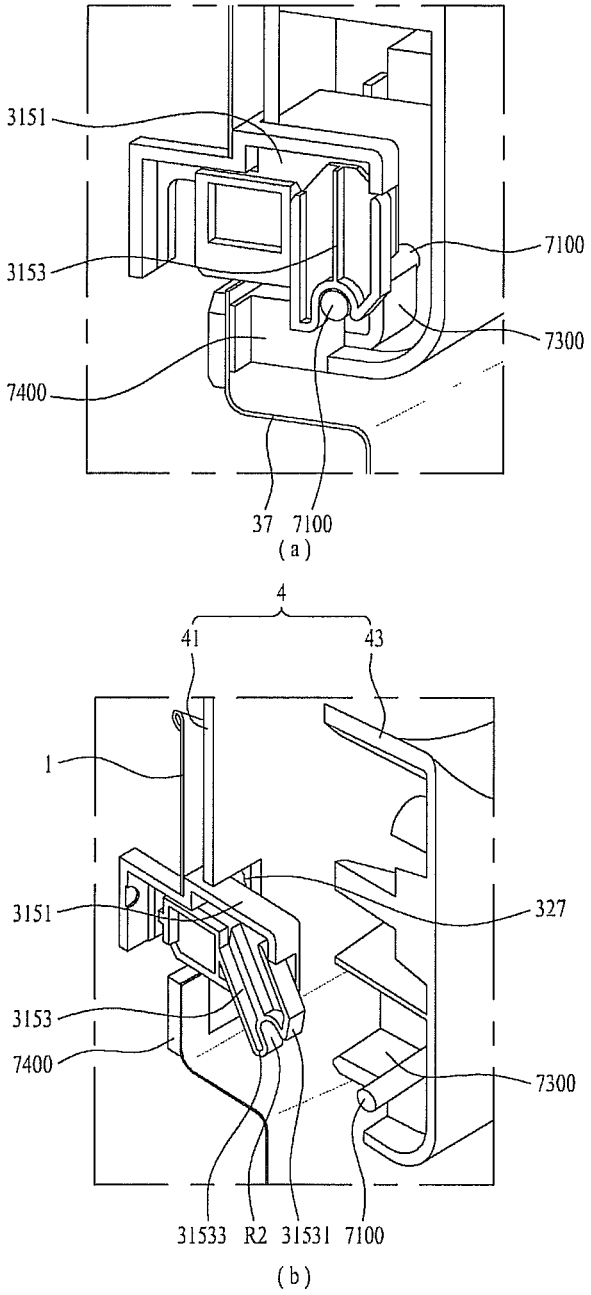

FIGS. 29 and 30 illustrate that the fifth shaft detaching part 315 detachably secures the fifth shaft 7100 of the fourth hinge to the cabinet 3, when the door 4 is rotated on the first shaft 51 and the second shaft 651.

The fifth shaft detaching part 315 may include a case 3151 fixed to the cabinet 3 and a fifth shaft receiving body 3153 rotatably provided in the case 3151 to detach the fifth shaft 7100 there from.

In this case, a receiving body through hole 327 may be further provided in the inner frame 41 of the door 4, to enable the fifth shaft receiving body 3153 to be inserted in the door.

In the meanwhile, the fifth shaft receiving body 3153 may include a fifth shaft receiving groove (R2) configured to receive the fifth shaft 7100 and a fifth shaft guider 31533 configured to guide the fifth shaft 7100 toward the second shaft receiving groove (R2).

In other words, the fifth shaft receiving groove (R2) may be formed by projections 31531 provided in both opposite ends of the fifth shaft receiving body 3153 and the fifth shaft guider 31533. Here, the length of the fifth shaft guider 31533 may be larger than the length of the projection 31531.

As a result, the laundry treating apparatus 100 including the fifth shaft detaching part 315 may realize an effect of coupling the fifth shaft 7100 to the cabinet 3 more stably by the cabinet detaching part of the second hinge.

As follows, a structure of a dryer according to a further embodiment will be described.

Figure 31:
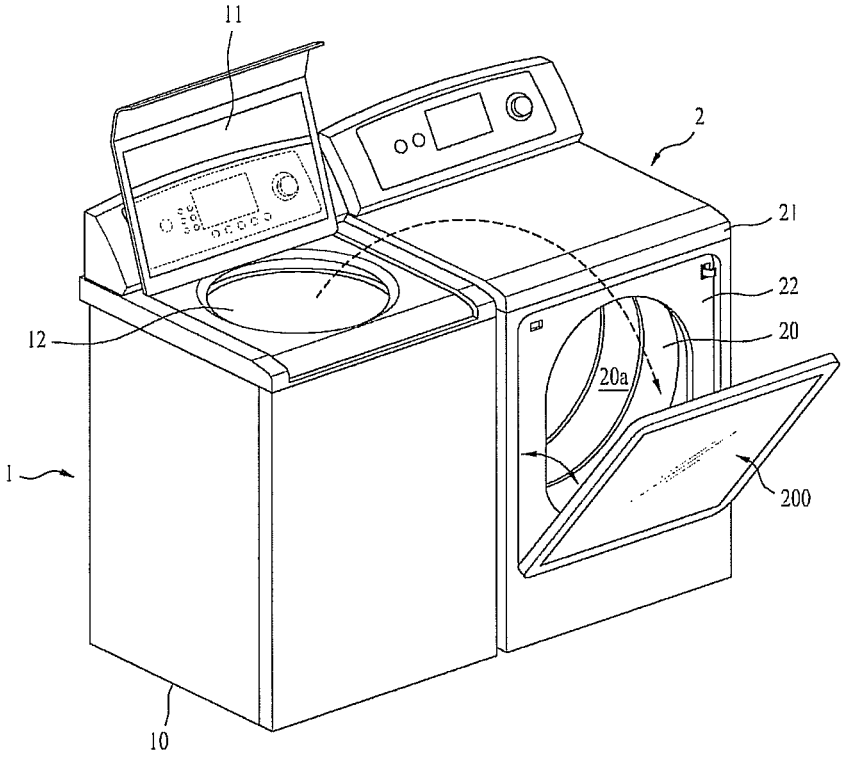
FIG. 31 is a perspective view illustrating a dryer according to a still further embodiment and a washing machine having the dryer.
Figure 32:
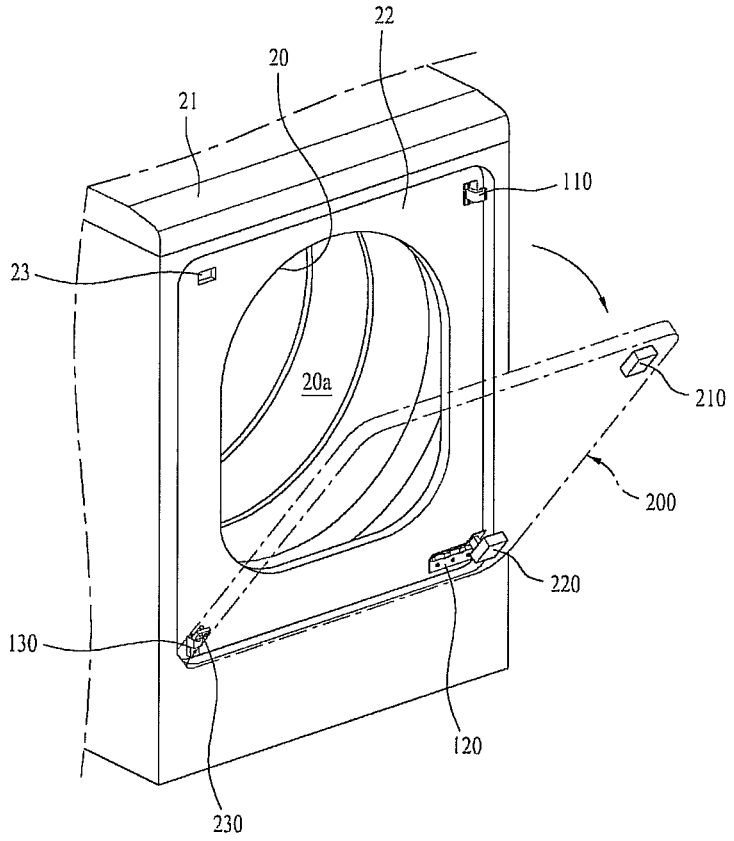
FIG. 32 is a perspective view partially illustrating a door provided in the dryer shown in FIG. 31, which is open and closed along a vertical direction.
Figure 33:
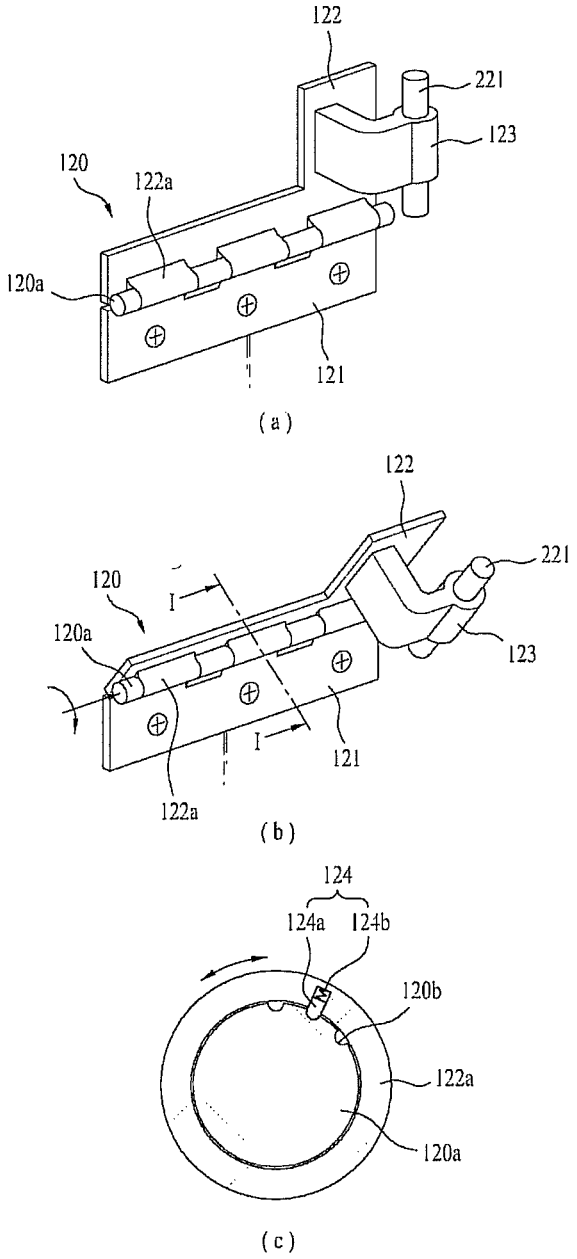
FIG. 33*a* is a perspective view illustrating a coupling relation between a second hooking member and a second shaft of a second hinge located in the door and FIG. 33*b* is a perspective view illustrating a vertical rotation state of the second hooking member shown in FIG. 32
FIG. 33*c* is a sectional view illustrating a fixing projection member elastically inserted in and separated from a fixing hole.
Figure 34:
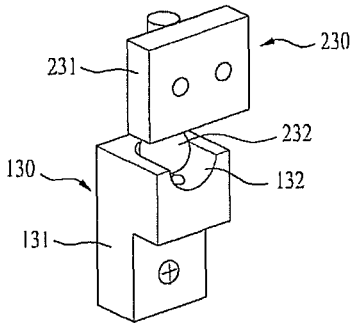
FIG. 34*a* is a perspective view illustrating a hingedly connecting relation between a rotation member shown in FIG. 32 and a rotation member in the door and FIG. 34*b* is a perspective view illustrating a vertical rotation state of the rotation member shown in FIG. 34*a;*
Figure 34:
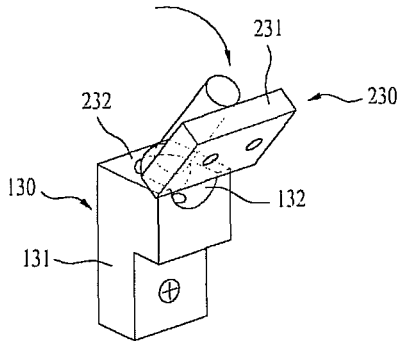

In reference to FIGS. 31 and 32, a dryer 2 according to this embodiment may include a dryer cabinet 21 having a drying room (20*a*) formed therein to dry drying objects (not shown) therein. Here, the drying room 20*a* may be a predetermined space where a drum rotated at a rotation speed set in a preset drying condition is arranged and an opening of the drying room may be exposed to outside by a drying object introduction opening 20 formed in a lateral surface of the cabinet 21.

The drying object introduction opening 20 may be opened and closed by a door 200 formed in a rectangular plate shape. A window may be installed in a center portion of the door 200 to enable the drying room 20*a* to be visible outside.

The door 200 may be multi-hingedly coupled to the cabinet 210 by a hinge unit and it may be selectively rotated to be open and closed along different directions.

Figure 36:
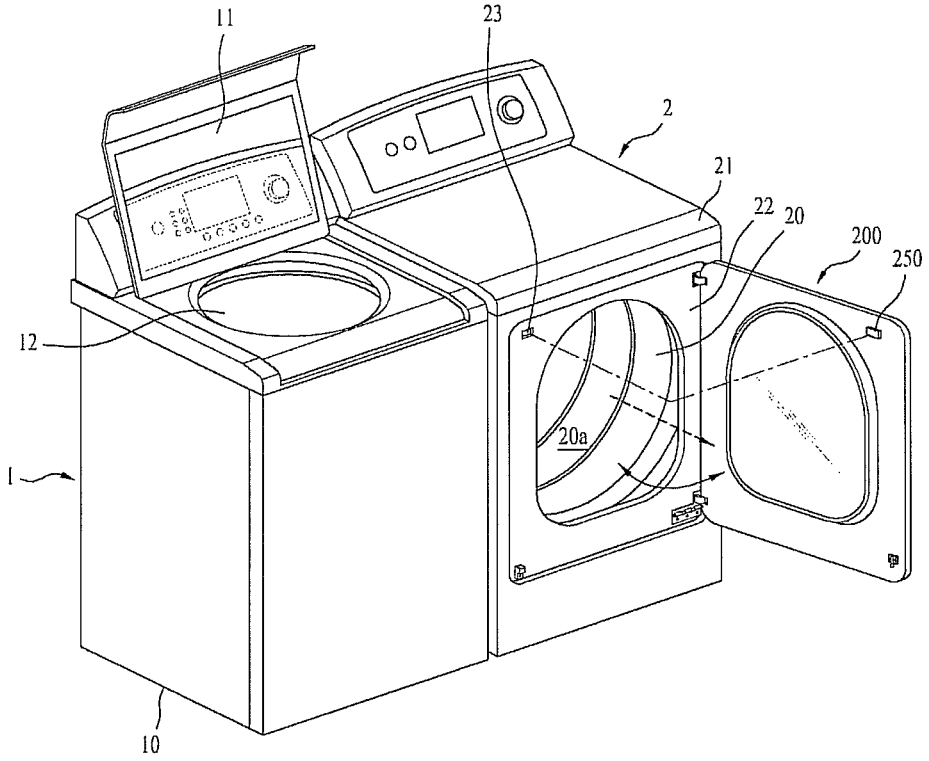
FIG. 36 is a perspective view illustrating a dryer having a door which is open along a horizontal direction as shown in FIG. 32 and a washing machine having the door.

As shown in FIGS. 31 and 36, the door 200 may be selectively open and closed along a vertical (an up and down direction) or horizontal direction (a right and left direction).

Here, the hinge unit configured to rotatably open and close the door 200 along the vertical or horizontal direction will be described.

The hinge unit may include a horizontal hinge part configured to open and close the door horizontally and a vertical hinge part configured to vertically open and close the door 200. In the meanwhile, an area adjacent to the drying object introduction opening 20 formed in the cabinet 21 may be stepped from an outer circumferential surface of the cabinet 210 and a guide plate 22 may be formed in the stepped portion to be in close contact with an inner surface of an outside of the door 200.

In reference to FIGS. 32 to 35, the vertical hinge part may include a second hooking member 120 installed in a predetermined portion of a lower end adjacent to the drying object introduction opening 20, with being vertically rotatable and hinge-connected and with a second hook 122 formed therein to insert and detach a second shaft 221 of the second hinge 220 installed in a lower end of the door, which will be described later, therein and there from, a rotation hole member 130 installed in the other lower end adjacent to the drying object introduction opening 20, with a rotation hole member body 131 to form a rotation hole 132 therein, and rotation member 230 installed in the other lower end of the door 200, with a spherical-shaped rotation ball 230 formed therein to be inserted in the rotation hole 132 to freely rotate and with a rotation member body 231 fixed to a lower end of the door.

As shown in FIGS. 32 and 36, a single hooking projection or a plurality of hooking projections 250 may be formed in the door 200. A single hooking groove or a plurality of hooking grooves 23 may be formed in the guide plate 22 consisting of the cabinet 21 near the drying object introduction opening 20 to insertedly hook the single one or the plurality of the hooking projections 250 thereto.

In the meanwhile, a vertical opening/closing angle of the door 200 may form a perpendicular angle or less.

A horizontal opening/closing angle of the door 200 may be a preset single value or a plurality of values selectively.

In this case, in reference to FIGS. 33*a* to 33*c*, the second hooking member 120 may include a rotation shaft 120*a* having fixing holes 120*b* formed in an outer circumferential surface thereof, spaced apart a predetermined distance from each other, a supporting body 121 hingedly connected to the rotation shaft 120*a*, with a surface fixed to the guide plate 22, and a rotation body 120 hingedly connected to the rotation shaft 120*a*, with a fixing projection member 124 formed an end thereof to elastically inserted and detached in and from the fixing hole 120*b* and with the second hook 123 projected outwardly there from.

Here, in reference to FIGS. 33*b* and 33*c*, the fixing projection member 124 may include a fixing holes 120*b* spaced apart a predetermined distance from each other along a circumferential direction of the rotation shaft 120*a*, a hole 124*c* formed in an inner circumferential surface of an inserting body 122*a* formed in the rotation body 120 to insert the rotation shaft 120*a* therein, a spring 124*b* installed in the hole 124*c*, and a fixing ball 124*a* connected to the spring 124*b* to be inserted in one of the fixing holes 120*b*.

As a result, when the rotation body 122 is rotated, the fixing ball 124*a* may be inserted in one of the fixing holes 2120*b* and an opening/closing angle of the door with respect to the guide plate 22 may be maintained.

Figure 37:
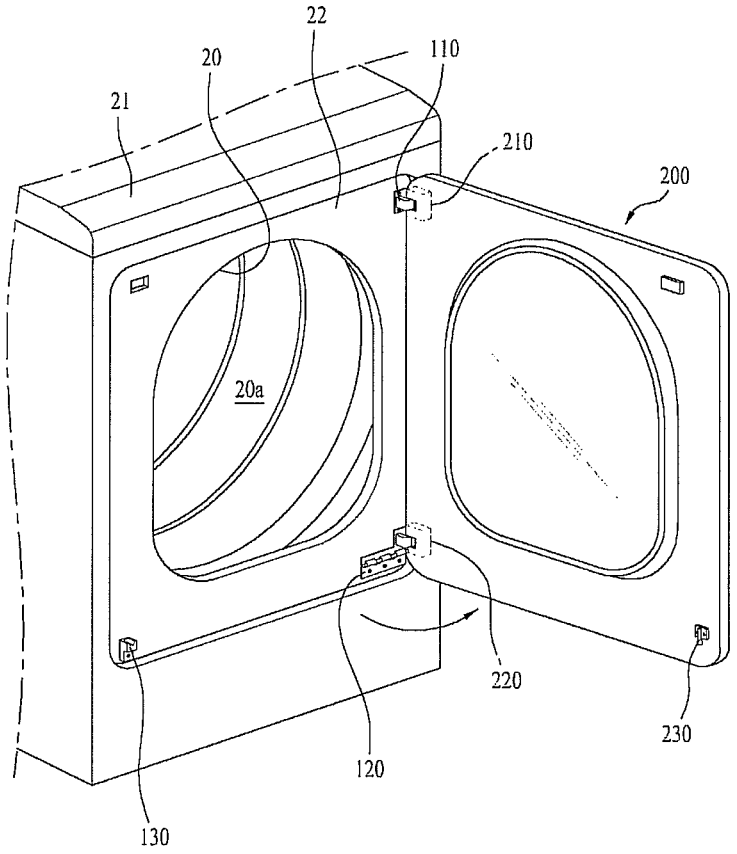
FIG. 37 is a perspective view illustrating the door of the dryer shown in FIG. 36, which is open and closed along the horizontal direction.
Figure 38:
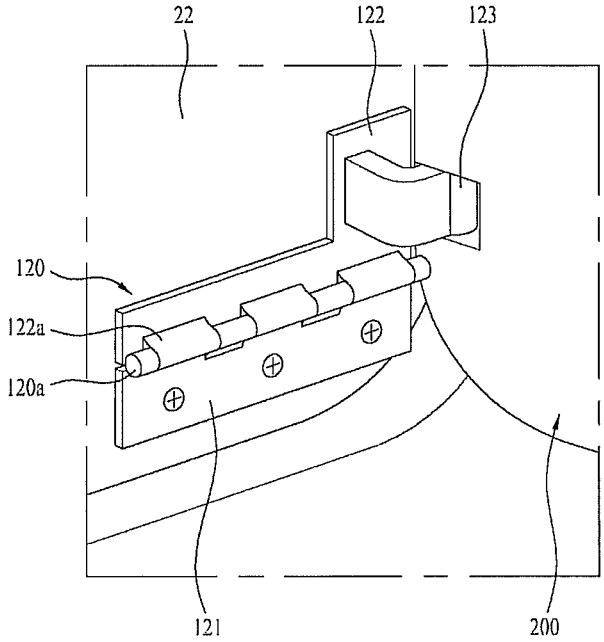
FIG. 38 is a perspective view illustrating a rotation state of a second hooking member and a second hinge member, when the door shown in FIG. 37 is open along the horizontal direction.
Figure 39:
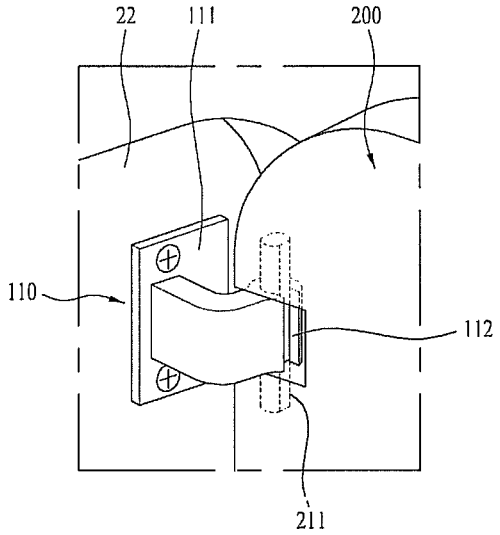
FIG. 39 is a perspective view illustrating a rotation state of a first hooking member and a first hinge member, when the door shown in FIG. 37 is open along the horizontal direction.
Figure 40:
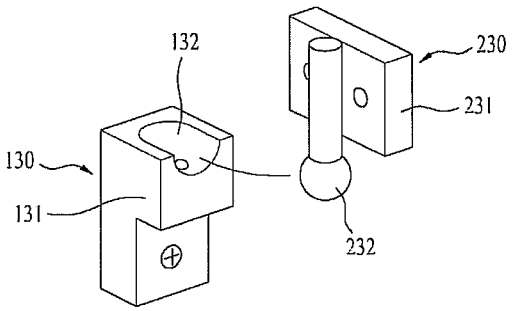
FIG. 40 is a perspective view illustrating a hingedly connecting relation between the rotation member shown in FIG. 37 and a rotation member of the door.

In reference to FIGS. 37 to 39, the horizontal hinge part may include a first hook body 111 installed in an upper end portion of the guide plate 22 adjacent to the drying object introduction opening 20, with a first hook body 111 having a first hook 112 formed therein, a first hinge member 210 installed in an upper end portion of the door 200, with a first rotation shaft 211 inserted in and detached from the first hook 112, and a second hinge member 220 installed in a lower end portion of the door 200, with a second rotation shaft 221. Here, the second rotation shaft 221 may be rotated, with being hooked to the second hook 123 of the second hooking member 120 mentioned above.

Next, the rotational opening/closing operation of the door along a vertical or horizontal direction will be described in reference to the configuration described above.

[Vertical Opening/Closing of Door]

In reference to FIGS. 31 to 35, when the door is vertically opened and closed, the door 200 may be rotated to be open and closed on a lower end thereof as a pivot. In other words, both lower ends of the door may be rotated.

In detail, in reference to FIGS. 32, 34*a* and 34*b*, the rotation ball 232 of the rotation member 230 provided in the other end of the door 200 inserted in the rotation hole 132 provided in the other end of the guide plate 22 may perform free rotation. In reference to FIGS. 33*a* and 33*b*, the second rotation shaft 221 of the second hinge member 220 provided in the end of the door 200 may be insertedly hooked to the second hook 123 of the second hooking member 120 hingedly provided in the end of the guide plate 22 and it may perform vertical rotation.

The door 200 may be rotated on the pivot passing the lower end of the door to be opened and closed vertically.

When the door 200 which can be vertically opened and closed closes the drying object introduction opening 20 airtight, the door 200 may maintain the airtight state (the closed state).

Figure 35:
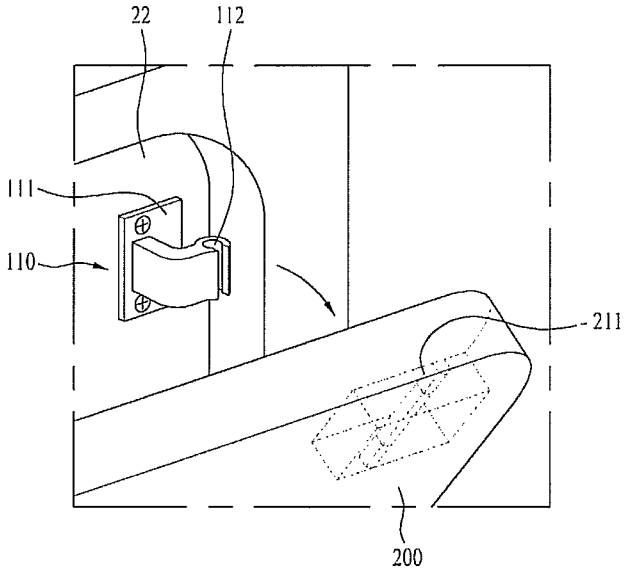
FIG. 35 is a perspective view illustrating a coupling relation between a first hooking member located in a dryer cabinet shown in FIG. 32 and a first hinge member located in a door.

In other words, as shown in FIG. 35, the first rotation shaft 211 of the first hinge member 210 provided in the upper end of the door 200 may be insertedly hooked to the first hook 112 of the first hooking member 110 formed in the end of the guide plate 22. In reference to FIG. 36, the plurality of the hooking projections 250 provided inner surface of the door 200 may be hooked to the plurality of the hooking grooves 23 formed in the guide plate 22 and the door 200 may maintain the closed state.

[Horizontal Opening/Closing Operation of Door]

In reference to FIGS. 36 to 40, when the door 200 is horizontally opened and closed, a lateral side of the door may be a pivot of the door rotation to open and close the door horizontally.

more specifically, the first rotation shaft 211 of the first hinge member 210 provided in the upper end of the door 200 may be rotated in a state of being insertedly hooked to the first hook 112 of the first hooking member 110 provided in the upper end of the guide plate 22. Also, as shown in FIGS. 33*a* and 38, the second rotation shaft 221 of the second hinge member 220 provided in the lower end of the door 200 may be rotated in a state of being insertedly hooked to the second hook 123 of the second hooking member 120 provided in the lower end of the guide plate. As a result, the first and second rotation shafts 211 and 221 may form the same pivot.

As a result, the door 200 may be rotated on the pivot passing the lateral side of the door 200 to be horizontally opened and closed.

When the horizontally openable and closable door 200 closes the drying object introduction opening 20 airtight, the door 200 may maintain the airtight state (the closed state).

In other words, as mentioned above, the first rotation shaft 211 of the first hinge member 210 provided in the upper end of the door 200 may be insertedly hooked to the first hook 112 of the first hooking member 110 formed in the upper end of the guide plate 22. Also, as shown in FIG. 36, the plurality of the hooking projections 250 provided in the inner lateral surface of the door 200 may be hooked to the plurality of the hooking grooves 23 formed in the guide plate 22, such that the door 200 may maintain the closed state.

As follows, a laundry treating apparatus configured of the dryer 2 having the configuration mentioned above and the washer 1 connected with each other will be described.

In reference to FIG. 31, a conventional washer 1 may include a washer cabinet 10 having a washing room formed therein. A washing object introduction opening 12 may be formed in an upper portion of the cabinet 10, to expose the washing room outside upwardly and a cover 11 may be coupled to the washing object introduction opening 12 to open and close the opening 12.

The dryer 2 according to the embodiment mentioned above may be installed next to the washer cabinet 10. Here, the washer cabinet 10 and the dryer cabinet 21 may be integrally formed with each other or they may be connected with each other by auxiliary connection means (not shown).

In reference to the configuration described above, washing objects may be loaded into the washing room via the washing object introduction opening 12. In other words, the washing objects may be loaded along a vertical (up and down) path.

The washing objects may be unloaded via the washing object introduction opening 12 along the vertical path, after a washing process including a washing cycle and a spinning cycle.

Hence, the washed washing objects may be loaded into the dryer 2 as the drying objects to have the drying process.

At this time, the drying objects may be loaded into the drying room via the drying object introduction opening 20 exposed outside by the opening of the door 200 coupled to the lateral surface of the dryer cabinet 21 according to the embodiment.

At this time, the door 200 may be rotated to be open and closed on the lower end thereof as the pivot. When the drying objects are loaded into the drying room 20*a*, the door may be opened in state of being tilted downwardly. Here, the vertical opening/closing structure and method of the door 200 is described above and the description thereof will be omitted accordingly.

When the door 200 is rotated in a state of forming a preset opening/closing angle downwardly, the inner surface of the door 200 may form a tilted slope.

As a result, the drying objected washed in the washer 1 may fall from the upper portion of the tiltedly open door 200 and the falling drying objects may be introduced into the drying room 20*a* via the drying object introduction opening 20 along the inner surface of the door 200 tilted toward the drying object introduction opening 20 smoothly.

In other words, the reason why the door 200 opened and closed vertically is rotated downwardly to form the tilted angle is to guide the drying objects toward the drying object introduction opening 20 along the inner surface of the tilted door 200 smoothly.

Although not shown in the drawings, a guide partition wall may be further formed in each side portion of the inner surface of the door 200 to guide the drying objects sliding toward the drying object introduction opening 20, without falling outside. When the door 200 is closed, an inserting hole may be formed in the guide plate 22 to insert therein the guide partition wall projected from each side portion of the inner surface of the door 200.

After the drying objects are loaded into the drying room 20*a* according to the sliding method along the downward direction, the door 200 may be closed to close the drying object introduction opening 20 airtight.

The dryer 2 may perform drying for the drying objects loaded in the drying room 20*a* according to set drying conditions.

After the drying, the drying objects may be unloaded outside via the drying object introduction opening 20.

At this time, in reference to FIG. 36, the door 200 according to the embodiment may be rotated to be open and closed along the horizontal direction. Because of that, the door may be opened along the horizontal direction in case of unloading the drying objects.

As a result, in case of unloading the drying objects, the user may unload the drying objects located in the drying room 20*a* via the drying object introduction opening 20 smoothly.

As follows, a laundry treating apparatus according to a still further embodiment will be described in reference to the accompanying drawings.

Although embodiments have been described with reference to a number of illustrative embodiments thereof, it should be understood that numerous other modifications and embodiments can be devised by those skilled in the art that will fall within the spirit and scope of the principles of this disclosure.

Reference may now be made in detail to specific embodiments, examples of which may be illustrated in the accompanying drawings. Wherever possible, same reference numbers may be used throughout the drawings to refer to the same or like parts.

Figure 41:
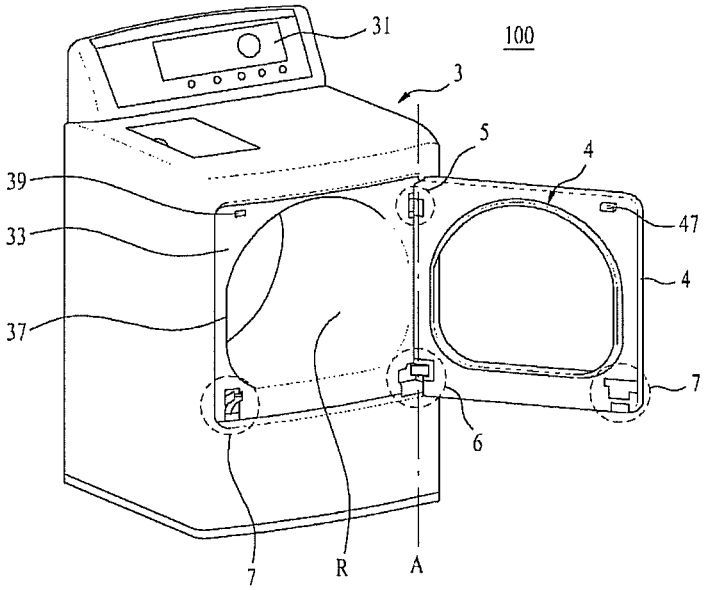
FIG. 41 is a perspective view illustrating a laundry treating apparatus according to a still further embodiment.
Figure 41:
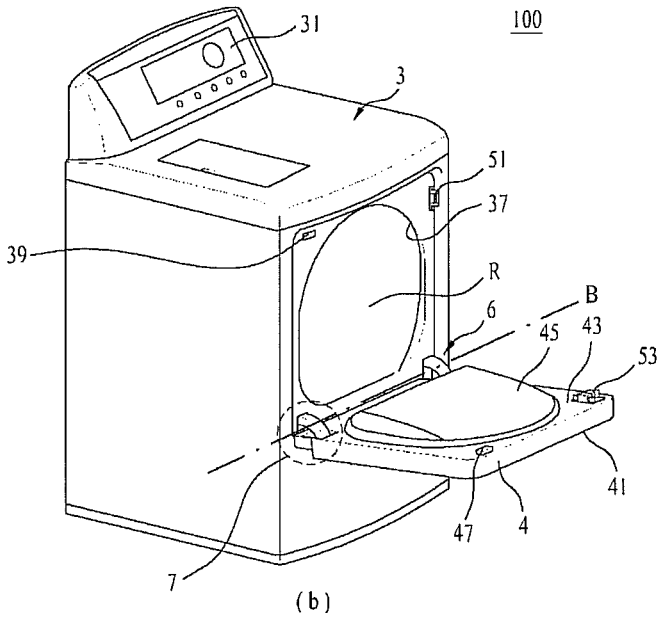

FIG. 41 is a perspective view illustrating a laundry treating apparatus according to a still further embodiment. The laundry treating apparatus 100 according to the embodiment may include a cabinet 3 having a laundry accommodating room (R) and a laundry introduction opening 37 configured to introduce the laundry into the laundry accommodating room, a door 4 configured to open and close the opening 37 and a hinge unit 5, 6 and 7 configured to enable the door to rotate the opening along different directions.

The cabinet 3 may define a profile of the laundry treating apparatus and the laundry introduction opening 37 may be provided through an outer panel 33 provided in a side of the cabinet to communicate with the laundry accommodating room (R).

A locking projection receiving part 39 may be provided in the outer panel 33 to receive a locking projection 47 provided in the door 4. The locking projection 47 of the door 4 may be received in the locking projection receiving part 39 provided in the cabinet, such that the door 4 may open and close the laundry introduction opening.

In the meanwhile, a control panel 31 may be provided on the cabinet 3 to enable a user to input a control command to the laundry treating apparatus.

The hinge unit 5, 6 and 7 may form a first pivot (A) to rotate the door to open and close the opening 37 and a second pivot (B) to rotate the door 4 to open and close the opening 37 along a different direction from a direction of the first pivot (A).

The first pivot may be formed by a first hinge 5 and a second hinge 6. The second pivot may be formed by the second hinge 6 and a third hinge 7.

In FIG. 41, the first pivot (A) may be formed along a longitudinal direction of the cabinet 3 (A vertical pivot) and the second pivot (B) may be formed along a width direction of the cabinet (A horizontal pivot). However, the location of the first pivot and the location of the second pivot may not be limited to what shown in FIG. 2 necessarily.

In other words, the first pivot and the second pivot may be located at various positions of the cabinet only if they enable the door to be rotated in various directions to open the opening (only if the first pivot and the second pivot form a preset angle).

Here, as shown in FIG. 31(*b*), the second pivot may be provided along the width direction of the cabinet to enable the door to be tilted with respect to a lower end of the opening 37. In this case, there may be an effect of efficient laundry loading caused by adjusting a tilting angle of the door, which will be described later.

The door 4 may include an inner frame 43 provided toward the outer panel 33 and an outer frame 41 coupled to the inner frame to from a profile of the door 4.

The door may further include a transparent part 45 insertedly provided in the opening 37. The transparent part 45 may prevent the laundry located in the laundry accommodating room (R) from coming out through the laundry introduction opening and it may also allow the user to see the laundry accommodating room (R) during the operation of the laundry treating apparatus.

As follows, the coupling structure between the hinge unit and the door according to this embodiment will be described in detail in reference to FIG. 42.

Figure 42:
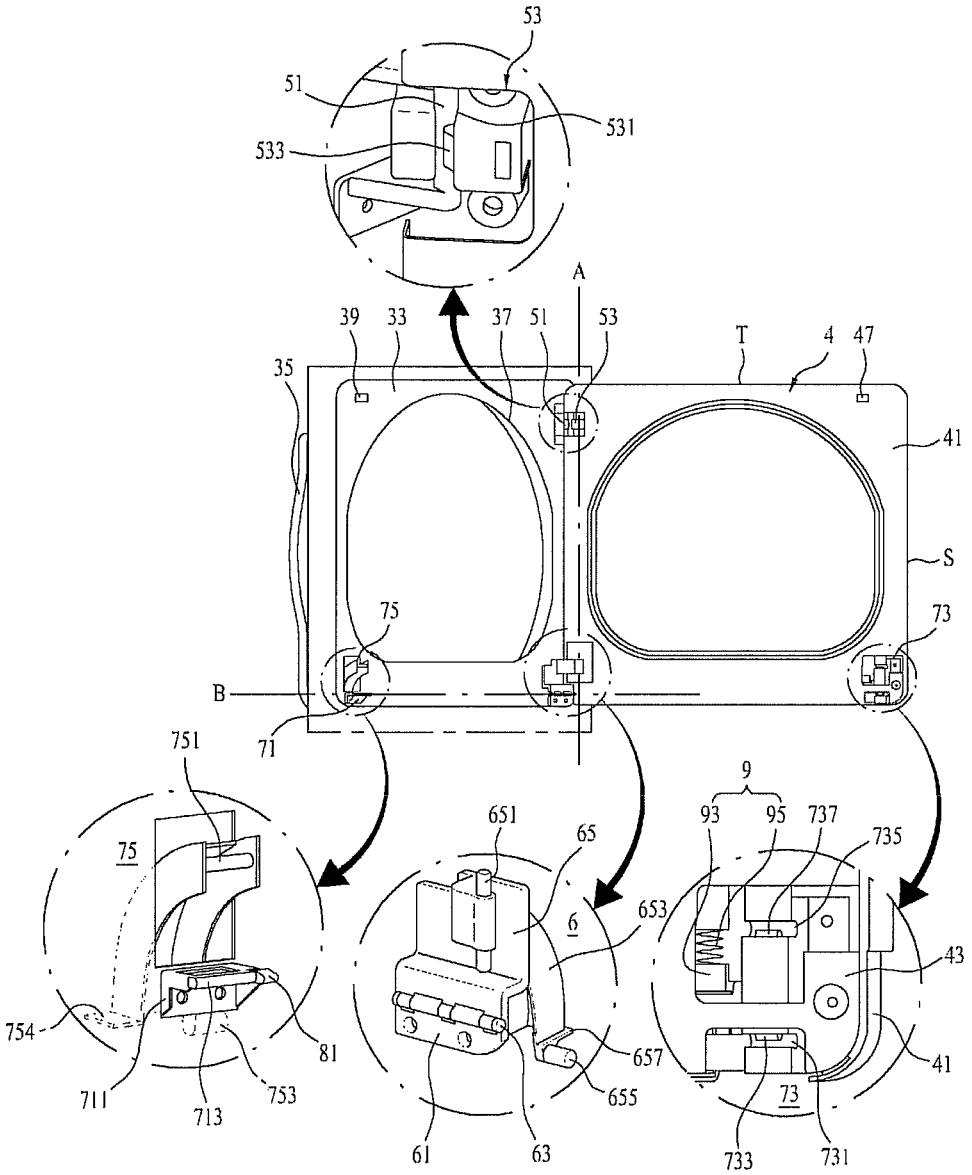
FIG. 42 is a diagram illustrating a door and a hinge unit provided in the laundry treating apparatus according to the embodiment shown in FIG. 41.

The inner frame 43 and the transparent part 45 are omitted from the door shown in FIG. 42 for the description of the coupling structure between the hinge unit and the door.

The hinge unit may include a first hinge 5 having a first shaft consisting of a first pivot (A) to couple and detach the door to and from the cabinet 3, a second hinge 6 having a second shaft consisting of the first pivot (A) together with the first shaft and a third shaft consisting of a second pivot (B), and a third hinge 7 having a fourth shaft consisting of the second pivot (B) together with the third shaft to couple and detach the door 4 to and from the cabinet 3.

In other words, the second hinge 6 may be secured to the cabinet and the door. The first hinge 5 and the third hinge 7 may selectively couple the door 4 to the cabinet.

As a result, the door 4 may be rotated on the first pivot (A) based on the user's selecting, to open and close the opening 37 (see FIG. 41(*a*)) or it may be rotated on the second pivot (B) to open and close the opening (see FIG. 41(*b*)).

The first hinge 5 may include the first shaft provided in either of the cabinet 3 and the door 4 and a first shaft detaching part 53 provided in the other one of the cabinet and the door, to detach the first shaft there from.

FIG. 42 illustrates the first shaft 51 provided in the outer panel 33 of the cabinet and the first shaft detaching part 53 provided in the door.

The first shaft 51 may be located in a right upper end of the outer panel 33, to form the first pivot (A).

The first shaft detaching part 53 may include a shaft receiving groove 531 to receive the first shaft 51 therein, a groove opening/closing part 533 to open and close the shaft receiving groove, an opening/closing part elastically supporting part 535 to elastically support the groove opening/closing part. The opening/closing part elastically supporting part 535 may be received in the groove opening/closing part 533 in FIG. 43. The first shaft 51 and the first shaft detaching part 53 will be described later in reference to FIG. 43.

The second hinge 6 may include a second shaft 651 provided corresponding to the first shaft of the first hinge 5 to form the first pivot (A) and a third shaft 63 forming the second pivot (B).

In detail, the second hinge 6 may be provided an intersection between the first pivot (A) and the second pivot (B). The second hinge 6 may include a cabinet securing part 61 secured to the outer panel 33 and a door securing part 65 secured to the door 4, with being rotatably connected to the cabinet securing part 61 via the third shaft 63.

The second shaft 651 may be provided in the door securing part 65 and the door 4 may be rotatably secured the second shaft 651.

As a result, the door 4 may be rotatable on the first pivot (A) formed by the first shaft 51 and the second shaft 651.

In the meanwhile, the door securing part 65 may be connected to the cabinet securing part 61 by the third shaft 63 forming the second pivot (B).

The second hinge 6 may further include a hinge supporter 653 having an end located in the cabinet and the other end connected with the door securing part 65 to be movable forwardly from the cabinet. The hinge supporter 653 may be extended from the door securing part 65 backwardly and downwardly, with forming a gentle curvature.

The hinge supporter 653 may be configured to adjust an opening angle of the door when the door 4 is rotated on the second pivot (B) to open the opening 37 and it may be coupled to a door tilting adjusting part (8, see FIG. 44) which will be described later.

In the meanwhile, the hinge supporter 653 may include a hinge supporter flange 657 to prevent the hinge supporter 653 from separated from the cabinet (the outer panel), when the door 4 is rotated on the second pivot (B).

The third hinge 7 may include a shaft forming part 71 fixed to either of the outer panel 33 and the door and a shaft detaching part 73 provided in other one of them, with the shaft forming part being detachable there from.

FIG. 42 illustrates the shaft forming part provided in the outer panel 33 and the shaft detaching part 73 provided in the door 4. As follows, the structure of the third hinge according to the embodiment will be described.

The shaft forming part 71 may include a body 711 fixed to the outer panel 33 and a fourth shaft 713 projected from the body 711 to form the second pivot (B) together with the third shaft 63.

The shaft detaching part 73 may include a fourth shaft receiving groove 731 located between the outer frame 41 and the inner frame 33 to receive the fourth shaft therein and a fourth shaft supporting projection 733 configured to support the fourth shaft 713 received in the fourth shaft receiving groove 731.

As a result, when the door 4 is rotated on the first pivot (A) toward the outer panel 33, the fourth shaft 713 may be received in the fourth shaft receiving groove 731 and supported by the fourth shaft supporting projection 733 after that.

The laundry treating apparatus having the configuration mentioned above may enable the user to rotate the door 4 on the first pivot (A) or the second pivot (B).

In other words, in the state of the door closing the opening 37, the first shaft 51 of the first hinge may be inserted in the shaft receiving groove 731 provided in the first shaft detaching part and the fourth shaft 713 of the third hinge may be inserted in the fourth shaft receiving groove 731 of the shaft detaching part.

As a result, when the user pulls the lateral surface (S) of the door 4, the fourth shaft 713 may be detached from the shaft detaching part 73 and it may be rotated on the first pivot (A). When the user pulls the top surface (T) of the door 4, the first shaft 51 may be detached from the first shaft detaching part 53 and it may be rotated on the second pivot (B).

In the meanwhile, when the door is rotated on the second pivot (B), the third hinge 7 may further include a door supporter 75 to adjust an opening angle of the door 4.

An end of the door supporter 75 may be located in the cabinet and the other end thereof may be detachably provided in the shaft detaching part 73.

A flange 754 may be provided at the end of the door supporter located in the cabinet, to prevent the door supporter from separated from the cabinet (the outer panel) when the door is rotated on the second pivot (B). A detaching shaft 751 may be provided in the door supporter to be detachable from the shaft detaching part 73.

In this case, the shaft detaching part 73 may further include a detaching shaft receiving groove 735 to receive the detaching shaft 751 and a detaching shaft supporting projection 737 to support the detaching shaft 751 received in the detaching shaft receiving groove.

Moreover, the shaft detaching part 73 may further include a supporting projection elastically supporting part (739, see FIG. 44) to elastically support the fourth shaft supporting projection 733 and the detaching shaft supporting projection 737.

The door supporter 75 and the hinge supporter 653 may enable the door tilting adjusting part 8 provided in the cabinet 3 to control the opening angle of the door 4, when the door 4 is rotated on the second pivot.

Adjusting the opening angle of the door when the door 4 is rotated on the second pivot (B) may realize an effect of smoothly loading the laundry into the laundry treating apparatus 100 which is configured to dry laundry.

The laundry treating apparatus 100 according to this embodiment is installed adjacent to the laundry treating apparatus only for washing will be described.

It will be very efficient to load the laundry into the laundry accommodating room (R), if the door is opened 30 to 60 degrees on the second pivot (B) when the user is moving the washed laundry to dry to the laundry treating apparatus according to the embodiment.

Especially, if the laundry treating apparatus only for washing is a top loading type capable of loading or unloading laundry via a top thereof, the effect mentioned above may be maximized.

A supporter projection 753 and a hinge supporter projection 655 detachable from the door tilting adjusting part 8 may be provided in the door supporter 75 and the hinge supporter 653, respectively, to be coupled to the door tilting adjusting part 8 to enable the door tilting adjusting part 8 to adjust the opening angle of the door.

Figure 43:
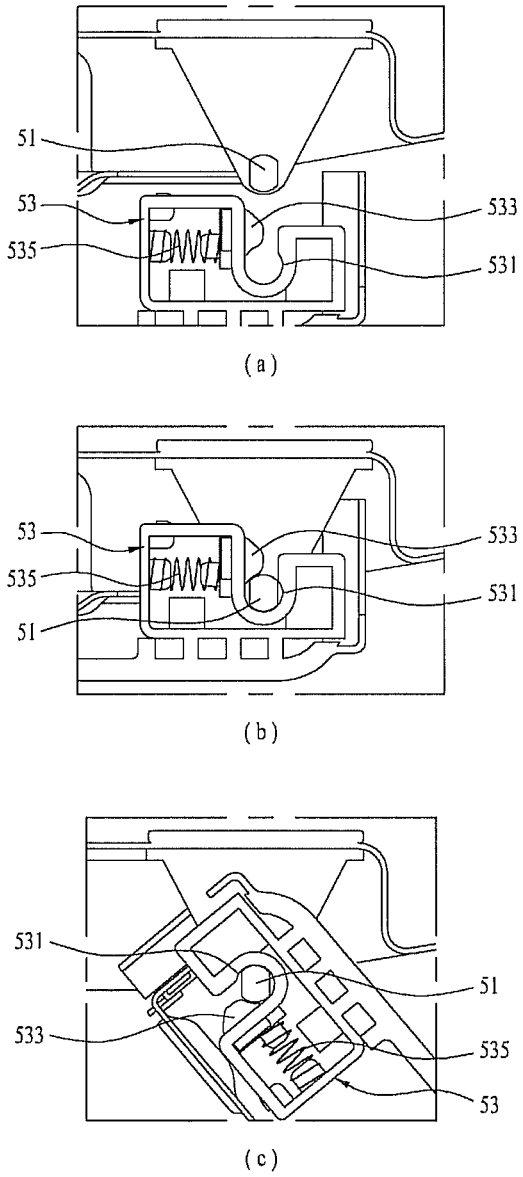
FIG. 43 is a diagram illustrating the motion of a first hinge according to the embodiment.

FIG. 43 illustrates the motion of the first hinge applied to the embodiment. As follows, the motion of the first hinge will be described in reference to FIG. 43.

In FIG. 43(*a*), the door 4 is rotated on the second pivot (B). Because of that, the first shaft 51 may not be received in the shaft receiving groove 531 and it may be located outside the shaft receiving groove 531, not in the shaft receiving groove 531.

The first shaft 51 may be a D-cut circular-section pole. Here, the D-cut circular section pole means that a cut-surface is provided in each of opposite ends of an outer circumferential surface of the first shaft or an end of the outer circumferential surface.

FIG. 43(*b*) illustrates that the door 4 closes the opening 37 airtight and the first shaft 51 may be received in the shaft receiving groove 531.

When the first shaft 51 is received in the shaft receiving groove 531 in the state shown in FIG. 43(*a*), the cut-surface of the first shaft 51 may press the opening/closing part elastically supporting part 535 of the groove opening/closing part 533. In other words, while the first shaft is getting inserted in the shaft receiving groove 531, the opening/closing part elastically supporting part 535 may be compressed. Once the first shaft 51 is completely inserted in the shaft receiving groove 531, the opening/closing part elastically supporting part 535 may be restituted and the first shaft 51 may be stopped from being separated from the shaft receiving groove 531 by a predetermined force as shown in FIG. 43(*b*).

In other words, when the door is rotated to close the opening 37 in the state of opening the opening 37 after rotated on the second pivot (B) (see FIG. 41(*b*) and FIG. 43(*a*)), the first shaft detaching part 53 provided in the door may be moved toward the first shaft 51 and the first shaft may be inserted in the shaft receiving groove 531 of the first shaft detaching part, to change the state into the state shown in FIG. 43(*b*).

In this case, an entrance of the shaft receiving groove 531 where the first shaft is inserted may have a corresponding shape to the shape of the first shaft 51. When the door 4 is rotated on the second pivot (B) to close the opening 37, the first shaft 51 may be inserted in the shaft receiving groove 531. However, when the door is rotated on the first pivot (A) after the first shaft is inserted in the shaft receiving groove, the first shaft 51 may be prevented from separated from the shaft receiving groove 531.

FIG. 43(*c*) illustrates the door 4 rotated on the first pivot (A).

When the door 4 is rotated on the first pivot (A) in the state of FIG. 43(*b*), the first shaft 51 installed in the door 4 may not be rotated but maintain the state. However, the first shaft detaching part 53 may be rotated along the door 4 and the first shaft 51 may be rotated a predetermined angle within the shaft receiving groove 531 accordingly. At this time, the opening/closing part elastically supporting part 535 may elastically support the groove opening/closing part 533. Because of that, the first shaft 51 may be rotated within the shaft receiving groove 531, without being separated from the shaft receiving groove 531.

In other words, when the door 4 is rotated on the second pivot (B), the first hinge 5 may be in the state shown in FIG. 43(*a*). When the door 4 closes the opening 37, it may be changed into the state shown in FIG. 43(*b*). When the door 4 is rotated on the first pivot (A), it may be changed into the state shown in FIG. 43(*c*).

As follows, the specific structure of the door tilting adjusting part 8 will be described in reference to FIG. 44.

Figure 44:
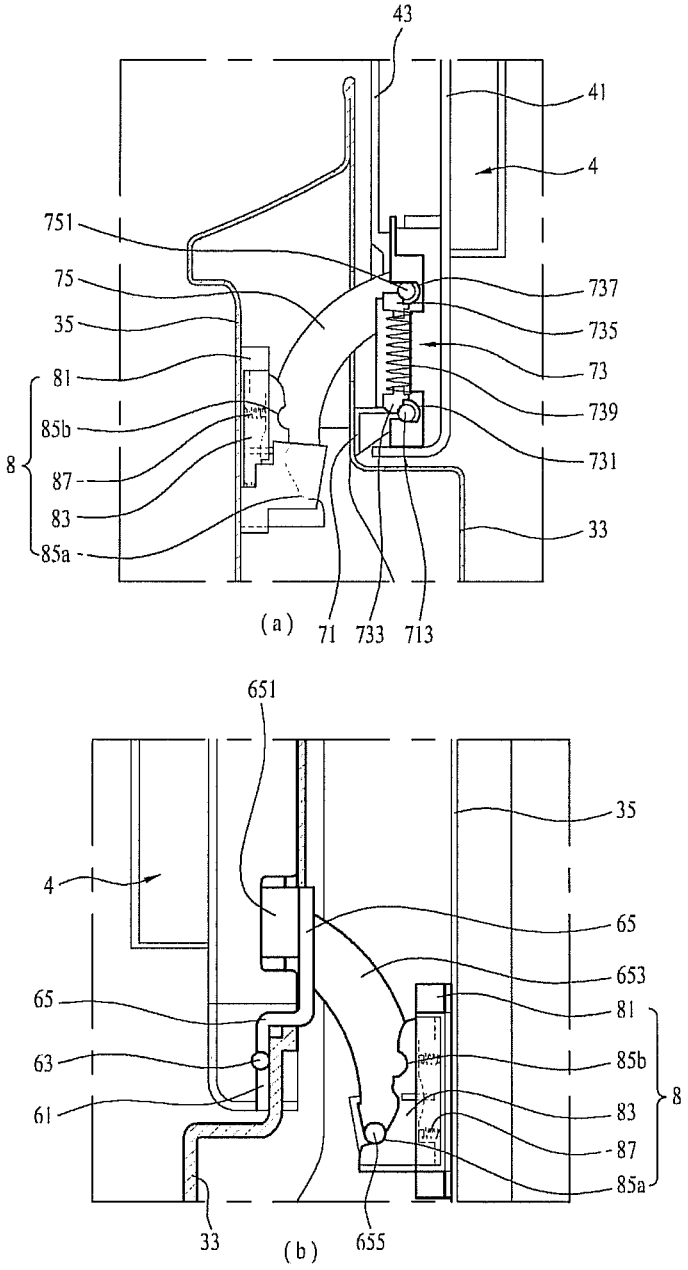
FIGS. 44 to 46 are diagrams illustrating movement of second and third hinges consisting of the hinge unit.

FIG. 44 illustrates that the door supporter 75 includes a door tilting adjusting part having the door supporter 75 detachable there from and a door tilting adjusting part having the hinge supporter 653 detachable there from (two door tilting adjusting parts). Alternatively, one of the door tilting adjusting parts 8 may be provided to be detachable from the door supporter 75 or the hinge supporter 653.

For explanation convenience, when describing the structures of the door tilting adjusting part having the door supporter detachable there from and the door tilting adjusting part having the hinge supporter 653 detachable there from, the structure of the door tilting adjusting part having the hinge supporter 653 detachable there from as shown in FIG. 44(*b*) will be described. In other words, the door tilting adjusting part 8 applied to the hinge supporter 653 may be identically applied to the door tilting adjusting part 8 applied to the door supporter 75.

The door tilting adjusting part 8 may be located in the cabinet 3, with being fixed to the inner panel 35 provided behind the outer panel 33.

In this case, the door tilting adjusting part 8 may include a fixing body 81 fixed to the inner panel 35, a detaching body 83 movably provided in the fixing body 81 and a projection receiving groove 85*a* and 85*b* provided in the detaching body to receive the hinge supporter projection 655.

A plurality of projection receiving grooves 85*a* and 85*b* may be provided in the detaching body 83, spaced apart a predetermined distance from each other.

One of the projection receiving grooves and another one of them may be spaced apart a predetermined distance from each other, to realize a preset opening angle when the hinge supporter projection 655 is received in the projection receiving grooves.

FIG. 44(*b*) illustrates that a projection receiving groove 85*a* receiving the hinge supporter projection 655 when the door is closed and another projection receiving groove 85*b* receiving the hinge supporter projection 655 when an opening angle of the door is approximately 30 or 60 degrees.

In the meanwhile, the detaching body 83 may be supported by the elastically supporting part 87 with respect to the fixing body 81. This is for the hinge supporter projection 655 to be detachable from the detaching body 83 smoothly.

As follows, the motion of the door supporter 75, the hinge supporter 653 and the door tilting adjusting part 8 will be described, when the door 4 is rotated on the second pivot (B) in the laundry treating apparatus having the door tilting adjusting part 8.

Figure 45:
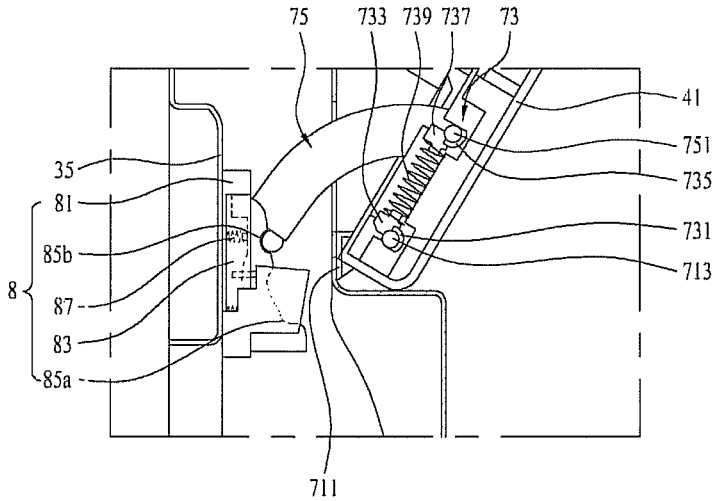
Figure 45:
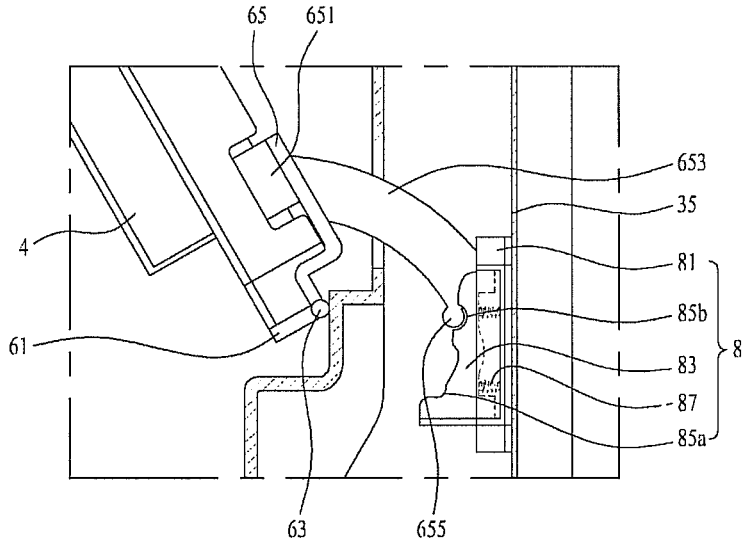
Figure 46:
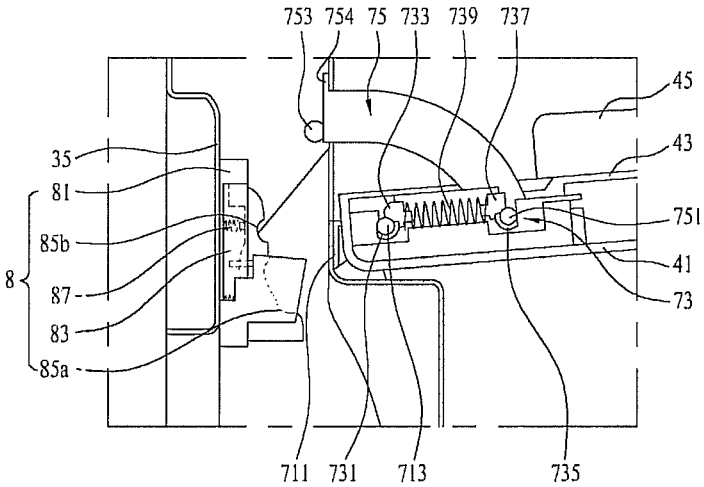
Figure 46:
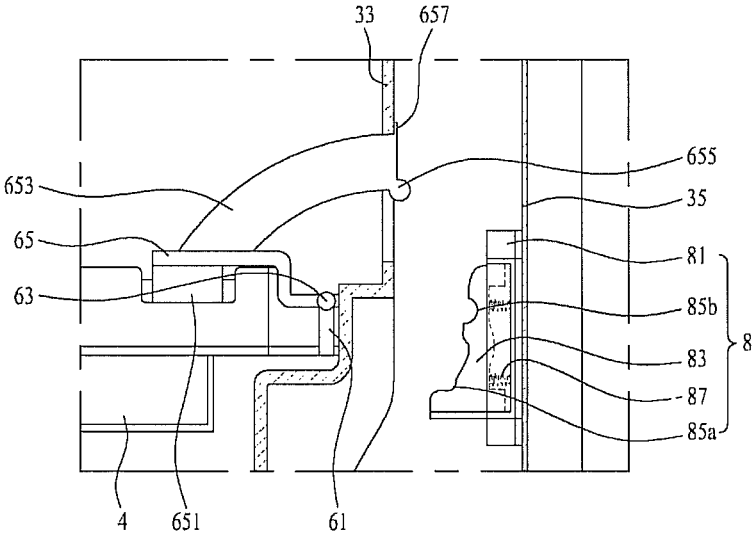

First of all, in reference to FIGS. 44(*a*), 45(*a*) and 46(*a*), the motion of the third hinge 7 and the door tilting adjusting part 8 will be described. In FIG. 44(*a*), the door 4 may be perpendicularly secured in the state of closing the opening 37. In FIG. 45(*a*), the door 4 may be rotated approximately 30 degrees on the second pivot (B). In FIG. 46(*a*), the door 4 is rotated approximately 85 degrees on the second pivot (B).

As mentioned above, the door tilting adjusting part 8 may be applied only to the hinge supporter 653, not to the door supporter 75. However, the structure applying the door tilting adjusting part 8 even to the door supporter 75 will be described in FIGS. 44(*a*), 45(*a*) and 46(*a*).

When the door 4 closes the opening 37 as shown in FIG. 44(*a*), the fourth shaft 713 of the third hinge and the detaching shaft 751 of the door supporter may be received in the fourth shaft receiving groove 731 and the detaching shaft receiving groove 735, respectively. The elastic force may be provided to the fourth shaft supporting projection 733 and the detaching shaft supporting projection 737 by the supporting projection elastically supporting part 739 and the fourth shaft supporting projection 733 and the detaching shaft supporting projection may support the fourth shaft and the detaching shaft, respectively.

Also, the supporter projection 753 of the door supporter 75 may be received in the projection receiving groove 85*a* of the door tilting adjusting part 8.

At this time, when the user pulls the top surface (T, see FIG. 42) of the door, the door 4 may be rotated on the fourth shaft 713 forming the second pivot and the end of the door supporter 75 fixed to the shaft detaching part 73 may be rotated.

When the end of the door supporter 75 is rotated approximately 30 degrees, the supporter projection 753 may be seated in the projection receiving groove 85*b* provided in the detaching body, as moving along the detaching body of the door tilting adjusting part 8 (the state shown in FIG. 45*a*). In other words, the supporter projection 753 may be fixed to the projection receiving groove 85*b* and the rotation of the door 4 may be then stopped.

Hence, when the user rotates the door 4 a larger angle, in other words, when he or she applies a predetermined force enough to detach the supporter projection 753 from the projection receiving groove 85*b*, the supporter projection 753 may be detached from the projection receiving groove 85*b* and the door 4 may be rotated. Once the door supporter 75 is detached from the door tilting adjusting part 8 to open the door completely, the flange 754 provided in the door supporter may contact with the rear surface of the outer panel 33, to support the door 4 (the state shown in FIG. 46(*a*)).

In other words, when the user rotates the door on the second pivot (B), the supporter projection 753 may be received in or detached from the projection receiving grooves 85*a* and 85*b* sequentially, to fix the rotational angle of the door 4.

In reference to FIGS. 44(*b*), 45(*b*) and 46(*b*), the motion of the second hinge 6 and the door tilting adjusting part 8 will be described. In FIG. 44(*b*), the door 4 may be perpendicularly secured in the state of closing the opening 37. In FIG. 44(*b*), the door 4 may be rotated approximately 30 degrees on the second pivot (B). In FIG. 46(*b*), the door 4 may be rotated approximately 85 degrees on the second pivot (B).

When the door 4 closes the opening 37, the hinge supporter projection 655 may maintain the state of being received in the projection receiving groove 85*a* of the door tilting adjusting part 8 (the state shown in FIG. 44(*b*)).

When the user pulls the top (T) of the door, the door 4 may be rotated on the third shaft 63 forming the second pivot (B). When the door 4 is rotated, the hinge supporter projection 655 of the hinge supporter 653 may be detached from the projection receiving groove 85*a* and it may be moved toward the outer panel 33 accordingly. After that, the hinge supporter projection 655 may be seated in the projection receiving groove 85*b* (the state shown in FIG. 45(*b*)). At this time, if other ones are formed rather than the projection receiving groove 85*b*, the rotated angle of the door 4 may be fixed at various angles, rather than approximately 30 degrees.

When the user rotates the door 4 a larger angle, that is, when the user applies a predetermined force enough to detach the hinge supporter projection 655 from the projection receiving groove 85*b*, the hinge supporter projection 655 may be detached from the projection receiving groove 85*b* and the door 4 may be rotated. Once the hinge supporter 653 is detached from the door tilting adjusting part 8 to open the door completely, the supporter flange 657 provided in the door supporter may contact with the rear surface of the outer panel 33, to support the door 4 (the state shown in FIG. 46(*b*)).

In other words, when the user rotates the door 4 on the second pivot (B), the hinge supporter projection 655 may be received in or detached from the projection receiving grooves 85*a* and 85*b* sequentially and the rotation angle of the door 4 may be fixed.

Moreover, the laundry treating apparatus according to the embodiment may further include a supporter elastically supporting part to supplement the door supporting force of the flanges 657 and 754 provided in the supporters 653 and 75, respectively, when the door 4 is open completely.

Figure 47:
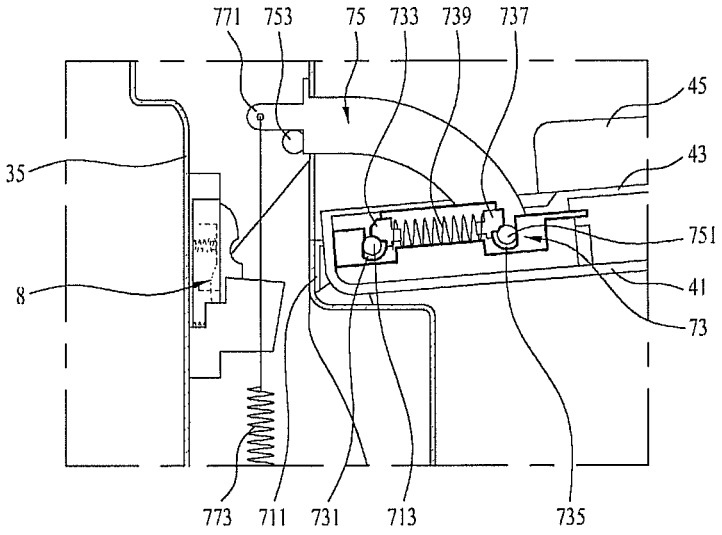
FIG. 47 is a diagram illustrating another embodiment of the second and third hinges.

FIG. 47 illustrates only the supporter elastically supporting part provided in the door supporter 75 and the supporter elastically supporting part may be provided in each of the door supporter and the hinge supporter. As follows, the supporter elastically supporting part 771 and 773 provided in the door supporter will be described for explanation convenience.

The supporter elastically supporting part may include an elastic part 773 to provide a restitution force to the door supporter 75 toward the inside of the cabinet when the door supporter 75 is detached out of the outer panel 33.

In this case, a rib 771 may be further provided at an end of the door supporter 75 to couple the elastic part 773 thereto. This is to prevent the elastic part 773 from interfering with other devices provided in the door, which might be generated when the elastic part 773 is directly coupled to the door supporter 75.

Figure 48:
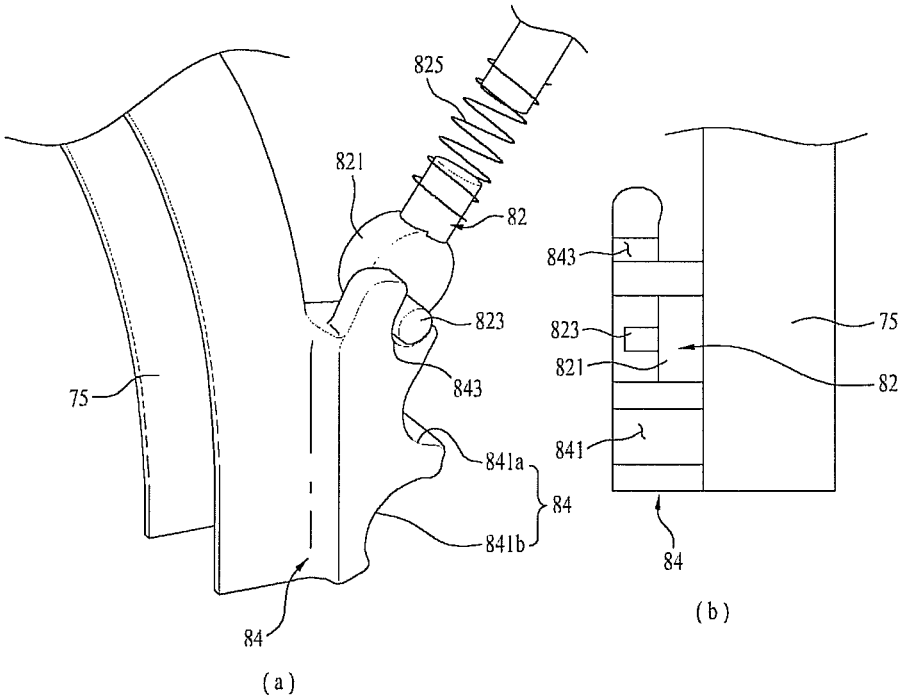
FIG. 48 is a diagram illustrating another embodiment of a door slope adjusting part provided in the laundry treating apparatus according to the embodiment.

In the meanwhile, the door tilting adjusting part may be variable in variable ways and FIG. 48 illustrates another embodiment of the door tilting adjusting part.

The door tilting adjusting part according to this embodiment may include a fixing part 82 located in the cabinet and a fixing part receiving groove 84 provided in the door supporter 75 to receive the fixing part 82.

The fixing part 82 may include a first fixing projection 821 having a predetermined diameter and a second fixing projection 823 projected from the first fixing projection, having a smaller diameter than the diameter of the first fixing projection.

Also, the first fixing projection 821 may be supported by the elastically supporting part 825 provided in a space formed between the outer panel 13 and the inner panel 15 of the cabinet 1.

The fixing part receiving groove 84 may include a first projection receiving groove 84 to receive the first fixing projection 821 and a second projection receiving groove 843 to receive the second fixing projection 821.

The second projection receiving groove 843 may be configured to receive only the second fixing projection 823 and the first projection receiving groove 841 may be configured to receive only an outer circumferential surface of the first fixing projection 821.

Also, at least 42 first projection receiving grooves 841 may be provided and one of them may be spaced apart a predetermined distance from another one.

The fixing part receiving groove 84 shown in FIG. 48 may include a second projection receiving groove 843 to support the door supporter when the opening is closed by the door, a first projection receiving groove 841*a* to support the door supporter when the door is opened 30 degrees on the second pivot, and a first projection receiving groove 841*b* to support the door supporter when the door 4 is opened 90 degrees on the second pivot (B).

The reason why the diameter of the second projection 823 is smaller than that of the first projection 821 is that it is difficult to form a groove capable of supporting the weight of the door in a gap between the second projection receiving groove 843 and the first projection receiving groove 841*a*, when the opening angle of the door is controlled only by the first projection 821.

FIG. 48 illustrates that the fixing part receiving groove 84 is provided only in the door supporter 75. However, in the door tilting adjusting part mentioned above, the fixing part receiving groove 84 may be provided in the hinge supporter 653 and the fixing part 82 may be detachable from the fixing part receiving groove provided in the hinge supporter.

In the laundry treating apparatus having the configuration mentioned above, the door 4 rotated on the second pivot may be supported by the flanges 754 and 657 provided in the door supporter and the hinge supporter, respectively. However, there might be danger of the detaching shaft 751 of the door supporter being separated from the shaft detaching part 73 because of the weight of the door.

As a result, the laundry treating apparatus according to the embodiment may further include a door fixing part to prevent the separation of the shaft detaching part 73 and the detaching shaft 751 of the door supporter. As follows, the door fixing part 9 will be described in reference to FIG. 9.

The door fixing part 9 may include a supporter coupling projection 93 located in the door 4, being movable to be fixed to the door supporter when the door is rotated on the second pivot.

At this time, a coupling projection seating part 755 may be provided in the door supporter 75 to seat the supporter coupling projection 93 thereon. The coupling projection seating part 755 may be projected from the door supporter 75, to be seated on the coupling projection seating part 755 in contact when the door is rotated.

In the meanwhile, the motion of the supporter coupling projection 93 may be enabled by a cam 91 provided in the shaft forming part 71 of the third hinge and the coupling projection elastically supporting part 95 provided in the door 4 to elastically support the supporter coupling projection 93.

In other words, the supporter coupling projection 93 may be provided adjacent to the shaft detaching part 73 and it may be supported by the elastically supporting part 95 (see FIG. 42). The cam 91 may be located outer to the fourth shaft receiving groove 731 provided in the shaft detaching part 73 and it may be located lower than the supporter coupling projection 93, when the door 4 is closed.

Also, the cam 91 may be formed in a shape enabling the supporter coupling projection 93 to move toward the door supporter 75, when the door 4 is rotated on the second pivot. At this time, the cam 91 may not be rotated but fixedly extended along a horizontal direction.

Figure 49:
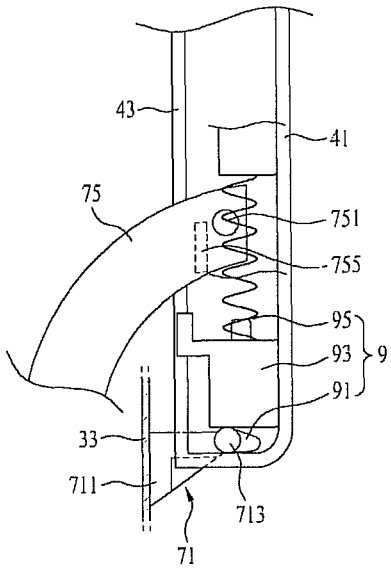
FIG. 49 is a conceptual diagram illustrating a door securing part provided in the laundry treating apparatus according to the embodiment of FIG. 41 to prevent downward movement of the door.
Figure 49:
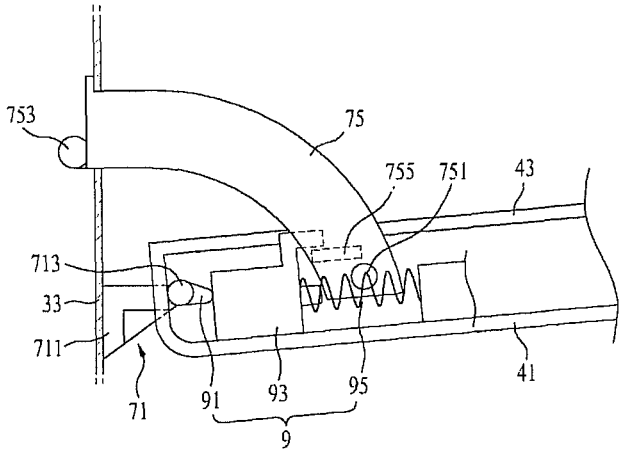

When the door fixing part 9 includes the configuration mentioned above, the door 4 may be rotated on the second pivot (B) and the supporter coupling projection 93 may be moved along an outer circumferential surface of the cam 91 within the door 4 almost horizontally as shown in FIG. 49(*b*). As a result, as the elastically supporting part 95 is pressed, the supporter coupling projection 93 may be moved toward the door supporter 75.

When the door is opened completely, the supporter coupling projection 93 may contact with the coupling projection seating part 755 provided in the door supporter and it may be stopped. As a result, the supporter coupling projection 93 may prevent the door 4 from being rotated a larger angle.

Also, even when the door 4 is rotated on the second pivot (B) only to open the opening 37 completely, the laundry treating apparatus may prevent the separation of the shaft detaching part 73 provided in the door and the detaching shaft 751 provided in the door supporter. This is because the door 4 might be separated from the laundry treating apparatus, when the door 4 is rotated a larger angle.

In the meanwhile, when the door 4 is rotated on the second pivot (B) to close the opening 37, the supporter coupling projection 93 may be moved within the door by the elastically supporting part 95, with maintaining the contact with the outer circumferential surface of the cam. At this time, the external force applied by the outer circumferential surface of the cam 91 may be eliminated from the elastically supporting part 95. Because of that, the elastically supporting part 95 may be restituted by the restitution force, without compressed. As a result, the supporter coupling projection 93 may be detached from the coupling projection seating part 755 and it may be changed as shown in FIG. 49(*a*).

The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure.

According to the embodiments, the opening angle of the door with respect to the opening may be adjusted for the user's convenience. In other words, the opening angle of the door may be adjusted in case that the user tries to open the opening relatively more or in case that the user tries to open it relatively less.

Furthermore, according to the embodiments, the door may be fixed even in the state of opening the opening after rotated. For example, when the door opens the opening relatively less, the distance between the door and the opening may be narrow. Because of that, the laundry may collide against the surface of the door to be loaded into the accommodating room smoothly, even though the user happens to fall the laundry to the surface of the door.

Any reference in this specification to "one embodiment," "an embodiment," "example embodiment," etc., means that a particular feature, structure, or characteristic described in connection with the embodiment is included in at least one embodiment of the invention. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet configured to define a profile thereof, the cabinet comprising a laundry introduction opening formed therein;

a door configured to open and close the laundry introduction opening; and a hinge comprising a first pivot to rotate the door along a first rotational direction and a second pivot to rotate the door along a second rotational direction, which is different from the first rotational direction, wherein the hinge comprises:

a first hinge having a first shaft configured to detachably secure the door to the cabinet and configured to form the first pivot;

a second hinge having a second shaft provided in parallel to the first shaft to form the first pivot, and a third shaft configured to rotatably secure the door to the cabinet to form the second pivot; and a third hinge having a fourth shaft configured to detachably secure the door to the cabinet and provided in parallel to the third shaft, wherein the door is detached from the fourth shaft when the door is rotated along the first rotational direction, and the door is detached from the first shaft when the door is rotated along the second rotational direction, wherein the first shaft includes cut-surfaces that face away from each other and a connecting surface that connects the cut-surfaces with each other, wherein the first hinge further comprises a first shaft detaching portion provided in the door that detachably receives the first shaft, wherein the first shaft detaching portion comprises:

a housing provided in the door; and a first shaft receiving groove provided in the housing, and wherein the first shaft receiving groove includes a cut-surface receiving groove that receives the cutsurfaces of the first shaft and a circular groove having a radius corresponding to a curvature of the connecting surface of the first shaft wherein the third hinge further includes an angle adjusting portion configured to adjust a rotational angle of the door when the door is rotated on the third shaft and the fourth shaft.

2. The laundry treating apparatus according to claim 1, wherein the first pivot is perpendicular to the second pivot.

3. The laundry treating apparatus according to claim 1, wherein the first shaft detaching portion further comprises:

a fixing body having one end located in the housing and the other end located in the first shaft receiving groove; and a fixing body elastic support located in the housing that elastically supports the fixing body.

4. The laundry treating apparatus according to claim 1, wherein the third hinge further comprises:

a connecting shaft provided in the fourth shaft, which is provided in the door; and a shaft receiving portion provided in the cabinet to receive the connecting shaft.

5. The laundry treating apparatus according to claim 4, wherein the third hinge further comprises a door elastic support, wherein the door elastic support is configured to control a rotational speed of the door when the door is rotated to open the laundry introduction opening.

6. The laundry treating apparatus according to claim 1, wherein the angle adjustment portion comprises at least one of a first angle adjusting portion or a second angle adjusting portion, wherein the first angle adjustment portion comprises a first adjusting plate fixed to the fourth shaft and a first detaching portion provided in the door to be coupled to the first adjusting plate to maintain a position of the door at a first angle, and the second angle adjustment portion comprises a second adjusting plate provided in the fourth shaft and a second detaching portion provided in the door to be coupled to the second plate to maintain the position of the door at a second angle which is larger than the first angle.

7. The laundry treating apparatus according to claim 6, wherein the first angle is approximately 0 degree and the second angle is approximately 30 degree.

8. The laundry treating apparatus according to claim 7, wherein the third hinge further comprises a door elastic support, and the door maintains a state of being opening at an angle between the second angle and approximately 90 degree by the door elastic support.

9. The laundry treating apparatus according to claim 1, wherein the second hinge further includes a cabinet securing portion secured to the cabinet and a door securing portion secured to the door, wherein the door securing portion is rotatably coupled to the door by the second shaft, and wherein the cabinet securing portion is rotatably coupled to the door securing portion by the third shaft.

10. A laundry treating apparatus, comprising:

a cabinet configured to define a profile thereof, the cabinet comprising a laundry introduction opening formed therein;

a door configured to open and close the laundry introduction opening; and a hinge comprising a first pivot to rotate the door along a first rotational direction and a second pivot to rotate the door along a second rotational direction, which is different from the first rotational direction, wherein the hinge comprises:

a first hinge having a first shaft configured to detachably secure the door to the cabinet and configured to form the first pivot;

a second hinge having a second shaft provided in parallel to the first shaft to form the first pivot, and a third shaft configured to rotatably secure the door to the cabinet to form the second pivot; and a third hinge having a fourth shaft configured to detachably secure the door to the cabinet and provided in parallel to third shaft, wherein the door is detached from the fourth shaft when the door is rotated along the first rotational direction, and the door is detached from the first shaft when the door is rotated along the second rotational direction, and wherein the third hinge further comprises:

a connecting shaft that projects from the fourth shaft toward the cabinet to be exposed outside of the door; and a shaft receiving portion provided in the cabinet, wherein the connecting shaft is coupled to the shaft receiving portion when the door is rotated along the second rotational direction, and wherein the connecting shaft is detached from the shaft receiving portion when the door is rotated along the first rotational direction wherein the thickness of the connecting shaft is smaller than the height of a receiving groove of the shaft receiving portion.

11. A laundry treating apparatus, comprising:

a cabinet configured to define a profile thereof, the cabinet comprising a laundry introduction opening formed therein;

a door configured to open and close the laundry introduction opening; and a hinge comprising a first pivot to rotate the door along a first rotational direction and a second pivot to rotate the door along a second rotational direction, which is different from the first rotational direction, wherein the hinge comprises:

a first hinge having a first shaft configured to detachably secure the door to the cabinet and configured to form the first pivot;

a second hinge having a second shaft provided in parallel to the first shaft to form the first pivot, and a third shaft configured to rotatably secure the door to the cabinet to form the second pivot; and a third hinge having a fourth shaft configured to detachably secure the door to the cabinet and provided in parallel to third shaft, wherein the door is detached from the fourth shaft when the door is rotated along the first rotational direction, and the door is detached from the first shaft when the door is rotated along the second rotational direction, wherein the third hinge further includes an angle adjusting portion configured to adjust a rotational angle of the door when the door is rotated on the third shaft and the fourth shaft, and wherein the angle adjusting portion comprises:

a first angle adjusting portion having a first adjusting plate fixed to the fourth shaft and a first detaching portion provided in the door to be coupled to the first adjusting plate to maintain a position of the door at a first angle; and a second angle adjusting portion having a second adjusting plate provided in the fourth shaft and a second detaching portion provided in the door to be coupled to the second plate to maintain the position of the door at a second angle which is larger than the first angle.

* * * * *